US011885025B2

(12) United States Patent
Kawata et al.

(10) Patent No.: US 11,885,025 B2
(45) **Date of Patent: *Jan. 30, 2024**

(54) HIGH-STRENGTH STEEL SHEET HAVING EXCELLENT MOLDABILITY AND IMPACT RESISTANCE, AND METHOD FOR MANUFACTURING HIGH-STRENGTH STEEL SHEET HAVING EXCELLENT MOLDABILITY AND IMPACT RESISTANCE

(71) Applicant: NIPPON STEEL CORPORATION, Tokyo (JP)

(72) Inventors: Hiroyuki Kawata, Tokyo (JP); Eisaku Sakurada, Tokyo (JP); Kohichi Sano, Tokyo (JP); Takafumi Yokoyama, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/312,871

(22) PCT Filed: Dec. 11, 2018

(86) PCT No.: PCT/JP2018/045552
§ 371 (c)(1),
(2) Date: Jun. 10, 2021

(87) PCT Pub. No.: WO2020/121418
PCT Pub. Date: Jun. 18, 2020

(65) Prior Publication Data

US 2022/0127691 A1 Apr. 28, 2022

(51) Int. Cl.
*C23C 2/06* (2006.01)
*C21D 8/02* (2006.01)
(Continued)

(52) U.S. Cl.
CPC ..... *C23C 2/06* (2013.01); *C21D 8/0226* (2013.01); *C21D 8/0236* (2013.01);
(Continued)

(58) Field of Classification Search
CPC .... C23C 2/06; C23C 2/40; C23C 2/28; C21D 8/0226; C21D 8/0236; C21D 8/0263;
(Continued)

(56) References Cited

U.S. PATENT DOCUMENTS

2013/0087254 A1 4/2013 Funakawa et al.
2018/0216206 A1* 8/2018 Yokoi ..... C21D 6/002

FOREIGN PATENT DOCUMENTS

CN 101768703 B * 9/2011
EP 2 740 812 A1 6/2014
(Continued)

OTHER PUBLICATIONS

Liu et al., (CN101768703 B google machine translation), Sep. 21, 2011, entire translation (Year: 2011).*

*Primary Examiner* — Keith Walker
*Assistant Examiner* — Adil A. Siddiqui
(74) *Attorney, Agent, or Firm* — Birch, Stewart, Kolasch & Birch, LLP

(57) ABSTRACT

A high-strength steel sheet includes a chemical composition including: by mass %, C: 0.080 to 0.500%, Si: 2.50% or less, Mn: 0.50 to 5.00%, P: 0.100% or less, S: 0.0100% or less, Al: 0.001 to 2.500%, N: 0.0150% or less, O: 0.0050% or less, and the balance: Fe and inevitable impurities. The high-strength steel sheet satisfying a predetermined formula has a microstructure in a region from ⅛t to ⅜t from a steel sheet surface. The microstructure includes: by volume %, 20% or more of acicular ferrite, 20% or more of an island-
(Continued)

shaped hard structure including residual austenite, 2% to 25% of residual austenite, and 20% or less of aggregated ferrite.

17 Claims, 2 Drawing Sheets

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23C 2/40*** | (2006.01) |
| ***C23C 2/28*** | (2006.01) |
| ***C23C 2/26*** | (2006.01) |

(52) U.S. Cl.
CPC ..... *C21D 8/0263* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C23C 2/261* (2022.08); *C23C 2/28* (2013.01); *C23C 2/29* (2022.08); *C23C 2/40* (2013.01); *C21D 2211/001* (2013.01); *C21D 2211/005* (2013.01)

(58) Field of Classification Search
CPC ..... C21D 9/46; C21D 2211/001; C21D 2211/005; C21D 1/18; C21D 1/185; C21D 1/19; C21D 1/20; C21D 1/25; C21D 8/021; C21D 8/0268; C21D 8/041; C21D 8/0426; C21D 8/0436; C21D 8/0447; C21D 8/0463; C21D 8/0468; C21D 8/0473; C21D 2211/002; C21D 2211/003; C21D 2211/008; C21D 2211/009; C21D 6/005; C21D 8/0247; C21D 8/0273; C21D 9/48; C22C 38/001; C22C 38/002; C22C 38/02; C22C 38/04; C22C 38/06; C22C 38/005; C22C 38/28; C22C 38/34; C22C 38/12; C22C 38/16; C22C 38/22; C22C 38/32; C22C 38/38; C22C 38/40; C22C 38/14; C22C 38/42; C22C 38/44; C22C 38/58; C25D 5/50
See application file for complete search history.

(56) References Cited

FOREIGN PATENT DOCUMENTS

| | | | | |
|---|---|---|---|---|
| JP | 2001-40451 | A | 2/2001 | |
| JP | 2004-238679 | A | 8/2004 | |
| JP | 2004-323958 | A | 11/2004 | |
| JP | 2006-274318 | A | 10/2006 | |
| JP | 2008-297609 | A | 12/2008 | |
| JP | 2011-195956 | A | 10/2011 | |
| JP | 2011-225941 | A | 11/2011 | |
| JP | 2012-26032 | A | 2/2012 | |
| JP | 2013-181208 | A | 9/2013 | |
| WO | WO 2009/142362 | A1 | 11/2009 | |
| WO | WO-2017022027 | A1 * | 2/2017 | ..... B32B 15/01 |

* cited by examiner

HIGH-STRENGTH STEEL SHEET HAVING EXCELLENT MOLDABILITY AND IMPACT RESISTANCE, AND METHOD FOR MANUFACTURING HIGH-STRENGTH STEEL SHEET HAVING EXCELLENT MOLDABILITY AND IMPACT RESISTANCE

TECHNICAL FIELD

The present invention relates to a high-strength steel sheet excellent in formability and impact resistance, and a manufacturing method of a high-strength steel sheet excellent in formability and impact resistance.

BACKGROUND

In recent years, a high-strength steel sheet has been often used in an automobile for reducing a weight of a vehicle body to improve a fuel efficiency and reduce carbon dioxide emission, and absorbing collision energy in an event of collision to ensure protection and safety of a passenger.

However, in general, when the strength of a steel sheet is increased, the formability (e.g., ductility, hole expandability) decreases to cause the steel sheet to be difficult to process into a complicated shape. Since it is thus not easy to attain both the formability (e.g., ductility, hole expandability) and impact resistance, various techniques have been proposed so far.

For instance, Patent Literature 1 discloses a high-strength steel sheet having a tensile strength of 780 MPa or more in which a strength-elongation balance and strength-formability for extension flange are improved by defining a steel sheet structure in which, by a space factor, ferrite is from 5 to 50%, residual austenite is 3% or less, and the balance is martensite (an average aspect ratio of 1.5 or more).

Patent Literature 2 discloses a technique of forming a composite structure including ferrite with an average crystal grain diameter of 10 μm or less, martensite of 20 volume % or more, and a second phase in a high-tensile hot-dip galvanized steel sheet, thereby improving corrosion resistance and secondary work brittleness resistance.

Patent Literatures 3 and 8 each disclose a technique of forming a metal structure of a steel sheet in a composite structure of ferrite (soft structure) and bainite (hard structure), thereby securing a high elongation even with a high strength.

Patent Literatures 4 discloses a technique of forming a composite structure in which, in a space factor, ferrite accounts for 5 to 30%, martensite accounts for 50 to 95%, ferrite has an average grain size of a 3-μm-or-ess equivalent circle diameter, and martensite has an average grain size of a 6-μm-or-ess equivalent circle diameter, thereby improving elongation and elongation flangeability in a high-strength steel sheet.

Patent Literatures 5 discloses a technique of attaining both strength and elongation at a phase interface at which a main phase is a precipitation strengthened ferrite precipitated by controlling a precipitation distribution by a precipitation phenomenon (interphase interfacial precipitation) that occurs mainly due to intergranular diffusion during transformation from austenite to ferrite.

Patent Literature 6 discloses a technique of forming a steel sheet structure in a ferrite single phase and strengthening ferrite with fine carbides, thereby attaining both strength and elongation. Patent Literature 7 discloses a technique of attaining elongation and hole expandability by setting 50% or more of austenite grains having a required carbon concentration at an interface between austenite grains and ferrite phase, bainite phase, and martensite phase in a high-strength thin steel sheet.

In recent years, it has been attempted to use a high-strength steel having 590 MPa or more in order to significantly reduce a weight of an automobile and improve impact resistance. However, improvement in formability is difficult with a typical technique. Accordingly, there is a demand for a high-strength steel having 590 MPa or more and an excellent (e.g., formability, ductility and hole expandability).

CITATION LIST

Patent Literature(s)

Patent Literature 1: JP2004-238679A
Patent Literature 2: JP2004-323958A
Patent Literature 3: JP2006-274318A
Patent Literature 4: JP2008-297609A
Patent Literature 5: JP2011-225941A
Patent Literature 6: JP2012-026032A
Patent Literature 7: JP2011-195956A
Patent Literature 8: JP2013-181208A

SUMMARY OF THE INVENTION

Problem(s) to be Solved by the Invention

In light of the demand of improving formability in a high-strength steel sheet with the maximum tensile strength (TS) of 590 MPa or more for attaining a weight reduction in an automobile and impact resistance, an object of the invention is to improve formability in a high-strength steel sheet (including a galvanized steel sheet, zinc-alloy plated steel sheet, galvannealed steel sheet, and galvannealed alloy steel sheet) with TS of 590 MPa or more, and to provide a high-strength steel sheet for solving this problem and a manufacturing method of a high-strength steel sheet excellent in formability and impact resistance.

Means for Solving the Problem(s)

The inventors have diligently studied a solution to the above problem. As a result, the inventors have found that a microstructure having an excellent formability as well as both of a high strength and impact resistance can be formed in a steel sheet after a heat treatment by defining a microstructure of a material steel sheet (steel sheet for heat treatment) as a lath structure containing a predetermined carbide and by performing a required heat treatment.

The invention has been made based on the above findings, and the gist thereof is as follows.

1. A high-strength steel sheet excellent in formability and impact resistance has a chemical composition including: by mass %, C in a range from 0.080 to 0.500%;
Si of 2.50% or less;
Mn in a range from 0.50 to 5.00%;
P of 0.100% or less;
S of 0.0100% or less;
Al in a range from 0.001 to 2.000%;
N of 0.0150% or less;
O of 0.0050% or less; and
the balance consisting of Fe and inevitable impurities, and in a steel sheet satisfying a formula (1), the high-strength steel sheet having a micro structure in a region from ⅛t (t: sheet thickness) to ⅜t (t: sheet thickness) from a steel sheet surface, the micro structure including: by volume %, 20% or more of acicular ferrite;

20% or more of an island-shaped hard structure including one or more of martensite, tempered martensite, and residual austenite;

the residual austenite in a range from 2% to 25%;

20% or less of aggregated ferrite; and

5% or less of pearlite and/or cementite in total, in the island-shaped hard structure, an average aspect ratio of a hard region having an equivalent circle diameter of 1.5 μm or more is 2.0 or more, and an average aspect ratio of a hard region having an equivalent circle diameter of less than 1.5 μm is less than 2.0, and an average of a number density per unit area (hereinafter also simply referred to as "the number density") of the hard region having the equivalent circle diameter of less than 1.5 μm is equal to or more than $1.0\times10^{10}$ pieces·$m^{-2}$, and when the number density of the island-shaped hard structure in an area of at least $5.0\times1^{0-10}$ $m^2$ in each of three view fields is obtained, a ratio between a maximum number density and a minimum number density thereof is 2.5 or less, $$[Si]+0.35[Mn]+0.15[Al]+2.80[Cr]+0.84[Mo]+0.50[Nb]+0.30[Ti]\geq1.00 \quad (1)$$

[element]: mass % of each element.

2. In the high-strength steel sheet excellent in formability and impact resistance according to the above aspect, the chemical composition further includes: by mass %, one or more of Ti of 0.300% or less; Nb of 0.100% or less; and V of 1.00% or less.

3. In the high-strength steel sheet excellent in formability and impact resistance according to the above aspect, the chemical composition further includes: by mass %, one or more of Cr of 2.00% or less, Ni of 2.00% or less, Cu of 2.00% or less, Mo of 1.00% or less, W of 1.00% or less, and B of 0.0100% or less.

4. In the high-strength steel sheet excellent in formability and impact resistance according to the above aspect, the chemical composition further includes: by mass %, one or more of Sn of 1.00% or less, and Sb of 0.200% or less.

5. In the high-strength steel sheet excellent in formability and impact resistance according to the above aspect, the chemical composition further includes: by mass %, one or more of Ca, Ce, Mg, Zr, La, Hf, and REM being 0.0100% or less in total.

6. In the high-strength steel sheet excellent in formability and impact resistance according to the above aspect, the high-strength steel sheet includes a galvanized layer or a zinc alloy plated layer on one surface or both surfaces of the high-strength steel sheet.

7. In the high-strength steel sheet excellent in formability and impact resistance according to the above aspect, the galvanized layer or the zinc alloy plated layer is an alloyed plated layer.

8. A method of manufacturing the high-strength steel sheet excellent in formability and impact resistance according to the above aspect includes: a hot rolling process of heating cast slab having the components according to the above aspect to a temperature in a range from 1080 degrees C. to 1300 degrees C., and subsequently subjecting the cast slab to hot rolling, where hot rolling conditions in a temperature region from a maximum heating temperature to 1000 degrees C. satisfy a formula (A) and a hot rolling completion temperature falls in a range from 975 degrees C. to 850 degrees C.;

a cooling process in which cooling conditions applied from the completion of the hot rolling to 600 degrees C. satisfy a formula (2) that represents sum of transformation progress degrees in 15 temperature regions obtained by equally dividing a temperature region ranging from the hot rolling completion temperature to 600 degrees C., and a temperature history that is measured by every 20 degrees C. from a time when 600 degrees C. is reached to a time when an intermediate heat treatment below is started satisfies the formula (3);

a cold rolling process of cold rolling at a rolling reduction of 80% or less; and an intermediate heat treatment process comprising: heating the cold-rolled cast slab to a temperature in a range from (Ac3−30) degrees C. to (Ac3+100) degrees C. at an average heating rate of at least 30 degrees C. per second in a temperature region ranging from 650 degrees C. to (Ac3−40) degrees C.; limiting a dwell time in a temperature region ranging from the heating temperature to (maximum heating temperature−10) degrees C. to 100 seconds or less, and subsequently cooling the cast slab from the heating temperature at an average cooling rate of at least 30 degrees C. per second in a temperature region ranging from 750 degrees C. to 450 degrees C.;

and performing a main heat treatment process including:

heating the steel sheet for heat treatment to a temperature ranging from (Ac1+25) degrees C. to an Ac3 point so that a temperature history from 450 degrees C. to 650 degrees C. satisfies a formula (B) below and subsequently a temperature history from 650 degrees C. to 750 degrees C. satisfies a formula (C) below;

retaining the steel sheet for heat treatment for 150 seconds or less at the heating temperature;

cooling the steel sheet for heat treatment from the heating retention temperature to a temperature region ranging from 550 degrees C. to 300 degrees C. at an average cooling rate of at least 10 degrees C. per second in a temperature region from 700 degrees C. to 550 degrees C.;

limiting a dwell time in the temperature region from 550 degrees C. to 300 degrees C. to 1000 secondes or less, and setting dwell conditions in the temperature region from 550 degrees C. to 300 degrees C. to satisfy a formula (4) below.

[NumericalFormula 1] (A)

$$\sum_{i=1}^{n}\left[A\cdot\frac{h_i-h_{i-1}}{h_i}\cdot\exp\left(-\frac{B}{T_i+273}\right)\cdot t^{0.5}\right]\geq1.00$$

n: rolling pass number up to 1000 degrees C. after removal from the heating furnace $h_i$: finishing sheet thickness [mm] after i-pass $T_i$: rolling temperature [degrees C.] at the i pass $t_i$: elapsed time [seconds] after the rolling at the i pass to an (i+1) pass $A=9.11\times10^7$, $B=2.72\times10^4$: constant value

[NumericalFormula 2] (2)

$$\left(\sum_{n=1}^{15}\left[\frac{1.88\times10^2}{1+17\mathrm{Ti}+51\mathrm{Nb}+3.3\sqrt{\mathrm{Mo}}+35\sqrt{\mathrm{B}}}\cdot\exp\left\{36.1-(0.0424-0.0027n)Tf-1.64n-14.4\mathrm{C}+0.62Si-1.36Mn+0.82\mathrm{Al}-0.62Cr-0.62\mathrm{Ni}-\frac{2.85\times10^4}{253+(1.033-0.067n)Tf+40n}\right\}\cdot t(n)^{0.25}\right]\right)^{0.333}\leq1.00$$

t(n): dwell time in the n-th temperature region element symbol: mass % of the element Tf: hot rolling completion temperature [degrees C.]

[NumericalFormula 3] (3)

$$1.00\leq\left[\frac{T_n\cdot\{\log_{10}(t_n)+\mathrm{C}\}}{1.50\times10^4}\right]^2\leq1.50$$

$$t_1=\Delta t_1(n=1)$$

$$t_n=\Delta t_n+\frac{T_{n-1}}{T_n}\cdot\{\log_{10}(t_{n-1})+\mathrm{C}\}(n>1)$$

$$\mathrm{C}=20.00-1.28\cdot\mathrm{Si}^{0.5}-0.13\cdot\mathrm{Mn}^{0.5}-0.47\cdot\mathrm{Al}^{0.5}-1.20\cdot\mathrm{Ti}-2.50\cdot\mathrm{Nb}-0.82\cdot\mathrm{Cr}^{0.5}-1.70\cdot\mathrm{Mo}^{0.5}$$

$T_n$: an average steel sheet temperature [degrees C.] from the (n−1)th calculation time point to the n-th calculation time point $t_n$: effective total time [hour] for carbide growth at time of the n-th calculation $\Delta t_n$: an elapsed time [hour] from the (n−1)th calculation time point to the n-th calculation time point C: parameters related to a growth rate of carbides (element symbol: mass % of element)

[Numerical Formula 4] (B)

$$a_0=1.00$$

$$a_n=\frac{\mathrm{F}}{C_n}\cdot t_n^{\left(\frac{1}{K}\right)}+10^{\left(\frac{354+5n}{359+5n}\cdot\log_{10}a_{n-1}\right)}$$

$$K+\log_{10}a_{20}\leq3.20$$

$$C_n:\left\{1.28+34\cdot\left(1-\frac{89+2n}{130}\right)^2\right\}\cdot\mathrm{Si}^{0.5}+0.13\cdot\mathrm{Mn}^{0.5}+0.47\cdot\mathrm{Al}^{0.5}+0.82\cdot\mathrm{Cr}^{0.5}+1.70\cdot\mathrm{Mo}^{0.5}$$

each element of the chemical composition represents an added amount [mass %]

F: constant value, 2.57

$t_n$: elapsed time [second] from (440+10n) degrees C. to (450+10n) degrees C.

K: a value of a middle side of the formula (3)

[Numerical Formula 5] (C)

$$1.00\leq\sum_{n=1}^{10}\frac{M}{N+P}\cdot\exp\left(-\frac{Q}{918+10n}\right)\cdot t_n^{0.5}\leq5.00$$

M: constant, $5.47\times10^{10}$

N: a value of the left side of the formula (B)

P: 0.38Si+0.64Cr+0.34Mo each element of the chemical composition represents an added amount [mass %]

Q: $2.43\times10^4$ $t_n$: elapsed time [second] from (640+10n) degrees C. to (650+10n) degrees C.

[Numercial Formula 6] (4)

$$\left[\sum_{n=1}^{10}1.29\times10^2\cdot\left\{\mathrm{Si}+0.9\mathrm{Al}\cdot\left(\frac{T(n)}{550}\right)^2+0.3(\mathrm{Cr}+1.5\mathrm{Mo})\cdot\frac{T(n)}{550}\right\}\cdot(B_s-T(n))^3\cdot\exp\left(-\frac{1.44\times10^4}{T(n)+273}\right)\cdot t^{0.5}\right]^{-1}\leq1.00$$

T(n): an average temperature of the steel sheet in an n-th time zone obtained by equally dividing the dwell time into 10 parts

*Bs* point (degrees C.)=611-33[Mn]−17[Cr]−17[Ni]−21[Mo]−11[Si]+30[Al]+(24[Cr]+15[Mo]+5500[B]+240[Nb])/(8[C])

[element]: mass % of each element at Bs<T(n), (Bs−T(n))=0 t: total [seconds] of a dwell time in the temperature region from 550 degrees C. to 300 degrees C.

9. The manufacturing method according to the above aspect further includes subjecting the steel sheet for heat treatment to cold rolling at a rolling reduction of 15.0% or less before the main heat treatment process.

10. The manufacturing method according to the above aspect further includes heating the steel sheet after the main heat treatment process to a temperature in a range from 200 degrees C. to 600 degrees C. to be tempered.

11. The manufacturing method according to the above aspect further includes subjecting the steel sheet after the main heat treatment process or the tempered steel sheet to skin pass rolling at a rolling reduction of 2.0% or less.

12. A method according to the above aspect for manufacturing the high-strength steel sheet according to the above aspect includes:

immersing the high-strength steel sheet excellent in formability and impact resistance in the manufacturing method according to the above aspect in a plating bath including zinc as a main component to form the galvanized layer or the zinc alloy plated layer on one surface or both surfaces of the steel sheet.

13. The method according to the above aspect for manufacturing the high-strength steel sheet according to the above aspect includes:

immersing the high-strength steel sheet dwelling in the temperature region in the range from 550 degrees C. to 300 degrees C. in a plating bath including zinc as a main component to form the galvanized layer or the zinc alloy plated layer on one surface or both surfaces of the steel sheet.

14. A method of manufacturing the high-strength steel sheet according to the above aspect includes:

forming, by electroplating, the galvanized layer or the zinc alloy plated layer on one surface or both surfaces of the high-strength steel sheet excellent in formability and impact resistance in the manufacturing method according to the above aspect.

15. A method of manufacturing the high-strength steel sheet according to the above aspect includes:

forming, by electroplating, the galvanized layer or the zinc alloy plated layer on one surface or both surfaces of the high-strength steel sheet excellent in formability and impact resistance in the manufacturing method according to the above aspect.

16. The method according to the above aspect for manufacturing the high-strength steel sheet according to the above aspect includes:

heating the galvanized layer or the zinc alloy plated layer to a temperature in a range from 400 degrees C. to 600 degrees C. to apply an alloying treatment to the the galvanized layer or the zinc alloy plated layer.

According to the above aspects of the invention, a high-strength steel sheet excellent in formability and impact resistance can be provided.

DESCRIPTION OF EMBODIMENT(S)

Figure 1:
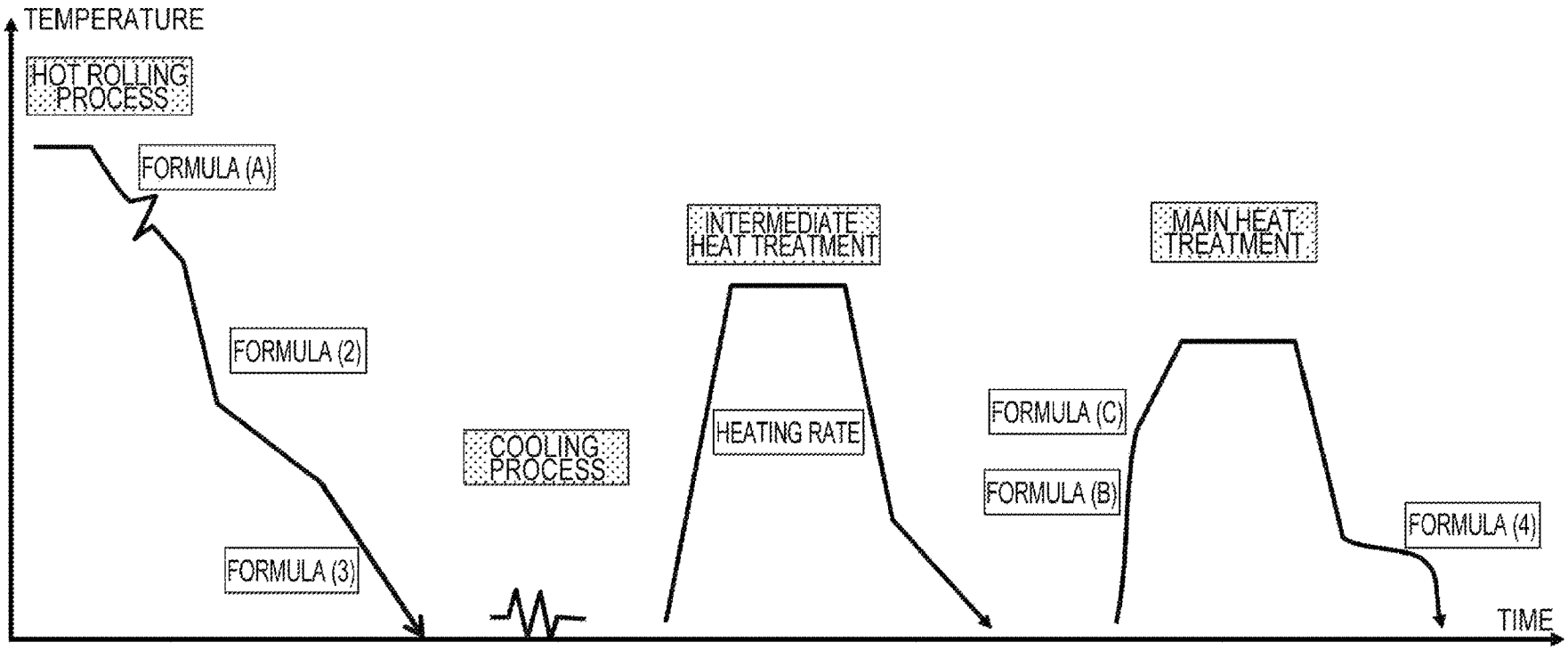
FIG. 1 schematically shows a manufacturing method of a high-strength steel sheet excellent in formability and impact resistance.

In order to manufacture a high-strength steel sheet having excellent formability and impact resistance according to an exemplary embodiment of the invention, it is necessary to manufacture a steel sheet for heat treatment (hereinafter, occasionally referred to as a "steel sheet a") and subject the steel sheet for heat treatment to a heat treatment. The steel sheet for heat treatment has a chemical composition including, by mass %, C in a range from 0.080 to 0.500%; Si of 2.50% or less; Mn in a range from 0.50 to 5.00%; P of 0.100% or less; S of 0.010% or less; Al in a range from 0.010 to 2.000%; N of 0.0015% or less; O of 0.0050% or less; and the balance consisting of Fe and inevitable impurities, and in a steel sheet satisfying a formula (1), the high-strength steel sheet having a micro structure in a region from ⅛t (t: sheet thickness) to ⅜t (t: sheet thickness) from a surface of the steel sheet, the micro structure comprising: by volume %, 80% or more of a lath structure including one or more of martensite, tempered martensite, bainite, and bainitic ferrite and having at least $1.0\times10^{10}$ pieces per $m^2$ of carbides each having an equivalent circle diameter of 0.3 μm or more.

$$[Si]+0.35[Mn]+0.15[Al]+2.80[Cr]+0.84[Mo]+0.50[Nb]+0.30[Ti]\geq1.00 \quad (1)$$

[element]: mass % of each element

A high-strength steel sheet according to an exemplary embodiment of the invention (hereinafter, occasionally referred to as "the present steel sheet A") excellent in formability and impact resistance has a chemical composition including: by mass %, C in a range from 0.080 to 0.500%; Si of 2.50% or less; Mn in a range from 0.50 to 5.00; P of 0.100% or less; S of 0.010% or less; Al in a range from 0.010 to 2.000%; N of 0.0015% or less; O of 0.0050% or less; and the balance consisting of Fe and inevitable impurities, and in a steel sheet satisfying a formula (1), the high-strength steel sheet comprising a micro structure in a region from ⅛t (t: sheet thickness) to ⅜t (t: sheet thickness) from a surface of the steel sheet, the micro structure including: by volume %, acicular ferrite of 20% or more;

20% or more of an island-shaped hard structure including one or more of martensite, tempered martensite, and residual austenite, 2% to 25% of the residual austenite;

aggregated ferrite of 20% or less;

in the island-shaped hard structure, an average aspect ratio of a hard region having an equivalent circle diameter of 1.5 μm or more is 2.0 or more, and an average aspect ratio of a hard region having an equivalent circle diameter of less than 1.5 μm is less than 2.0, and an average of a number density per unit area of the hard region having the equivalent circle diameter of less than 1.5 μm is equal to or more than $1.0\times10^{10}$ pieces·$m^{-2}$, and when the number density of the island-shaped hard structure in an area of at least $5.0\times10^{10}\cdot m^2$ in each of three view fields is obtained, a ratio between a maximum number density and a minimum number density thereof is 2.5 or less.

$$[Si]+0.35[Mn]+0.15[Al]+2.80[Cr]+0.84[Mo]+0.50[Nb]+0.30[Ti]1.00 \quad (1)$$

[element]: mass % of each element

A high-strength steel sheet excellent in formability and impact resistance of the invention (hereinafter, occasionally referred to as "the present steel sheet A1") includes a galvanized layer or a zinc alloy plated layer on one surface or both surfaces of the present steel sheet A.

In a high-strength steel sheet excellent in formability, toughness, and weldability of the invention (hereinafter, occasionally referred to as "the present steel sheet A2"), the galvanized layer or the zinc alloy plated layer on one surface or both surfaces of the present steel sheet A1 is an alloyed plated layer.

A manufacturing method of the above-described steel sheet for heat treatment (hereinafter, occasionally referred to as a "manufacturing method a") is a manufacturing method of a steel sheet a.

The method includes: a hot rolling process of heating cast slab having the components of the steel sheet a to a temperature in a range from 1080 degrees C. to 1300 degrees C., and subsequently subjecting the cast slab to hot rolling, where hot rolling conditions in a temperature region from a maximum heating temperature to 1000 degrees C. satisfy the formula (A) and a hot rolling completion temperature falls in a range from 975 degrees C. to 850 degrees C.;

a cooling process in which cooling conditions applied from the completion of the hot rolling to 600 degrees C. satisfy a formula (2) that represents a sum of transformation progress degrees in 15 temperature regions obtained by equally dividing a temperature region ranging from the hot rolling completion temperature to 600 degrees C., and a temperature history that is measured by every 20 degrees C.

from a time when 600 degrees C. is reached to a time when an intermediate heat treatment below is started satisfies a formula (3);

a cold rolling process of cold rolling at a rolling reduction of 80% or less; and an intermediate heat treatment process comprising: heating the cold-rolled cast slab to a temperature in a range from (Ac3−30) degrees C. to (Ac3+100) degrees C. at an average heating rate of at least 30 degrees C. per second in a temperature region ranging from 650 degrees C. to (Ac3−40) degrees C.; limiting a dwell time in a temperature region ranging from the heating temperature to (maximum heating temperature−10) degrees C. to 100 seconds or less; and subsequently cooling the cast slab from the heating temperature at an average cooling rate of at least 30 degrees C. per second in a temperature region ranging from 750 degrees C. to 450 degrees C.

A manufacturing method of the high-strength steel sheet excellent in formability and impact resistance (hereinafter, occasionally referred to as "the present manufacturing method A") is a manufacturing method of a steel sheet a includes: heating the steel sheet a to a temperature in a range from (Ac1+25) degrees C. to an Ac3 point so that a temperature history from 450 degrees C. to 650 degrees C. satisfies a formula (B) below and subsequently a temperature history from 650 degrees C. to 750 degrees C. satisfies a formula (C) below;

retaining the steel sheet for heat treatment for 150 seconds or less at the heating temperature;

cooling the steel sheet a from the heating retention temperature to a temperature region ranging from 550 degrees C. to 300 degrees C. at an average cooling rate of at least 10 degrees C. per second in a temperature region from 700 degrees C. to 550 degrees C.;

setting a dwell time in the temperature region from 550 degrees C. to 300 degrees C. to 1000 seconds or less; and setting dwell conditions in the temperature region from 550 degrees C. to 300 degrees C. to satisfy a formula (4) below.

A method of manufacturing the high-strength steel sheet (hereinafter, occasionally referred to as "the present manufacturing method A1a") excellent in formability and impact resistance is a method of manufacturing the present steel sheet A1.

The present manufacturing method A1a includes: immersing the high-strength steel sheet excellent in formability and impact resistance in the present manufacturing method A in a plating bath including zinc as a main component to form the galvanized layer or the zinc alloy plated layer on one surface or both surfaces of the high-strength steel sheet.

A method of manufacturing the high-strength steel sheet (hereinafter, occasionally referred to as "the present manufacturing method A1b") excellent in formability and impact resistance is a method of manufacturing the present steel sheet A1.

The present manufacturing method A1b includes: immersing the steel sheet manufactured in the present manufacturing method A in a plating bath including zinc as a main component during dwelling in a range from 550 degrees C. to 300 degrees C. to form the galvanized layer or the zinc alloy plated layer on one surface or both surfaces of the steel sheet.

A method of manufacturing the high-strength steel sheet (hereinafter, occasionally referred to as "the present manufacturing method A1c") excellent in formability and impact resistance is a method of manufacturing the present steel sheet A1.

The present manufacturing method A1c includes: forming a galvanized layer or a zinc alloy plated layer by electroplating on one surface or both surfaces of the the high-strength steel sheet excellent in formability and impact resistance in the present manufacturing method A.

A method of manufacturing the high-strength steel sheet (hereinafter, occasionally referred to as "the present manufacturing method A2") excellent in formability and impact resistance is a method of manufacturing the present steel sheet A2.

The present manufacturing method A2 includes: heating the galvanized layer or the zinc alloy plated layer of the present steel sheet A1 to a temperature in a range from 400 degrees C. to 600 degrees C. to apply an alloying treatment to the galvanized layer or the zinc alloy plated layer.

The steel sheet a and a manufacturing method thereof (manufacturing method a), and the steel sheets A, A1 and A2 according to the exemplary embodiments of the invention (hereinafter also referred to as the present steel sheets A, A1 and A2) and manufacturing methods thereof (hereinafter also referred to as the present manufacturing methods A, A1a, A1b, A1c and A2) will be descried sequentially.

Firstly, reasons for limiting a chemical composition of the steel sheet a and the present steel sheets A, A1, and A2 (hereinafter, occasionally collectively referred to as "the present steel sheet") will be described. % depicted with the chemical composition means mass %.

Chemical Composition

C is in a range from 0.080 to 0.500%

C is an element contributing to improving strength and impact resistance. Since an effect obtainable by adding C is not sufficient at less than 0.080% of C, C is defined to be 0.080% or more, preferably 0.100% or more, more preferably 0.140% or more.

On the other hand, since a foundry slab becomes embrittled to be susceptible to cracking and productivity is significantly lowered at more than 0.500% of C, C is defined to be 0.500% or less.

Further, since a large amount of C deteriorates weldability, in order to secure a favorable spot weldability, C is preferably 0.350% or less, more preferably 0.250% or less.

Si is 2.50% or less.

Si is an element contributing to improving strength and formability by making iron carbides finer, however, also embrittling steel. Since a foundry slab becomes embrittled to be susceptible to cracking and productivity is significantly lowered at more than 2.50% of Si, Si is defined to be 2.50% or less. Further, since Si is an element embrittling Fe crystal, in order to secure impact resistance, Si is preferably 2.20% or less, more preferably 2.00% or less.

When Si is decreased to less than 0.010%, inclusive of the lower limit of 0%, coarse iron carbides are formed during transformation of bainite, thereby lowering strength and formability. Accordingly, Si is preferably 0.005% or more, more preferably 0.010% or more.

Mn in a range from 0.50 to 5.00%

Mn is an element contributing to improving strength by increasing hardenability. When Mn is less than 0.50%, a soft structure is formed during a cooling step of annealing, which makes it difficult to secure a required strength. Accordingly, Mn is defined to be 0.50% or more, preferably 0.80% or more, more preferably 1.00% or more.

On the other hand, when Mn exceeds 5.00%, Mn concentrates on a central part of a foundry slab, so that the foundry slab becomes embrittled to be susceptible to cracking and productivity is significantly lowered. Accordingly, Mn is defined to be 5.00% or less. Further, since a large amount of Mn deteriorates weldability, in order to secure a favorable spot weldability, Mn is preferably 3.50% or less, more preferably 3.00% or less.

P is 0.100% or less.

P is an element embrittling steel or embrittling a melted portion generated by spot melting. Since the foundry slab becomes embrittled to be susceptible to cracking at more than 0.100% of P, P is defined to be 0.100% or less. In order to secure a strength of the spot melted portion, P is preferably 0.040% or less, more preferably 0.020% or less.

When P is decreased to less than 0.0001%, inclusive of the lower limit of 0%, a production cost is significantly increased. Accordingly, 0.0001% is a substantive lower limit for a practical steel sheet.

S is 0.0100% or less.

S forms MnS and is an element inhibiting formability such as ductility, hole expandability, elongation flangeability, and bendability and inhibiting weldability. Since formability and productivity are significantly lowered at more than 0.0100% of S, S is defined to be 0.0100% or less. In order to secure a favorable weldability, S is preferably 0.0070% or less, more preferably 0.0050% or less.

When S is decreased to less than 0.0001%, inclusive of the lower limit of 0%, a production cost is significantly increased. Accordingly, 0.0001% is a substantive lower limit for a practical steel sheet.

Al is in a range from 0.001 to 2.000%;

Al functions as a deoxidizing element, however, is also an element embrittling steel and inhibiting weldability. Since deoxidation effect is not sufficiently obtained at less than 0.001% of Al, Al is defined to be 0.001% or more, preferably 0.010% or more, more preferably 0.020% o more.

However, when Al exceeds 2.000%, coarse oxides are formed, so that the foundry slab becomes susceptible to cracking. Accordingly, Al is defined to be 2.000% or less. In order to secure a favorable weldability, an amount of Al is preferably 1.500% or less, further preferably 1.100% or less.

N is 0.0150% or less.

N forms nitrides and is an element inhibiting formability such as ductility, hole expandability, elongation flangeability, and bendability. N is also an element causing generation of blowholes to inhibit weldability during a welding process. Since formability and weldability are lowered at more than 0.0150% of N, N is defined to be 0.0150% or less, preferably 0.0100% or less, more preferably 0.0060% or less.

When N is decreased to less than 0.0001%, inclusive of the lower limit of 0%, a production cost is significantly increased. Accordingly, 0.0001% is a substantive lower limit for the steel sheet in practical use.

O is 0.0050% or less.

O forms oxides and is an element inhibiting formability such as ductility, hole expandability, elongation flangeability, and bendability. Since formability is significantly lowered at more than 0.0050% of O, O is defined to be 0.0050% or less, preferably 0.0030% or less, more preferably 0.0020% or less.

When O is decreased to less than 0.0001%, inclusive of the lower limit of 0%, a production cost is significantly increased. Accordingly, 0.0001% is a substantive lower limit for the steel sheet in practical use.

$$[Si]+0.35[Mn]+0.15[Al]+2.80[Cr]+0.84[Mo]+0.50[Nb]+0.30[Ti]1.00 \quad (1)$$

In the later-described manufacture of the steel sheet for heat treatment, fine carbides of a predetermined amount or more need to be obtained by suitably dissolving carbides during the intermediate heat treatment. In case of excessively soluble carbides, since all the carbides disappear during the intermediate heat treatment, a predetermined steel sheet for heat treatment cannot be obtained. Accordingly, it is necessary to satisfy the formula (1) consisting of additive amounts of elemental species that slow down a dissolution rate of the carbides.

$$[Si]+0.35[Mn]+0.15[Al]+2.80[Cr]+0.84[Mo]+0.50[Nb]+0.30[Ti]: 1.00 \text{ or more} \quad \text{Left side of formula (1):}$$

[element] represents mass % of the element in the left side of the formula (1). In the manufacturing process of the present steel sheet a, Si inhibits dissolution of the carbides. Provided that a contribution degree showing Si contribution to improvement in balance of strength, formability, and impact resistance of a steel sheet after the main heat treatment of a final product is 1, a coefficient of each element is a ratio obtained when the contribution degree 1 of Si is compared with a contribution degree of each element.

When a value of the left side of the formula (1) in the chemical composition of the steel sheet is less than 1.00, carbides are not sufficiently formed in the steel sheet for heat treatment, resulting in deterioration in properties of the steel sheet after the main heat treatment. In order to sufficiently leave carbides present in the steel sheet for heat treatment to improve the properties, the value of the left side of the formula (1) needs to be defined as 1.00 or more, preferably 1.25 or more, more preferably 1.50 or more.

The upper limit value of the left side of the formula (1) does not need to be limited since being determinable depending on the upper limit value of each element. However, when the value of the left side of the formula (1) is excessively high, carbides in the steel sheet for heat treatment becomes excessively coarse in size and the coarse carbides may remain also in the subsequent heat treatment process to adversely lower properties of the steel sheet. Accordingly, the value of the left side of the formula (1) is preferably 4.00 or less, more preferably 3.60 or less.

The chemical composition of each of the steel sheet for heat treatment of the invention and the high-strength steel sheet of the invention includes the above components and the balance consisting of Fe and inevitable impurities. In order to improve the properties, in addition to the above elements, the chemical composition may include the following elements in place of a part of Fe.

Ti is 0.300% or less.

Ti is an element contributing to improving the steel sheet strength by strengthening by precipitates, strengthening by fine grains by inhibiting growth of ferrite crystal grains, and strengthening by dislocation by inhibiting recrystallization. Since a great amount of carbonitrides are precipitated to deteriorate formability at more than 0.300% of Ti, Ti is preferably 0.300% or less, more preferably 0.150% or less.

In order to obtain a sufficient strength-improving effect by Ti, although the lower limit is 0%, Ti is preferably 0.001% or more, more preferably 0.010% or more.

Nb is 0.100% or less.

Nb is an element contributing to improving the steel sheet strength by strengthening by precipitates, strengthening by fine grains by inhibiting growth of ferrite crystal grains, and strengthening by dislocation by inhibiting recrystallization. Since a great amount of carbonitrides are precipitated to deteriorate formability at more than 0.100% of Nb, Nb is preferably 0.100% or less, more preferably 0.060% or less.

In order to obtain a sufficient strength-improving effect by Nb, Nb is preferably 0.001% or more, more preferably 0.005% or more, although the lower limit is 0%.

V is 1.00% or less.

V is an element contributing to improving the steel sheet strength by strengthening by precipitates, strengthening by fine grains by inhibiting growth of ferrite crystal grains, and strengthening by dislocation by inhibiting recrystallization. Since a great amount of carbonitrides are precipitated to deteriorate formability at more than 1.00% of V, V is preferably 1.00% or less, more preferably 0.50% or less.

In order to obtain a sufficient strength-improving effect by V, V is preferably 0.001% or more, more preferably 0.010% or more, although the lower limit is 0%.

Cr is 2.00% or less, Cr is an element contributing to improving the steel sheet strength by improving hardenability, and the element capable of partially substituting C and/or Mn. Since hot workability is deteriorated to lower productivity at more than 2.00% of Cr, Cr is preferably 2.00% or less, more preferably 1.20% or less.

In order to obtain a sufficient strength-improving effect by Cr, Cr is preferably 0.01% or more, more preferably 0.10% or more, although the lower limit is 0%.

Ni is 2.00%.

Ni is an element contributing to improving the steel sheet strength by inhibiting phase transformation at a high temperature, and the element capable of partially substituting C and/or Mn. Since weldability is lowered at more than 2.00% of Ni, Ni is preferably 2.00% or less, more preferably 1.20% or less.

In order to obtain a sufficient strength-improving effect by Ni, Ni is preferably 0.01% or more, more preferably 0.10% or more, although the lower limit is 0%.

Cu is 2.00% or less.

Cu is an element contributing to improving the steel sheet strength by being present as fine grains in steel, and the element capable of partially substituting C and/or Mn. Since weldability is lowered at more than 2.00% of Cu, Cu is preferably 2.00% or less, more preferably 1.20% or less.

In order to obtain a sufficient strength-improving effect by Cu, Cu is preferably 0.01% or more, more preferably 0.10% or more, although the lower limit is 0%.

Mo is 1.00% or less.

Mo is an element contributing to improving the steel sheet strength by inhibiting phase transformation at a high temperature, and the element capable of partially substituting C and/or Mn. Since hot workability is deteriorated to lower productivity at more than 1.00% of Mo, Mo is preferably 1.00% or less, more preferably 0.50% or less.

In order to obtain a sufficient strength-improving effect by Mo, Mo is preferably 0.01% or more, more preferably 0.05% or more, although the lower limit is 0%.

W is 1.00% or less.

W is an element contributing to improving the steel sheet strength by inhibiting phase transformation at a high temperature, and the element capable of partially substituting C and/or Mn. Since hot workability is deteriorated to lower productivity at more than 1.00% of W, W is preferably 1.00% or less, more preferably 0.70% or less.

In order to obtain a sufficient strength-improving effect by W, W is preferably 0.01% or more, more preferably 0.10% or more, although the lower limit is 0%.

B is 0.0100% or less.

B is an element contributing to improving the steel sheet strength by inhibiting phase transformation at a high temperature, and the element capable of partially substituting C and/or Mn. Since hot workability is deteriorated to lower productivity at more than 0.0100% of B, B is preferably 0.0100% or less, more preferably 0.0050% or less.

In order to obtain a sufficient strength-improving effect by B, B is preferably 0.0001% or more, more preferably 0.0005% or more, although the lower limit is 0%.

Sn is 1.00% or less.

Sn is an element contributing to improving the steel sheet strength by inhibiting formation of coarse crystal grains. Since the steel sheet sometimes becomes embrittled to be cracked during a rolling process at Sn exceeding 1.00%, Sn is preferably 1.00% or less, more preferably 0.50% or less.

In order to obtain a sufficient effect by adding Sn, Sn is preferably 0.001% or more, more preferably 0.010% or more, although the lower limit is 0%.

Sb is 0.200% or less.

Sb is an element contributing to improving the steel sheet strength by inhibiting formation coarse crystal grains. Since the steel sheet sometimes becomes embrittled to be cracked during a rolling process at Sb exceeding 0.200%, Sb is preferably 0.200% or less, more preferably 0.100% or less.

In order to obtain a sufficient effect by adding Sb, Sb is preferably 0.001% or more, more preferably 0.005% or more, although the lower limit is 0%.

The chemical composition of the present steel sheet may contain one or more of Ca, Ce, Mg, Zr, La, Hf, and REM as needed.

One or more of Ca, Ce, Mg, Zr, La, Hf, and REM are 0.0100% or less in total.

Ca, Ce, Mg, Zr, La, Hf, and REM are elements contributing to improving formability. Since ductility may be deteriorated when one or more of Ca, Ce, Mg, Zr, La, Hf, and REM exceed 0.0100% in total, one or more of Ca, Ce, Mg, Zr, La, Hf, and REM in total are preferably 0.0100% or less, more preferably 0.0070% or less.

Although the lower limit of the total of one or more of Ca, Ce, Mg, Zr, La, Hf, and REM is 0%, the total is preferably 0.0001% or more, more preferably 0.0010% or more in order to obtain a sufficient effect of improving formability.

It should be noted that REM (Rare Earth Metal) means elements belonging to lanthanoid. Although REM and Ce are often added in a form of misch metal, lanthanoid elements may be inevitably contained other than La and Ce.

In the chemical composition of the present steel sheet, the balance except for the above elements is Fe and inevitable impurities. The inevitable impurities are elements inevitably mixed from a raw material for steel and/or during a steel production process. As the impurities, H, Na, Cl, Sc, Co, Zn, Ga, Ge, As, Se, Y, Zr, Tc, Ru, Rh, Pd, Ag, Cd, In, Sn, Sb, Te, Cs, Ta, Re, Os, Ir, Pt, Au, and Pb may be contained at 0.010% or less in total.

Next, the microstructure of each of the present steel sheet will be described.

Region for defining microstructure: from ⅛t to ⅜*t* (t: sheet thickness) from steel sheet surface Typically, a microstructure in a region from ⅛t (t: sheet thickness) to ⅜*t* (t: sheet thickness) from the steel sheet surface, the region centering on ¼*t* (t: sheet thickness) from the steel sheet surface, exhibits mechanical characteristics (e.g., formability, strength, ductility, toughness, and hole expandability). Accordingly, in the present steel sheets A, A1, and A2 (hereinafter, collectively referred to as "the present steel sheet A"), the microstructure in the region from ⅛t (t: sheet thickness) to ⅜*t* (t: sheet thickness) from the steel sheet surface is defined.

In order that the microstructure in the region from ⅛t (t: sheet thickness) to ⅜*t* (t: sheet thickness) from the steel sheet surface in the present steel sheet A is made into a desired microstructure by heat treatment, a microstructure in a region from ⅛t (t: sheet thickness) to ⅜t (t: sheet thickness) from the steel sheet surface is defined same as above in the steel sheet a.

Firstly, the microstructure in the region from ⅛t (t: sheet thickness) to ⅜t (t: sheet thickness) from the steel sheet surface (hereinafter, also referred to as "the microstructure a") is described. Hereinafter, % depicted with the microstructure means volume %.

Microstructure a

80% or more of a lath structure including one or more of martensite, tempered martensite, bainite, and bainitic ferrite and having at least $1.0\times10^{10}$ pieces per $m^2$ of carbides each having an equivalent circle diameter of 0.1 μm or more.

The microstructure a includes 80% or more of a lath structure including one or more of martensite, tempered martensite, bainite, and bainitic ferrite and having at least $1.0\times10^{10}$ pieces per $m^2$ of carbides each having an equivalent circle diameter of 0.1 μm or more. When the steel sheet a having the lath structure of less than 80% is subjected to heat treatment, a required microstructure cannot be obtained and an excellent formability cannot be secured in the present steel sheet A. Accordingly, the lath structure is defined to account for 80% or more, preferably 90% or more.

If the microstructure a is a lath structure, the heat treatment (annealing) generates fine austenite surrounded by ferrite having the same crystal orientation at a lath boundary and the austenite grows along the lath boundary. The austenite grown along the lath boundary, that is, unidirectionally elongated austenite forms an island-shaped hard structure by the cooling treatment, thereby greatly contributing to strength and formability.

The lath structure of the steel sheet a can be formed by subjecting a steel sheet manufactured under predetermined hot rolling and cold rolling conditions to a required intermediate heat treatment. Formation of the lath structure is described later.

An individual volume % of tempered martensite, bainite, and bainitic ferrite varies depending on the chemical composition, hot rolling conditions, and cooling conditions of the steel sheet. Although volume % is not particularly limited, but a preferable volume % is described.

Martensite becomes tempered martensite by the main heat treatment, and in combination with the existing tempered martensite, contributes to the improvement of the formability-strength balance of the present steel sheet A. On the other hand, when the steel sheet a for heat treatment includes a large amount of martensite, strength is improved and bendability is deteriorated, which hinders productivity in processes such as cutting and shape correction. From this viewpoint, volume % of martensite in the lath structure is preferably 30% or less, more preferably 15% or less.

Tempered martensite is a structure significantly contributing to improvement in formability-strength balance of the present steel sheet A. Moreover, since tempered martensite does not excessively increase strength of the steel sheet for heat treatment and provides an excellent bendability thereto, tempered martensite is a structure positively usable for the purpose of improving productivity. A volume fraction of tempered martensite in the steel sheet a for heat treatment is preferably 30% or more, more preferably 50% or more, and may be 100%.

Bainite and bainitic ferrite have lower strength than martensite and tempered martensite, and may be positively utilized for the purpose of improving productivity.

On the other hand, since carbides are formed in bainite and C is consumed, the volume fraction of the steel sheet a for heat treatment is preferably 50% or less.

In the microstructure a, other structures (e.g., pearlite, cementite, aggregated ferrite, and residual austenite) are set at less than 20%.

Since aggregated ferrite does not have austenite nucleation sites in crystal grains, the aggregated ferrite becomes ferrite including no austenite in the microstructure after annealing (later-described main heat treatment) and does not contribute to improving the strength.

Moreover, aggregated ferrite sometimes does not have a specific crystal orientation relationship with mother phase austenite. When the aggregated ferrite increases, austenite having a crystal orientation significantly different from that of the mother phase austenite is sometimes formed at a boundary between the aggregated ferrite and the mother phase austenite during annealing. Newly formed austenites with different crystal orientations around the ferrite grow coarsely and isotropically, which does not contribute to improving mechanical characteristics.

The residual austenite does not contribute to improving mechanical characteristics since a part of the residual austenite becomes coarse and isotropic during annealing. In particular, in order to ensure bendability required for correcting a shape of the steel sheet for heat treatment, residual austenite likely to serve as a start point of cracking in a bending process is preferably limited to 10% or less, more preferably 5% or less.

Pearlite and cementite are transformed into austenite during annealing and grow coarse isotropically, which does not contribute to improving mechanical characteristics. Therefore, other structures (e.g., pearlite, cementite, aggregated ferrite, and residual austenite) is set at less than 20%, preferably less than 10%.

At Least $1.0\times10^{10}$ Pieces per $m^2$ Of Carbides Each Having Equivalent Circle Diameter of 0.1 mm or More When carbides are present in the lath structure, the amount of solid solution carbon in the microstructure is small, the transformation temperature of the microstructure is high, and the shape and dimensions of the steel sheet are maintained favorably even when rapidly cooled. Moreover, the strength of the steel sheet is reduced, which facilitates cutting the steel sheet and correcting the shape thereof, so that a second heat treatment is easily performed. Carbides are dissolved in the macrostructure in the second heat treatment to form a hard structure formation site.

Since this site is present in the lath structure unlike the above-described site along the lath boundary, the formed austenite grows isotropically inside acicular ferrite and, through the cooling treatment, forms a fine and isotropic island-shaped hard structure not having grown large in a particular direction, so that impact resistance of the steel sheet can be improved.

Since carbides each having the equivalent circle diameter of less than 0.1 μm do not serve as the hard structure formation site, carbides each having the equivalent circle diameter of 0.1 μm or more are defined as a target for measuring the number of carbides. When a number density of carbides each having the equivalent circle diameter of 0.1 μm or more per unit area (hereinafter also simply referred to as the "number density") is less than $1.0\times10^{10}$ pieces per $m^2$, the number of nucleation sites becomes insufficient and the amount of solid solution carbon in the microstructure is not sufficiently reduced. Accordingly, the number density of carbide is defined as at least $1.0\times10^{10}$ pieces per $m^2$, preferably at least $1.5\times10^{10}$ pieces per $m^2$, more preferably at least $2.0\times10^{10}$ pieces per $m^2$.

The upper limit in size of the above carbides is not particularly determined. However, excessively coarse carbides are not preferable since excessively coarse carbides may remain without being completely melted even when the steel sheet for heat treatment is heat-treated and may deteriorate strength, formability, and impact resistance. Moreover, excessively coarse carbides are likely to be a start point of cracking in the shape correction of the steel sheet. From the above two viewpoints, the average equivalent circle diameter of carbides each having the equivalent circle diameter of 0.1 μm or more is preferably 1.2 μm or less, more preferably 0.8 μm or less.

Since the number density of carbides depends on the C amount and the heat treatment conditions (described later) of the steel sheet, the upper limit of the number density is not determined. However, since all the carbides may not be melted in the second heat treatment, approximately $5.0\times10^{12}$ pieces per $m^2$ is a substantial upper limit.

Next, a microstructure in the region from ⅛t (t: sheet thickness) to ⅜*t* (t: sheet thickness) from a steel sheet surface of the present steel sheet A (hereinafter, also referred to as "the microstructure A") is described. % depicted with the microstructure means volume %.

Microstructure a

The microstructure A is formed by subjecting the microstructure a of the steel sheet a to a required heat treatment (later-described main heat treatment). The microstructure A is a structure including an island-shaped hard structure unidirectionally extending acicular ferrite formed by inheriting the structure of the microstructure a, and an equiaxed island-shaped hard structure formed by a required heat treatment. This is the characteristic of the present steel sheet A.

20% or More of Acicular Ferrite

When the microstructure a (the lath structure including one or more of tempered martensite, bainite, and bainitic ferrite and at least $1.0\times10^{10}$ pieces per $m^2$ of carbides each having the equivalent circle diameter of 0.1 μm or more: 80% or more) is subjected to the required heat treatment, the lath-shaped ferrite is united into acicular ferrite, and austenite grains unidirectionally elongated are formed at the crystal grain boundary.

Further, when the cooling treatment is performed under predetermined conditions after the heat treatment, the austenite unidirectionally elongated becomes an island-shaped hard structure unidirectionally elongated, and thereby improving the formability-strength balance of the microstructure A.

When the acicular ferrite is less than 20%, the volume % of the coarse and isotropic island-shaped hard structure is significantly increased, and the formability-strength balance of the microstructure A is deteriorated. Accordingly, the acicular ferrite is defined as 20% or more. The acicular ferrite is preferably 30% or more in order to further improve the formability-strength balance.

On the other hand, when the acicular ferrite exceeds 80%, the volume % of the island-shaped hard structure is decreased to significantly lower the strength. Accordingly, the acicular ferrite is preferably 80% or less. In order to increase the strength, it is preferable to decrease the volume % of the acicular ferrite while increasing the volume % of the island-shaped hard structure. From this viewpoint, the volume % of the acicular ferrite is more preferably 65% or less.

20% or more of an island-shaped hard structure including one or more of martensite, tempered martensite, and residual austenite, The volume % of each structure forming the island-shaped hard structure is not specified because the volume % thereof depends on the chemical composition of the steel sheet and the heat treatment conditions, but the preferable volume % is as follows.

Martensite of 30% or Less

Martensite is a structure responsible for the steel sheet strength. Since impact resistance of the steel sheet is lowered when martensite exceeds 30%, martensite is preferably 30% or less, more preferably 15% or less, inclusive of the lower limit of 0%.

Tempered Martensite of 80% or Less

Tempered martensite is a structure for improving the steel sheet strength without impairing formability and impact resistance of the steel sheet. In order to sufficiently improve strength, formability and impact resistance of the steel sheet, tempered martensite is preferably 10% or more, more preferably 15% or more.

On the other hand, when tempered martensite exceeds 80%, the steel sheet strength is excessively increased to lower formability. Accordingly, tempered martensite is preferably 80% or less, more preferably 60% or less.

Residual Austenite in a Range from 2% to 25%

Residual austenite is a structure that significantly improves formability, especially, ductility of the steel sheet. In order to sufficiently obtain this effect, residual austenite is preferably 2% or more, more preferably 5% or more.

On the other hand, residual austenite is a structure that inhibits impact resistance. Since an excellent impact resistance cannot be ensured when residual austenite exceeds 25%, residual austenite is preferably 25% or less, more preferably 20% or less.

Aspect Ratio of Hard Region in Island-Shaped Hard Structure

Average aspect ratio in hard region having equivalent circle diameter of 1.5 μm or more: 2.0 or more Average aspect ratio in hard region having equivalent circle diameter of less than 1.5 μm or more: less than 2.0

The coarse island-shaped hard structure extended unidirectionally is a structure that significantly improves work-hardenability of the steel sheet and increases strength and formability thereof. On the other hand, aggregated and coarse island-shaped hard structure is liable to be internally fractured due to deformation, resulting in deterioration in formability. From the above viewpoint, in order to sufficiently improve the strength-formability balance of the steel sheet, it is necessary to set the average aspect ratio of the coarse island-shaped hard structure having 1.5 μm or more of the equivalent circle diameter to 2.0 or more. In order to improve strength-formability balance, the average aspect ratio is preferably 2.5 or more, more preferably 3.0 or more.

Mainly, the fine island-shaped hard structure generated in ferrite grains is a structure that contributes to improving strength-formability because of being difficult to peel off at the interface with the surrounding ferrite and being difficult to fracture even if receiving strain. Especially, the fine island-shaped hard structure grown isotropically, which is difficult to serve as a fracture propagation site, is a structure that improves strength-formability balance without impairing impact resistance of the steel sheet.

On the other hand, the fine island-shaped hard structure extending unidirectionally is a structure that impairs impact resistance because of being inside ferrite grains and acting strongly as a fracture propagation site. Therefore, in order to sufficiently secure the impact resistance of the steel sheet, it is necessary to set the average aspect ratio of the fine island-shaped hard structure having the equivalent circle diameter of less than 1.5 μm (preferably 1.44 μm or less) to be less than 2.0. In order to further improve the impact resistance, the average aspect ratio is preferably 1.7 or less, more preferably 1.5 or less.

When a number density per unit area of the fine island-shaped hard structure (hereinafter also simply referred to as the "number density") is low, stress and/or strain is concentrated in and/or around a part of the island-shaped hard structure and acts as a starting point of fracture and propagation path thereof. Accordingly, the average of the number density of the fine island-shaped hard structure having the equivalent circle diameter of less than 1.5 μm is defined as at least $1.0\times10^{10}$ pieces per $m^2$. In order to make it difficult that the fine island-shaped hard structure serves as the fracture propagation path, the average of the number density is preferably at least $2.5\times10^{10}$ pieces per $m^2$, more preferably at least $4.0\times10^{10}$ pieces per $m^2$.

When the fine island-shaped hard structure is unevenly distributed in a part, stress and/or strain is concentrated in and/or around a part of the island-shaped hard structure in a region where the island-shaped hard structure is sparse during propagation of fracture, so that fracture easily propagates. In order to avoid this phenomenon, the number density of the fine island-shaped hard structure is preferably substantially constant. Specifically, in each of three or more fields of view, the number density of the island-shaped hard structure having the equivalent circle diameter of less than 1.5 μm in an area of at least $5.0\times10^{-10}$ $m^2$ is obtained, and a value obtained by dividing the maximum value by the minimum value among the number densities of the island-shaped hard structure is limited to 2.5 or less. This value is preferably 2.0 or less, more preferably closer to 1.0.

Aggregated ferrite is 20% or less.

Aggregated ferrite is a structure that competes with acicular ferrite. As the volume % of aggregated ferrite is increased, the volume % of acicular ferriteis decreased. Accordingly, aggregated ferrite is limited to 20% or less. The smaller volume % of aggregated ferrite is preferable. The volume % thereof may be 0%.

Balance: bainite+bainitic ferrite+inevitable generation phase.

The balance of the microstructure A is bainite, bainitic ferrite and/or an inevitable generation phase.

Bainite and bainitic ferrite are structures having an excellent balance between strength and formability, and may be contained in the microstructure as long as a sufficient volume % of acicular ferrite and martensite are secured. If a total of the volume % of bainite and bainitic ferrite exceeds 40%, the volume % of acicular ferrite and/or martensite may not be sufficiently obtained. Therefore, the total of the volume % of bainite and bainite is preferably 40% or less.

The inevitable generation phase in the balance structure of the microstructure A is pearlite, cementite and the like. As the volume % of pearlite and/or cementite increases, ductility decreases and the formability-strength balance decreases. Therefore, the total of the volume % of pearlite and/or cementite is preferably 5% or less.

An excellent formability-strength balance can be ensured by forming the microstructure A, so that the present steel sheet A excellent in formability and impact resistance can be obtained.

Figure 2A:
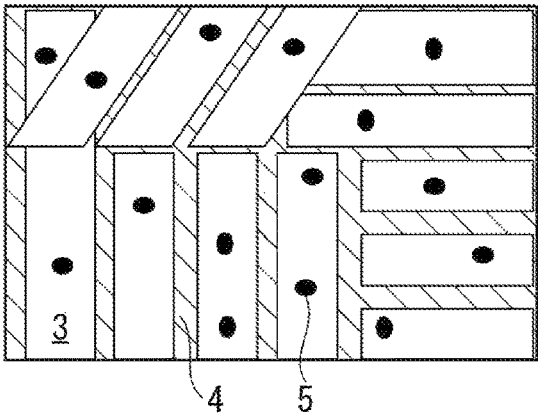
FIG. 2A is an image illustration of a structure of a steel of the invention.
Figure 2B:
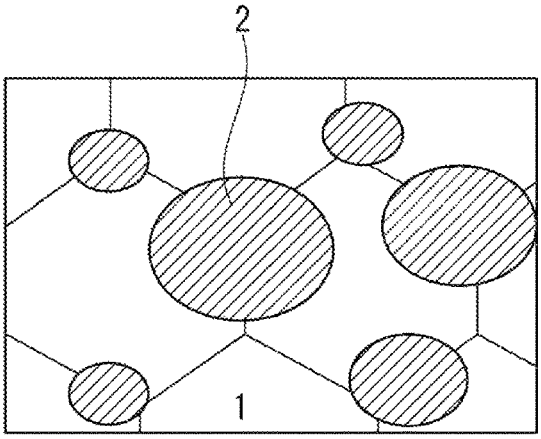
FIG. 2B is an image illustration of a structure of a general high-strength composite structure steel as a comparative steel.
Figure 2C:
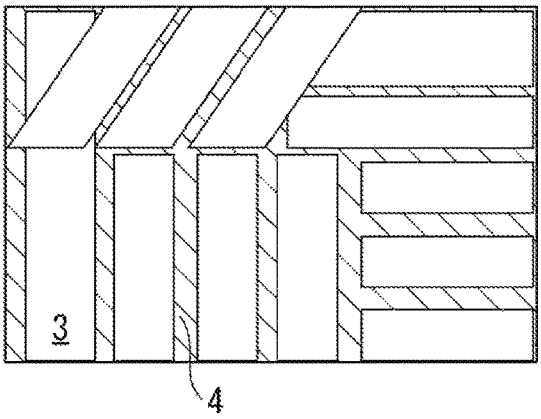
FIG. 2C is an image illustration of a structure of a comparative steel (e.g., Patent Literature 1) relating to a high-strength composite structure steel having improved properties.

FIG. 2 schematically shows an image of the microstructure of the steel sheet. This figure is merely an illustration schematically shown for explanation. The microstructure of the invention is not defined by this figure. FIG. 2A shows an image of the microstructure A of the invention, expressing acicular ferrite 3, a hard region (coarse island-shaped hard structure (a large aspect ratio) 4) having the equivalent circle diameter of 1.5 μm or more, and a hard region (fine island-shaped hard structure (a small aspect ratio) 5) having the equivalent circle diameter of less than 1.5 μm. FIG. 2B shows a high-strength composite structure steel as a comparative steel, expressing aggregated ferrite 1 and a corase island-shaped hard structure (a small aspect ratio) 2. FIG. 2C relates to a high-strength composite structure steel (e.g., Patent Literature 1) having improved properties as a comparative steel, expressing the acicular ferrite 3 and the island-shaped hard structure (a large aspect ratio) 4.

Here, a method of determining the volume fraction (volume %) of the structure will be described.

A test piece having a sheet thickness cross section parallel to the rolling direction of the steel plate as the observation surface is collected from the steel sheet. A fraction of the lath structure is obtained by: polishing the observation surface of the test piece and subsequently applying Nital etching to the observation surface; observing an area of at least $2.0\times10^{-9}$ $m^2$ in total in at least one view field in the region from ⅛t (t: sheet thickness) to ⅜t (t: sheet thickness) from a surface in sheet thickness using Field Emission Scanning Electron Microscope (FE-SEM); and analyzing an area fraction (area %) of each structure (other than residual austenite).

Since it is empirically known that the area fraction (area %) volume fraction (volume %), the area fraction is used as the volume fraction (volume %).

The acicular ferrite in the microstructure A refers to ferrite having the aspect ratio of 3.0 or more, which is the ratio of the major axis to the minor axis of the crystal grains, in the structure observation by FE-SEM. Further, similarly, aggregated ferrite refers to ferrite having the aspect ratio of less than 3.0.

The volume fraction of residual austenite in the microstructure is analyzed by X-ray diffraction. In the region from ⅛t (t: sheet thickness) to ⅜*t* (t: sheet thickness) from the surface in the sheet thickness of the test piece, the surface parallel to the steel plate surface is finished to be a mirror surface, and the area fraction of FCC iron is analyzed by X-ray diffraction method. The area fraction is used as the volume fraction of the residual austenite.

In the microstructure (sheet thickness cross section parallel to the rolling direction of the steel sheet), a portion including one or more of martensite, tempered martensite, and residual austenite is referred to as an "island-shaped hard structure." Since these structures in three types are all hard, the structures are named "hard." In the microstructure A, regions each surrounded by soft ferrite and connected to each other in the observation structure are collectively regarded as an "island." With this definition, when the island-shaped hard structure is evaluated in terms of the aspect ratios for the island-shaped hard structure divided into the region having the equivalent circle diameter of 1.5 μm or more and the region having the equivalent circle diameter of less than 1.5 μm, one island can be treated as one grain.

The present steel sheet A may be a steel sheet having a galvanized layer or a zinc alloy plated layer on one or both surfaces of the steel sheet (the present steel sheet A1), or may be a steel plate having an alloyed plated layer obtained by alloying the galvanized layer or the zinc alloy plated layer (the present steel plate A2). Description will be made below.

Galvanized Layer and Zinc Alloy Plated Layer

The plated layer formed on one or both surfaces of the present steel sheet A is preferably a galvanized layer or a zinc alloy plated layer containing zinc as a main component. The zinc alloy plated layer preferably contains Ni as an alloy component.

The galvanized layer and the zinc alloy plated layer are formed by a hot-dip plating method or an electroplating method. When the Al amount of the galvanized layer increases, the adhesion between the steel sheet surface and the galvanized layer decreases. Therefore, the Al amount of the galvanized layer is preferably 0.5 mass % or less. When the galvanized layer is a hot-dip galvanized layer, an Fe amount of the hot-dip galvanized layer is preferably 3.0 mass % or less in order to improve the adhesion between the steel sheet surface and the galvanized layer.

When the galvanized layer is an electrogalvanized layer, an Fe amount of the electrogalvanized layer is preferably 5.0 mass % or less in order to improve corrosion resistance.

The galvanized layer and the zinc alloy plated layer may contain one or more of Ag, B, Be, Bi, Ca, Cd, Co, Cr, Cs, Cu, Ge, Hf, Zr, I, K, La, Li, Mg, Mn, Mo, Na, Nb, Ni, Pb, Rb, Sb, Si, Sn, Sr, Ta, Ti, V, W, Zr, and REM as long as corrosion resistance and formability are not inhibited. Especially, Ni, Al, and Mg are effective for improving corrosion resistance.

Alloyed Plated Layer

The galvanized layer or zinc alloy plated layer is subjected to the alloying treatment to form an alloyed plated layer on the steel sheet surface. When a hot-dip galvanized layer or hot-dip zinc alloy plated layer is subjected to the alloying treatment, an Fe amount of the hot-dip galvanized layer or hot-dip zinc alloy plated layer is preferably in a range from 7.0 to 13.0 mass % in order to improve adhesion between the steel sheet surface and the alloyed plated layer.

The sheet thickness of the present steel sheet A, which is not particularly limited to a specific range of the sheet thickness, is preferably in a range from 0.4 to 5.0 mm in consideration of applicability and productivity. When the sheet thickness is less than 0.4 mm, the shape of the steel sheet is difficult to keep flat and dimensional and shape accuracy is lowered. Accordingly, the sheet thickness is 0.4 mm or more, more preferably 0.8 mm or more.

On the other hand, when the sheet thickness exceeds 5.0 mm, it becomes difficult to control the heating conditions and the cooling conditions during the manufacturing process, and a homogeneous microstructure may not be obtained in the sheet thickness direction. Accordingly, the sheet thickness is preferably 5.0 mm or less, more preferably 4.5 mm or less.

In this manufacturing method (the present manufacturing method A of the invention) as shown in FIG. 1: the hot rolling process (manufacturing method a) is performed so as to satisfy a formula (A); and the cooling process is performed so as to satisfy the formulae (2) and (3), whereby desired-sized carbides are uniformly formed entirely inside steel. Next, the cold rolling process is performed and further the intermediate heat treatment process is performed under predetermined conditions, whereby carbides are heated without being completely melted. Subsequently, by rapidly cooling, a lath structure is formed inside the steel.

Finally, in the main heat treatment process: at the beginning, the temperature is initially rapidly increased so as to satisfy the formula (B); from the time when austenite transformation begins, the heat treatment is reduced so as to satisfy the formula (C); and subsequently rapid cooling is performed. In the latter half of cooling, the austenite fraction is controlled by cooling so as to satisfy a formula (4), thereby forming a structure including acicular structure as a main structure and two types of island-shaped hard structures.

The manufacturing method a, and the present manufacturing methods A, A1a, A1b, and A2 will be described.

Firstly, the manufacturing method a will be described.

The manufacturing method a includes: a hot rolling process of heating cast slab having a predetermined chemical composition to a temperature in a range from 1080 degrees C. to 1300 degrees C., and subsequently subjecting the cast slab to hot rolling, in which hot rolling conditions in a temperature region from the maximum heating temperature to 1000 degrees C. satisfy the formula (A) and a hot rolling completion temperature falls in a range from 975 degrees C. to 850 degrees C.; a cooling process in which cooling conditions applied from the completion of the hot rolling to 600 degrees C. satisfy the formula (2) that represents sum of transformation progress degrees in 15 temperature regions obtained by equally dividing a temperature region ranging from the hot rolling completion temperature to 600 degrees C., and a temperature history that is measured by every 20 degrees C. from a time when 600 degrees C. is reached to a time when a later-described intermediate heat treatment is started satisfy the formula (3); and the intermediate heat treatment process of heating to a temperature in a range from (Ac3−30) degrees C. to (Ac3+100) degrees C. at an average heating rate of at least 30 degrees C. per second in a temperature region ranging from 650 degrees C. to (Ac3−40) degrees C., limiting the dwell time in a temperature region ranging from the heating temperature to (maximum heating temperature−10) degrees C. to 100 seconds or less, and subsequently, and subsequently cooling at an average cooling rate of at least 30 degrees C. per second from the heating temperature to a temperature region ranging from 750 degrees C. to 450 degrees C.

Process conditions of the manufacturing method a will be described.

Steel Sheet to Be Subjected to Heat Treatment

A manufacturing method a is a method of manufacturing the steel sheet a by subjecting a steel sheet having the chemical composition of the steel sheet a to the intermediate heat treatment. Any steel sheet having the chemical composition of the steel sheet a and manufactured through hot rolling and cold rolling according to a typical method is usable as the steel sheet to be subjected to the heat treatment. Preferable hot rolling conditions are as follows.

Hot Rolling Temperature

Molten steel having the chemical composition of the steel sheet a is cast according to a typical method such as continuous casting or thin slab casting to manufacture a steel piece intended for hot rolling. When the steel piece is once cooled to the room temperature and then subjected to hot rolling, the heating temperature is preferably in a range from 1080 degrees C. to 1300 degrees C.

When the heating temperature is less than 1080 degrees C., coarse inclusions due to casting do not melt and the hot-rolled steel sheet may crack in the process after hot rolling. Accordingly, the heating temperature is preferably 1080 degrees C. or more, more preferably 1150 degrees C. or more.

When the heating temperature exceeds 1300 degrees C., a large amount of heat energy is required. Accordingly, the heating temperature is preferably 1300 degrees C. or less, more preferably 1230 degrees C. or less. After casting the molten steel, the steel piece in the temperature region from 1080 degrees C. to 1300 degrees C. may be directly subjected to hot rolling.

Hot rolling is divided into: rolling in a section where the heating temperature is 1000 degrees C. or more to promote recrystallization inside the steel sheet and improve homogeneity; and rolling in a section where the heating temperature is less than 1000 degrees C. to introduce appropriate strain to uniformly promote phase transformation after the rolling.

In the rolling in the section where the heating temperature is 1000 degrees C. or more for enhancing the homogeneity of the steel sheet, rolling conditions need to satisfy the formula (A) in order to promote recrystallization, refine the γ grain size, and enhance the homogeneity inside the steel sheet by diffusing carbon along the grain boundaries. A total rolling reduction in this temperature section is preferably 75% or more.

[Numerical Formula 7]

$$\sum_{i=1}^{n}\left[A\cdot\frac{h_i-h_{i-1}}{h_i}\cdot\exp\left(-\frac{B}{T_i+273}\right)\cdot t^{0.5}\right]\geqq 1.00 \quad \text{(A)}$$

n: rolling pass number up to 1000 degrees C. after removal from the heating furnace $h_i$: finishing sheet thickness [mm] after i pass $T_i$: rolling temperature [degrees C.] at the i pass $t_i$: elapsed time [second] after the rolling at the i pass to an (i+1) pass $A=9.11\times10^7$, $B=2.72\times10^4$: constant value The homogeneity of the steel sheet is improved as the value of the formula (A) becomes larger. However, if the value of the formula (A) is excessively increased, the rolling reduction in the high temperature region is excessively increased and the structure is coarsened. Accordingly, the value of the formula (A) is preferably kept at 4.50 or less. In order to enhance the homogeneity of the steel sheet, the value of the formula (A) is preferably 1.50 or more, further preferably 2.00 or more.

A total rolling reduction of the rolling in the section of less than 1000 degrees C. is preferably 50% or more. The rolling completion temperature of this rolling is preferably in a range from 975 degrees C. to 850 degrees C.

Rolling Completion Temperature: From 850 Degrees C. to 975 Degrees C.

The rolling completion temperature is preferably in a range from 850 degrees C. to 975 degrees C. When the rolling completion temperature is less than 850 degrees C., a rolling reaction force increases and it becomes difficult to stably secure a dimensional accuracy of a shape and a sheet thickness. Therefore, the rolling completion temperature is preferably 850 degrees C. or more. On the other hand, when the rolling completion temperature exceeds 975 degrees C., a steel sheet-heating device is required, resulting in an increase in a rolling cost. Therefore, the rolling completion temperature is preferably 975 degrees C. or less.

A cooling process from the completion of the hot rolling to 600 degrees C. is preferably performed in a range satisfying a formula (2). The formula (2) is a formula expressing the total degree of a transformation progress degree in each of temperature regions obtained by equally dividing the temperature from the rolling completion temperature to 600 degrees C. into 15 parts.

[Numerical Formula 8]

$$\left(\sum_{n=1}^{15}\left[\frac{1.88\times10^2}{1+17\mathrm{Ti}+51\mathrm{Nb}+3.3\sqrt{\mathrm{Mo}}+35\sqrt{\mathrm{B}}}\cdot\exp\left\{36.1-(0.0424-0.0027n)Tf-1.64n-14.4\mathrm{C}+0.62\mathrm{Si}-1.36\mathrm{Mn}+0.82\mathrm{Al}-0.62\mathrm{Cr}-0.62\mathrm{Ni}-\frac{2.85\times10^4}{253+(1.033-0.067n)Tf+40n}\right\}\cdot t(n)^{0.25}\right]\right)^{0.333}\leq 1.00 \quad (2)$$

t(n): dwell time in the n-th temperature region element symbol: mass % of the element Tf: hot rolling completion temperature [degrees C.]

The hot-rolled steel sheet that has been subjected to the cooling treatment to satisfy the above formula (2) has a homogeneous microstructure and is present with carbides dispersed. Accordingly, when the obtained steel sheet is further subjected to the cold rolling and the intermediate heat treatment to provide a steel sheet for heat treatment, carbides are also uniformly dispersed in the steel sheet for heat treatment. Further, in a high-strength steel sheet obtained by subjecting the steel sheet for heat treatment to the main heat treatment, dispersion of the island-shaped hard structure is also leveled and the strength-formability balance is improved.

On the other hand, when the cooling process in the hot rolling does not satisfy the above formula (2), the phase transformation proceeds excessively at a high temperature, resulting in a hot-rolled steel sheet in which carbides are unevenly distributed. In the steel sheet for heat treatment obtained by subjecting this hot-rolled steel sheet to the cold rolling and the intermediate heat treatment, carbides are uniformly dispersed. Further, in the steel sheet obtained by subjecting the steel sheet for heat treatment to the main heat treatment, the island-shaped hard structures are unevenly distributed and the strength-formability balance is lowered. From this viewpoint, the left side of the formula (2) is preferably 0.80 or less, more preferably 0.60 or less.

The temperature history, which is calculated every 20 degrees C. from reaching 600 degrees C. after the completion of hot rolling until the start of the heat treatment (intermediate heat treatment described later) for manufacturing a steel sheet for heat treatment, preferably satisfies a formula (3) below. The middle side of the formula (3) is a formula that expresses the degree of growth of carbides that grow with elapse of time (increase in n). It can be expected that as the value at the middle side of the formula (3) (the value finally obtained before the start of the intermediate heat treatment) becomes larger, carbides becomes coarser.

[Numerical Formula 9]

$$1.00\leq\left[\frac{T_n\cdot\{\log_{10}(t_n)+\mathrm{C}\}}{1.50\times10^4}\right]^2\leq 1.50 \quad (3)$$

$$t_1=\Delta t_1\ (n=1)$$

$$t_n=\Delta t_n+\frac{T_{n-1}}{T_n}\cdot\{\log_{10}(t_{n-1})+\mathrm{C}\}\ (n>1)$$

$$\mathrm{C}=20.00-1.28\cdot\mathrm{Si}^{0.5}-0.13\cdot\mathrm{Mn}^{0.5}-0.47\cdot\mathrm{Al}^{0.5}-1.20\cdot\mathrm{Ti}-2.50\cdot\mathrm{Nb}-0.82\cdot\mathrm{Cr}^{0.5}-1.70\cdot\mathrm{Mo}^{0.5}$$

$T_n$: an average steel sheet temperature [degrees C.] from the (n−1)th calculation time point to the n-th calculation time point $t_n$: an effective total time for carbide growth at the n-th calculation time [hour]

$\Delta t_n$: an elapsed time from the (n−1)th calculation time point to the n-th calculation time point C: parameters related to the growth rate of carbides (element symbol: mass % of element)

When the middle side of the above formula (3) is less than 1.00, the carbides existing in the steel sheet immediately before starting the intermediate heat treatment for obtaining the steel sheet for heat treatment are excessively fine, and the carbides in the steel sheet may disappear by the intermediate heat treatment. Accordingly, the middle side of the above formula (3) is preferably 1.00 or more.

On the other hand, when the middle side of the formula (3) exceeds 1.50, carbides in the steel sheet become excessively coarse, the number density of the carbides is decreased, which may cause an insufficient number density of the carbide after the intermediate heat treatment. Accordingly, the middle side of the formula (3) is preferably 1.50 or less. In order to further improve the properties, the middle side of the formula (3) is preferably in a range from 1.10 to 1.40.

When the steel sheet is heated to the Ac3 point or more before starting the intermediate heat treatment for obtaining the steel sheet for heat treatment, the middle side of the formula (3) becomes zero at that time. Only the temperature history upon and after again reaching 600 degrees C. is calculated.

Cold Rolling Process after Hot Rolling

By cold-rolling the hot-rolled steel sheet before the intermediate heat treatment below, the structure becomes a homogeneous processed structure, and, in the subsequent heat treatment (intermediate heat treatment), a large number of austenites are uniformly generated to provide a fine structure, resulting in an improvement in the properties. When the rolling reduction of cold rolling exceeds 80%, excessive recrystallization may proceed locally during the intermediate heat treatment and an aggregated structure may develop around the recrystallized region. Therefore, the cold rolling ratio is defined as 80% or less. In order to obtain a sufficient effect by the fine structure, the cold rolling ratio is preferably 30% or more. At the cold rolling ratio of less than 30%, development of the processed structure becomes insufficient and generation of the homogeneous austenite does not proceed in some cases.

Intermediate Heat Treatment Process for Hot-Rolled and Cold-Rolled Steel Sheet

In order to adjust the size of carbides in the wound cold-rolled steel sheet, the cold-rolled steel sheet is subjected to the intermediate heat treatment process at appropriate temperature and time. The intermediate heat treatment process includes: heating the cold-rolled steel sheet to a temperature in a range from (Ac3−30) degrees C. to (Ac3+100) degrees C. at an average heating rate of at least 30 degrees C. per second in the temperature region ranging from 650 degrees C. to (Ac3−40) degrees C.; limiting the dwell time in the temperature region ranging from the heating temperature to (maximum heating temperature−10) degrees C. to 100 seconds or less; and subsequently cooling from the heating temperature at an average cooling rate of at least 30 degrees C. per second in a temperature region ranging from 750 degrees C. to 450 degrees C. Moreover, the steel sheet after heated to Ac3 point or more may be again cooled to the room temperature.

The cold-rolled steel sheet may be pickled at least once before the intermediate heat treatment. When oxides on the surface of the cold-rolled steel sheet are removed and cleaned by pickling, plating properties of the steel sheet are improved.

Steel-sheet-heating temperature: (Ac3−30) degrees C. to (Ac3+100) degrees C.

Temperature region with limited heating rate: from 650 degrees C. to (Ac3−40) degrees C.

Average heating rate in the above temperature region: at least 30 degrees C. per second The cold-rolled steel sheet is heated to (Ac3−30) degrees C. or more. When the steel-sheet-heating temperature is less than (Ac3−30) degrees C., coarse aggregated ferrite remains, resulting in a significant decline of mechanical characteristics of the high-strength steel sheet. Therefore, the steel-sheet-heating temperature is defined as (Ac3−30) degrees C. or more, preferably (Ac3−15) degrees C. or more, more preferably (Ac3+5) degrees C. or more.

On the other hand, when the steel-sheet-heating temperature exceeds (Ac3+100) degrees C., carbides in the steel sheet disappear. Therefore, the heating temperature is defined as (Ac3+100) degrees C. or less. In order to further inhibit disappearance of the carbides, the heating temperature is preferably (Ac3+80) degrees C. or less, more preferably (Ac3+60) degrees C. or less.

In heating, the steel sheet is heated at the average heating rate of at least 30 degrees C. per second in a temperature region from 650 degrees C. to (Ac3−40) degrees C. By setting the average heating rate in the temperature temperature region from 650 degrees C. to (Ac3−40) degrees C., where a dissolution rate of carbides is high, to at least 30 degrees C. per second, the carbides can be inhibited from being dissolved to remain until the start of cooling. Therefore, the average heating rate is preferably at least 50 degrees C. per second, more preferably at least 70 degrees C. per second in the temperature region from 650 degrees C. to (Ac3−40) degrees C.

The Ac1 and Ac3 points of the steel sheet are obtained by measuring a volume expansion curve that is formed by cutting out small pieces from the hot-rolled steel sheet before heating, heating the small pieces at 1100 degrees C., subsequently subjecting the small pieces to a homogenization treatment of cooling at 10 degrees C. per second to the room temperature, and subsequently heating the small pieces at 10 degrees C. per second from the room temperature to 1100 degrees C. Further, the volume expansion curve may be replaced with a calculation result calculated by an empirical formula based on sufficient experimental data.

Dwell time in temperature region from maximum heating temperature to (maximum heating temperature−10) degrees C.: 100 seconds or less A dwell time in a temperature region from the maximum heating temperature to (maximum heating temperature−10) degrees C. is limited to 100 seconds or less. When the dwell time exceeds 100 seconds, carbides dissolve and the number density of carbides with an equivalent circle diameter of 0.1 μm or more decreases to less than $1.0\times10^{10}$ pieces per $m^2$. Therefore, the dwell time at the heating temperature is defined as 100 seconds or less, preferably 60 seconds or less, more preferably 30 seconds or less.

The lower limit of the dwell time is not particularly set, but in order to make the dwell time less than 0.1 seconds, it is necessary to cool rapidly immediately after the completion of heating, and a great cost is required to realize it. Therefore, the dwell time is preferably 0.1 seconds or more.

Temperature region with limited cooling rate: from 750 degrees C. to 450 degrees C.

Average cooling rate in the above temperature region: at least 30 degrees C. per second The hot-rolled steel sheet is heated to a temperature region from (Ac3−30) to (Ac3+100) degrees C., and subsequently cooled from the heating temperature at the average cooling rate of at least 30 degrees C. per second in the temperature region from 750 degrees C. to 450 degrees C. This cooling inhibits generation of aggregated ferrite in the above temperature region. The microstructure a can be formed by this series of heating and cooling.

The steel plate for heat treatment (steel plate a) can be obtained without specifying cooling conditions in a temperature region of less than 450 degrees C. When the dwell time from 450 degrees C. to 200 degrees C. is short, a lath structure is formed at a lower temperature and the crystal grain size becomes finer. Accordingly, in a high-strength steel sheet obtained by subjecting the steel sheet for heat treatment to the heat treatment, the microstructure becomes finer and the strength-formability balance is improved. From this viewpoint, the dwell time in the temperature region from 450 degrees C. to 200 degrees C. is preferably 60 seconds or less.

On the other hand, when the dwell time in the temperature region from 450 degrees C. to 200 degrees C. is increased, a temperature of generating the lath structure is increased to soften the steel sheet for heat treatment, so that costs required for winding and cutting the steel sheet is reducible. From this viewpoint, the dwell time in the temperature region from 450 degrees C. to 200 degrees C. is preferably 60 seconds or more, more preferably 120 seconds or more.

It is preferable to cold-roll the steel sheet after the intermediate heat treatment because thermal strain generated inside the steel sheet due to the heating and cooling of the intermediate heat treatment is removed and the flatness of the steel sheet is improved. However, when the rolling reduction of cold rolling exceeds 15%, excessive dislocations are accumulated in the lath structure formed by the intermediate heat treatment, and an aggregated structure is formed during the subsequent main heat treatment. Therefore, the cold rolling ratio is preferably 15% or less.

When the steel sheet after the intermediate heat treatment is cold-rolled, the steel sheet may be heated before rolling or between rolling passes. This heating softens the steel sheet, reduces the rolling reaction force during rolling, and improves the shape and dimensional accuracy of the steel sheet. The heating temperature is preferably 700 degrees C. or less. When the heating temperature exceeds 700 degrees C., it is likely that a part of the microstructure becomes aggregated austenite, Mn segregation proceeds, and a coarse aggregated Mn concentrated region is formed.

This aggregated Mn-concentrated region becomes untransformed austenite and remains aggregated even in annealing (main heat treatment) process, and an aggregated and coarse hard structure is formed in the steel sheet, resulting in deterioration in ductility. When the heating temperature is less than 300 degrees C., a sufficient softening effect cannot be obtained. Accordingly, the heating temperature is preferably 300 degree C. or more. The pickling and the cold rolling may be performed either before or after the heating, or both before and after the heating.

Next, the manufacturing methods A, A1a, A1b, Al c, and A2 of the invention will be described.

The present manufacturing method A is a manufacturing method of the present steel sheet A and performs a main heat treatment including:

heating the steel sheet a to a temperature in a range from (Ac1+25) degrees C. to Ac3 so that a temperature history from 450 degrees C. to 650 degrees C. satisfies a formula (B) below and subsequently a temperature history from 650 degrees C. to 750 degrees C. satisfies a formula (C) below;

retaining the steel sheet a for 150 seconds or less at the heating temperature;

cooling the steel sheet a from the heating retention temperature to a temperature region ranging from 550 degrees C. to 300 degrees C. at an average cooling rate of at least 10 degrees C. per second in a temperature region from 700 degrees C. to 550 degrees C.;

setting a dwell time in the temperature region from 550 degrees C. to 300 degrees C. to 1000 seconds or less; and setting dwell conditions in the temperature region from 550 degrees C. to 300 degrees C. to satisfy a formula (4) below.

The present manufacturing method A1a is a manufacturing method of the present steel sheet A1.

The present manufacturing method A1a includes: immersing the high-strength steel sheet excellent in formability and impact resistance in the present manufacturing method A in a plating bath including zinc as a main component to form the galvanized layer or the zinc alloy plated layer on one surface or both surfaces of the high-strength steel sheet.

The present manufacturing method A1b is a manufacturing method of the present steel sheet A1.

The present manufacturing method A1b includes: immersing the steel sheet in a plating bath including zinc as a main component during dwelling in a range from 550 degrees C. to 300 degrees C. in the present manufacturing method A to form a galvanized layer or a zinc alloy plated layer on one surface or both surfaces of the steel sheet.

The present manufacturing method A1c is a manufacturing method of the present steel sheet A1.

The present manufacturing method A1c includes: forming a galvanized layer or a zinc alloy plated layer by electroplating on one surface or both surfaces of the the high-strength steel sheet excellent in formability and impact resistance in the present manufacturing method A.

The present manufacturing method A2 is a manufacturing method of the present steel sheet A2.

The present manufacturing method A2 includes: heating the galvanized layer or the zinc alloy plated layer of the present steel sheet A1 to a temperature in a range from 400 degrees C. to 600 degrees C. to apply an alloying treatment to the galvanized layer or the zinc alloy plated layer.

Process conditions of the present manufacturing method A will be described.

Main Heat Treatment Process

In heating the steel sheet a to a steel-sheet-heating temperature in a range from (Ac1+25) degrees C. to Ac3 point, the steel sheet a is heated so that the temperature history from 450 degrees C. to 650 degrees C. is defined to satisfy the formula (B) below and subsequently the temperature history from 650 degrees C. to 750 degrees C. is defined to satisfy the formula (C) below, and the steel sheet a is retained for 150 seconds or less at the heating temperature.

Steel-Sheet-Heating Temperature: (Ac1+25) Degrees C. to Ac3 Point

When the steel-sheet-heating temperature is less than (Ac1+25) degrees C., it is concerned that cementite in the steel sheet may remain undissolved to deteriorate machanical characteristics. Accordingly, the steel-sheet-heating temperature is determined to be equal to or more than (Ac1+25) degrees C., preferably equal to or more than (Ac1+40) degrees C.

On the other hand, the upper limit of the steel-sheet-heating temperature is determined to be Ac3 point. When the steel-sheet-heating temperature exceeds the Ac3 point, the entire microstructure becomes austenite and the lath structure disappears, so that acicular ferrite to be derived from the lath structure cannot be obtained. Therefore, the steel-sheet-heating temperature is defined to be equal to or less than the Ac3 point. Accordingly, in order to inherit the lath structure of the present steel sheet a and further improve the machanical characteristics, the steel-sheet-heating temperature is preferably equal to or less than (Ac3−10) degrees C., more preferably equal to or less than (Ac3−20) degrees C. The steel-sheet-heating temperature is indicated as "maximum heating temperature."

Temperature region with limited heating rate: from 450 degrees C. to 650 degrees C.

Average heating rate: Formula (B)

[Numerical Formula 10]

$$a_0 = 1.00 \tag{B}$$

$$a_n = \frac{F}{C_n} \cdot t_n^{\left(\frac{1}{K}\right)} + 10^{\left(\frac{354+5n}{359+5n} \cdot \log_{10} a_{n-1}\right)}$$

$$K + \log_{10} a_{20} \leq 3.20$$

$$C_n : \left\{1.28 + 34 \cdot \left(1 - \frac{89+2n}{130}\right)^2\right\} \cdot Si^{0.5} + 0.13 \cdot Mn^{0.5} + 0.47 \cdot Al^{0.5} + 0.82 \cdot Cr^{0.5} + 1.70 \cdot Mo^{0.5}$$

Each element of the chemical composition represents an added amount [mass %].

F: constant value, 2.57

$t_n$: elapsed time [second] from (440+10n) degrees C. to (450+10n) degrees C.

K: a value of the middle side of the formula (3)

The formula (B) is a formula consisting of terms of the formula (3) representing formation and growth behavior of carbides in the hot rolling process, the temperature history in a section from 450 degrees C. to 650 degrees C. in the hot rolling process, the temperature history controlling a size of carbides obtained after the intermediate heat treatment, and chemical composition strongly influencing the size of the carbides. When the temperature history in the temperature region ranging from 450 degrees C. to 650 degrees C. does not satisfy the formula (B), carbides in the microstructure a of the steel sheet a grows while decreasing in number. At the end of the heating, isotropic and fine austenite cannot be obtained and an average aspect ratio of a fine and island-shaped hard structure increases excessively. For this reason, the temperature history in the above limited temperature region needs to satisfy the formula (B).

A smaller value of the left side of the formula (B) is preferable. However, the value of the left side of the formula (B) is not smaller than the value of the middle side of the formula (3). A lower limit of the value of the left side of the formula (B) is equal to the value of the middle side of the formula (3). Moreover, since carbides grow while decreasing in number when the value of the left side of the formula (B) is large, the value of the left side of the formula (B) is preferably 3.00 or less, further preferably 2.80 or less.

The upper limit of the average heating rate in the above limited temperature region is not particularly limited. However, when the average heating rate exceeds 100 degrees per second, the effect is saturated although the growth of carbides with a decrease in number does not occur. Accordingly, 100 degrees per second is a practical upper limit of the average heating rate.

Temperature Region with Limited Heating Rate: from 650 Degrees C. to 750 Degrees C.

Average heating rate: Formula (C)

[Numerical Formula 11]

$$1.00 \leq \sum_{n=1}^{10} \frac{M}{N+P} \cdot \exp\left(-\frac{Q}{918+10n}\right) \cdot t_n^{0.5} \leq 5.00 \tag{C}$$

M: constant: $5.47 \times 10^{10}$

K: a value of the left side of the formula (B)

P: 0.38Si+0.64Cr+0.34Mo

Each element of the chemical composition represents an added amount [mass %].

Q: $2.43 \times 10^4$ $t_n$: elapsed time [second] from (640+10n) degrees C. to (650+10n) degrees C.

The formula (C) is a formula consisting of terms of the formula (B) representing formation and growth behavior of carbides in the hot rolling process, and chemical composition strongly influencing stability of the carbides. When the average heating rate in the temperature region ranging from 650 degrees C. to 750 degrees C. does not satisfy the formula (C), nucleation from carbides of 0.1 μm or more in the steel sheet for heat treatment do not proceed sufficiently and austenite is generated with the lath boundary as the nucleation site, whereby isotropic and fine austenite cannot be obtained and an average aspect ratio of a fine and island-shaped hard structure increases excessively. For this reason, the temperature history in the above limited temperature region needs to satisfy the formula (C).

When the value of the formula (C) is less than 1.00, austenite transformation having the lath boundary as the nucleation site occurs preferentially, so that a predetermined structure cannot be obtained. In order to avoid nucleation at the lath boundary and prioritize nucleation from fine carbides, the value of the formula (C) needs to be 1.00 or more, preferably 1.10 or more, further preferably 1.20 or more.

When the value of the formula (C) exceeds 5.00, austenite generated from some nucleation sites grows, uptake of fine carbides and coalescence of austenites progress, and a coarse aggregated structure develops. In order to avoid excessive growth of austenite, the value of the formula (C) needs to be 5.00 or less, preferably 4.50 or less, further preferably 3.50 or less.

Heating Retention Time: 150 Seconds or Less

Under the above conditions, the steel sheet a is heated to reach the steel-sheet-heating temperature (maximum heating temperature) and retained in a temperature region ranging from the steel-sheet-heating temperature to (steel-sheet-heating temperature−10 degrees C.) for 150 seconds or less. When the heating retention time exceeds 150 seconds, the microstructure may become austenite and the lath structure may disappear. Accordingly, the heating retention time is defined as 150 seconds or less, preferably 120 seconds or less. The lower limit of the heating retention time is not particularly limited. Although the heating retention time may be zero seconds, the heating retention time is preferably 10 seconds or more in order to completely dissolve coarse carbides.

Temperature Region with Limited Cooling Rate: From 700 Degrees C. To 550 Degrees C.

Average cooling rate: at least 10 degrees C. per second

In cooling the present steel sheet a after retained for 150 seconds or less at the heating temperature, the steel sheet a is cooled at the average cooling rate of at least 10 degrees C. per second in the temperature region from 700 degrees C. to 550 degrees C. When the average cooling rate is less than 10 degrees C. per second, aggregated ferrite may be generated and acicular ferrite may be sufficiently obtained, the average cooling rate in the temperature region from 700 degrees C. to 550 degrees C. is defined to be at least 10 degrees C. per second, preferably 25 degrees C. per second.

The upper limit of the average cooling rate is equivalent to the upper limit of a cooling capacity of cooling equipment and is at most about 200 degrees C. per second.

Cooling stop temperature: from 550 degrees C. to 300 degrees C.

Dwell time: 1000 seconds or less

The present steel sheet a after cooled at the average cooling rate of at least 10 degrees C. per second in the temperature region from 700 degrees C. to 550 degrees C. is cooled to the temperature region from 550 degrees C. to 300 degrees C. and is left to dwell in this temperature region for 1000 seconds or less. When the dwell time exceeds 1000 seconds, austenite is transformed into bainite, bainitic ferrite, pearlite and/or cementite to be decreased and an island-shaped hard structure having a sufficient volume fraction cannot be obtained. Accordingly, the dwell time in the above temperature region is defined as 1000 or less.

In the above temperature range, the dwell time is preferably 700 seconds or less, more preferably 500 seconds or less, in terms of increasing the volume fraction of the island-shaped hard structure and further increasing the strength. The shorter dwell time is preferable. However, since special cooling equipment is required to allow less than 0.3 second of the dwell time, the dwell time is preferably 0.3 second or more.

Moreover, in order to form residual austenite and further improve ductility of the steel sheet, dwell conditions in the above temperature region preferably satisfy the formula (4).

[Numercial Formula 12]

$$\left[\sum_{n=1}^{10} 1.29\times10^{2}\cdot\left\{\mathrm{Si}+0.9\mathrm{Al}\cdot\left(\frac{T(n)}{550}\right)^{2}+0.3(\mathrm{Cr}+1.5\mathrm{Mo})\cdot\frac{T(n)}{550}\right\}\cdot(B_s-T(n))^{3}\cdot\exp\left(-\frac{1.44\times10^{4}}{T(n)+273}\right)\cdot t^{0.5}\right]^{-1}\leq 1.00 \quad (4)$$

T(n): an average temperature of the steel sheet in an n-th time zone obtained by equally dividing the dwell time into 10 parts

*Bs* point (degrees C.)=611-33[Mn]−17[Cr]−17[Ni]−21[Mo]−11[Si]+30[Al]+(24[Cr]+15[Mo]+5500[B]+240[Nb])/(8[C])

[element]: mass % of each element, at Bs<T(n), (Bs−T(n))=0 t: total [seconds] of a dwell time in the temperature region from 550 degrees C. to 300 degrees C.

The above formula (4) is a formula expressing the tendency of C to be concentrated in untransformed austenite due to phase transformation in the temperature range 550 degrees C. to 300 degrees C. When the left side of the formula (4) exceeds 1.00, the concentration of C becomes insufficient, and austenite is transformed in the cooling process performed to room temperature, and a sufficient amount of residual austenite cannot be obtained. Accordingly, in order to sufficiently secure residual austenite, the left side of the formula (4) is preferably 1.00 or less, more preferably 0.85 or less, further preferably 0.70 or less.

In the production method A of the invention, the steel sheet after the main heat treatment may be tempered by being heated to a temperature in a range from 200 degrees C. to 600 degrees C. By performing the tempering treatment, martensite in the microstructure becomes tough tempered martensite, and in particular, impact resistance is improved. From this viewpoint, a tempering temperature is preferably 200 degrees C. or more, more preferably 230 degrees C. or more.

On the other hand, when the tempering temperature is excessively high, coarse carbides are generated and strength and formability are lowered. Therefore, the tempering temperature is preferably 600 degrees C. or less, more preferably 550 degrees C. or less. The time for tempering treatment is not particularly limited to a specific range. The time for tempering treatment may be appropriately set according to the chemical composition and the above heat history of the steel sheet.

In the present manufacturing method A, the steel sheet after the main heat treatment may be subjected to skin pass rolling with a rolling reduction of 2.0% or less. By subjecting the above steel sheet to skin pass rolling with a rolling reduction of 2.0% or less, the shape, and dimensional accuracy of the steel sheet can be improved. Even if the rolling reduction of skin pass rolling exceeds 2.0%, the effect cannot be expected to increase further, and there is concern about the harmful effects of structural changes due to an increase in the rolling reduction, so the rolling reduction is preferably 2.0% or less. Further, in the present manufacturing method A, the tempering treatment may be performed after the skin pass rolling, and conversely, the skin pass rolling may be performed after the tempering treatment. Alternatively, the skin pass rolling may be applied to the steel sheet both of before and after the tempering treatment.

Galvanized Layer and Zinc Alloy Plated Layer

A galvanized layer or a zinc alloy plated layer is formed on one surface or both surfaces of the present steel sheet A by the manufacturing methods A1a, A1b and Al c of the invention. The plating method is preferably a hot-dip galvanizing method or an electroplating method.

Process conditions of the present manufacturing method A1a will be described.

In the present manufacturing method A1a of the invention, the present steel sheet A is immersed in a plating bath including zinc as a main component to form a galvanized layer or a zinc alloy plated layer on one surface or both surfaces of the present steel sheet A.

Temperature of Plating Bath

The temperature of the plating bath is preferably from 450 degrees C. to 470 degrees C. When the temperature of the plating bath is less than 450 degrees C., the viscosity of the plating solution increases, it becomes difficult to control the thickness of the plated layer accurately, and the appearance of the steel sheet is impaired. Therefore, the temperature of the plating bath is preferably 450 degrees C. or more.

On the other hand, when the temperature of the plating bath exceeds 470 degrees C., a large amount of fume is formed from the plating bath and the working environment is deteriorated to lower the work safety. Therefore, the temperature of the plating bath is preferably 470 degrees C. or less.

The temperature of the present steel sheet A immersed in the plating bath is preferably in a range from 400 degrees C. to 530 degrees C. When the temperature of the steel sheet is less than 400 degrees C., a large amount of heat is required to stably maintain the temperature of the plating bath at 450 degrees C. or more, and the plating cost increases. Therefore, the temperature of the steel sheet is preferably 400 degrees C. or more, more preferably 430 degrees C. or more.

On the other hand, when the temperature of the steel sheet exceeds 530 degrees C., a large amount of heat must be removed to keep the temperature of the plating bath stable at 470 degrees C. or less, thereby increasing the plating cost. Therefore, the temperature of the steel sheet is preferably 530 degrees C. or less, more preferably 500 degrees C. or less.

Composition of Plating Bath

The plating bath mainly contains zinc and preferably has an effective Al amount of 0.01 to 0.30 mass % which is obtained by subtracting the entire Fe amount from the entire Al amount. When the effective Al amount of the galvanizing bath is less than 0.01 mass %, Fe excessively invades into the galvanizing layer or the zinc alloy plated layer, and the plating adhesion is lowered. The fore, the effective Al amount of the galvanizing bath is 0.01 mass % or more, more preferably 0.04 mass % or more.

On the other hand, when the effective Al amount of the galvanizing bath exceeds 0.30 mass %, Al oxides are excessively formed at the interface between the base iron and the galvanized layer or the zinc alloy plated layer, and the plating adhesion is significantly deteriorated. Therefore, the effective Al amount of the galvanizing bath is preferably 0.30 mass % or less. Since the Al oxides hinder movement of Fe atoms and Zn atoms to inhibit formation of the alloy phase in the subsequent alloying treatment, the effective Al amount of the plating bath is more preferably 0.20 mass % or less.

The plating bath may contain one or more of Ag, B, Be, Bi, Ca, Cd, Co, Cr, Cs, Cu, Ge, Hf, Zr, I, K, La, Li, Mg, Mn, Mo, Na, Nb, Ni, Pb, Rb, Sb, Si, Sn, Sr, Ta, Ti, V, W, Zr, and REM in order to improve corrosion resistance and formability.

The adhesion amount of plating is adjusted by pulling the steel sheet out of the plating bath and then spraying a high-pressure gas mainly including nitrogen on the surface of the steel sheet to remove excess plating solution.

Process conditions of the present manufacturing method A1b will be described.

In manufacturing a high-strength steel sheet excellent in formability and impact resistance according to the present manufacturing method A, the present manufacturing method A1b includes immersing the steel sheet in a plating bath including zinc as a main component during dwelling in the temperature region from 550 degrees C. to 300 degrees C. to form a galvanized layer or a zinc alloy plated layer on one surface or both surfaces of the high-strength steel sheet.

Immersing the steel sheet in the plating bath can be performed at any timing in the dwell time in the temperature region from 550 degrees C. to 300 degrees C. Immediately after the temperature reaches 550 degrees C., the steel sheet can be immersed tin the plating bath and then dwell in the temperature region from 550 degrees C. to 300 degrees C. Alternatively, after the temperature reaches 550 degrees C., the steel sheet can dwell for a certain time in the temperature region from 550 degrees C. to 300 degrees C., subsequently be immersed in the plating bath, further dwell in this temperature region, and then be cooled to the room temperature. Alternatively, after the temperature reaches 550 degrees C., the steel sheet can dwell for a certain time in the temperature region from 550 degrees C. to 300 degrees C., subsequently be immersed in the plating bath and immediately be cooled to the room temperature.

Details other than the above are the same as those in the present manufacturing method A1a.

Process conditions of the present manufacturing method A1c of the invention (also referred to as the present manufacturing method A1c) will be described.

In the present manufacturing method A1c, a galvanized layer or a zinc alloy plated layer is formed on one surface or both surfaces of the present steel sheet A by electroplating.

Electroplating

In the present manufacturing method A1c, a galvanized layer or a zinc alloy plated layer is formed on one surface or both surfaces of the present steel sheet A under typical electroplating conditions.

Alloying of Galvanized Layer and Zinc Alloy Plated Layer

The present manufacturing method A2 includes heating a galvanized layer or a zinc alloy plated layer, which is formed on one surface or both surfaces of the present steel sheet A by the present manufacturing method A1a, A1b or Al c, to a temperature in a range from 400 degrees C. to 600 degrees C. for alloying. The heating time is preferably in a range from 2 to 100 seconds.

When the heating temperature is less than 400 degrees C. or the heating time is less than 2 seconds, alloying does not proceed sufficiently and the plating adhesion is not improved. Therefore, it is preferable that the heating temperature is 400 degrees C. or more and the heating time is 2 seconds or more.

On the other hand, when the heating temperature exceeds 600 degrees C. or the heating time exceeds 100 seconds, alloying excessively proceeds and the plating adhesion is lowered. Therefore, it is preferable that the heating temperature is 600 degrees C. or less and the heating time is 100 seconds or less. In particular, when the heating temperature is increased, the strength of the steel sheet tends to be lowered. Therefore, it is more preferable that the heating temperature is 550 degrees or less.

The alloying treatment may be performed at any timing after the plating. For instance, after the plating, the steel sheet may be cooled to the room temperature and again heated to perform the alloying treatment.

Examples

Next, Examples of the invention will be described. Conditions used in Examples are exemplarily adopted for checking the feasibility and effect of the invention. The invention is not limited to the exemplary conditions. Various conditions are applicable to the invention as long as the conditions are not contradictory to the gist of the invention and are compatible with an object of the invention.

Example: Manufacture of Steel Sheet for Heat Treatment

Steel pieces were manufactured by casting molten steel with the chemical compositions shown in Tables 1 and 2. Next, the steel pieces are subjected to hot rolling and cold rolling under the conditions shown in Tables 3 and 4, and heat-treated (tempered) as appropriate to obtain steel sheets. When the tempering heat treatment is performed, numerical values are indicated in the "Tempering temperature" column in Tables 3 and 4.

TABLE 1

| Chemical component | Component Content (mass %) C | Si | Mn | P | S | Al | N | O | Others | Left side of Formula (1) | Bs point ° C. | |
|---|---|---|---|---|---|---|---|---|---|---|---|---|
| A | 0.198 | 0.78 | 2.51 | 0.009 | 0.0036 | 0.022 | 0.0027 | 0.0004 | | 1.66 | 520 | Example |
| B | 0.105 | 0.34 | 1.78 | 0.010 | 0.0028 | 0.222 | 0.0017 | 0.0009 | Cr: 0.24, Mo: 0.08, B: 0.0018 | 1.74 | 569 | Example |
| C | 0.203 | 1.58 | 3.04 | 0.003 | 0.0046 | 0.081 | 0.0060 | 0.0021 | | 2.66 | 496 | Example |
| D | 0.085 | 1.07 | 1.73 | 0.016 | 0.0010 | 0.037 | 0.0038 | 0.0016 | Ti: 0.039, B: 0.0028 | 1.69 | 566 | Example |
| E | 0.432 | 0.84 | 1.37 | 0.009 | 0.0031 | 0.063 | 0.0053 | 0.0016 | | 1.33 | 558 | Example |
| F | 0.229 | 0.86 | 2.16 | 0.013 | 0.0011 | 0.201 | 0.0056 | 0.0014 | | 1.65 | 536 | Example |
| G | 0.165 | 0.02 | 2.81 | 0.014 | 0.0020 | 0.257 | 0.0018 | 0.0015 | Nb: 0.009 | 1.05 | 527 | Example |
| H | 0.136 | 0.59 | 4.37 | 0.002 | 0.0015 | 0.851 | 0.0029 | 0.0008 | | 2.25 | 486 | Example |
| I | 0.240 | 0.07 | 3.77 | 0.012 | 0.0049 | 1.212 | 0.0011 | 0.0009 | V: 0.054 | 1.57 | 522 | Example |
| J | 0.198 | 0.48 | 1.80 | 0.010 | 0.0025 | 0.079 | 0.0089 | 0.0012 | Cu: 0.26, Mg: 0.0022 | 1.12 | 549 | Example |
| K | 0.281 | 0.76 | 1.69 | 0.005 | 0.0020 | 0.163 | 0.0022 | 0.0001 | Ti: 0.160 | 1.42 | 552 | Example |
| L | 0.177 | 1.27 | 2.18 | 0.014 | 0.0024 | 0.097 | 0.0041 | 0.0005 | Nb: 0.064, Ca: 0.0012 | 2.08 | 539 | Example |
| M | 0.138 | 2.24 | 1.05 | 0.002 | 0.0001 | 0.098 | 0.0050 | 0.0014 | Cr: 0.15, Ni: 0.22 | 3.04 | 552 | Example |
| N | 0.231 | 1.72 | 0.63 | 0.030 | 0.0001 | 0.030 | 0.0032 | 0.0004 | Cr: 0.64 | 3.74 | 570 | Example |
| O | 0.095 | 2.02 | 0.85 | 0.046 | 0.0004 | 0.013 | 0.0049 | 0.0004 | Ni: 1.27, Cu: 0.28 | 2.32 | 540 | Example |
| P | 0.129 | 1.92 | 1.32 | 0.015 | 0.0080 | 0.029 | 0.0039 | 0.0016 | V: 0.186 | 2.39 | 547 | Example |
| Q | 0.327 | 1.46 | 1.96 | 0.002 | 0.0012 | 0.320 | 0.0040 | 0.0008 | Ti: 0.008, Nb: 0.025, B: 0.0007 | 2.21 | 544 | Example |
| R | 0.174 | 0.74 | 1.32 | 0.009 | 0.0009 | 0.003 | 0.0057 | 0.0022 | Cr: 1.06, Zr: 0.0013 | 4.17 | 560 | Example |
| S | 0.233 | 1.32 | 2.40 | 0.008 | 0.0054 | 0.092 | 0.0048 | 0.0011 | Ti: 0.087, REM: 0.0020 | 2.20 | 520 | Example |
| T | 0.184 | 0.37 | 2.36 | 0.001 | 0.0048 | 0.084 | 0.0108 | 0.0012 | Ti: 0.024, Ca: 0.0013 | 1.22 | 532 | Example |
| U | 0.367 | 0.16 | 2.97 | 0.023 | 0.0047 | 1.681 | 0.0046 | 0.0013 | Mo: 0.18 | 1.60 | 559 | Example |
| V | 0.232 | 1.90 | 1.15 | 0.015 | 0.0025 | 0.124 | 0.0031 | 0.0007 | Nb: 0.030, Ni: 0.32, Ce: 0.0018 | 2.34 | 554 | Example |
| W | 0.138 | 0.26 | 1.51 | 0.003 | 0.0022 | 0.084 | 0.0061 | 0.0007 | Ti: 0.039, Mo: 0.33 | 1.09 | 558 | Example |
| X | 0.186 | 1.25 | 2.07 | 0.013 | 0.0034 | 0.005 | 0.0032 | 0.0014 | B: 0.0035, La: 0.0009 | 1.98 | 542 | Example |
| Y | 0.129 | 0.86 | 1.87 | 0.023 | 0.0014 | 0.063 | 0.0068 | 0.0015 | W: 0.24 | 1.52 | 542 | Example |
| Z | 0.279 | 1.03 | 3.19 | 0.003 | 0.0073 | 0.130 | 0.0003 | 0.0004 | Ca: 0.0029 | 2.17 | 498 | Example |

TABLE 2

| Chemical component | Component Content (mass %) C | Si | Mn | P | S | Al | N | O | Others | Left side of Formula (1) | Bs point ° C. | |
|---|---|---|---|---|---|---|---|---|---|---|---|---|
| AA | 0.199 | 0.44 | 1.17 | 0.011 | 0.0045 | 0.020 | 0.0034 | 0.0016 | | 0.85 | 568 | Comparative |
| AB | 0.045 | 1.24 | 2.05 | 0.009 | 0.0026 | 0.091 | 0.0041 | 0.0001 | | 1.97 | 532 | Comparative |
| AC | 0.523 | 1.03 | 1.99 | 0.008 | 0.0023 | 0.023 | 0.0031 | 0.0011 | | 1.73 | 535 | Comparative |
| AD | 0.198 | 3.05 | 2.09 | 0.010 | 0.0024 | 0.059 | 0.0049 | 0.0016 | | 3.79 | 510 | Comparative |
| AE | 0.203 | 1.13 | 7.00 | 0.011 | 0.0063 | 0.101 | 0.0029 | 0.0004 | | 3.60 | 371 | Comparative |
| AF | 0.205 | 1.05 | 0.32 | 0.008 | 0.0017 | 0.025 | 0.0016 | 0.0012 | | 1.17 | 590 | Comparative |
| AG | 0.218 | 1.08 | 1.96 | 0.128 | 0.0061 | 0.018 | 0.0057 | 0.0008 | | 1.77 | 535 | Comparative |
| AH | 0.210 | 1.15 | 2.03 | 0.010 | 0.0231 | 0.009 | 0.0065 | 0.0007 | | 1.86 | 532 | Comparative |
| AI | 0.194 | 0.98 | 2.09 | 0.010 | 0.0030 | 2.325 | 0.0017 | 0.0011 | | 2.06 | 601 | Comparative |
| AJ | 0.197 | 0.98 | 2.00 | 0.009 | 0.0031 | 0.050 | 0.0198 | 0.0001 | | 1.69 | 536 | Comparative |
| AK | 0.214 | 1.06 | 2.01 | 0.011 | 0.0028 | 0.061 | 0.0028 | 0.0153 | | 1.77 | 535 | Comparative |

※A value with underline indicates that the value is out of the scope of the invention.

TABLE 3

| Hot-rolled steel sheet | Chemical component | Hot-rolling process: Heating temperature ° C. | Hot rolling completion temperature ° C. | Left side of Formula (A) | Left side of Formula (2) | Middle Side of Formula (3) | Tempering temperature ° C. | Cold-rolling process Cold rolling ratio % | |
|---|---|---|---|---|---|---|---|---|---|
| 1 | A | 1249 | 962 | 3.24 | 0.43 | 1.24 | — | 48 | Example |
| 2 | A | 1221 | 900 | 1.94 | 0.41 | 1.23 | — | 43 | Example |
| 3 | A | 1241 | 891 | 3.55 | 0.46 | 1.41 | 640 | 48 | Example |
| 4 | A | 1262 | 940 | 4.26 | 0.55 | 1.25 | — | 53 | Example |
| 5 | B | 1214 | 962 | 1.58 | 0.48 | 1.27 | 625 | 58 | Example |
| 6 | B | 1269 | 973 | 3.47 | 0.49 | 0.92 | — | 66 | Comparative |
| 7 | C | 1219 | 951 | 1.29 | 0.28 | 1.05 | — | 46 | Example |

TABLE 3-continued

| Hot-rolled steel sheet | Chemical component | Hot-rolling process: Heating temperature ° C. | Hot rolling completion temperature ° C. | Left side of Formula (A) | Left side of Formula (2) | Middle Side of Formula (3) | Tempering temperature ° C. | Cold-rolling process Cold rolling ratio % | |
|---|---|---|---|---|---|---|---|---|---|
| 8 | C | 1209 | 927 | 1.54 | 0.42 | 1.08 | — | 65 | Example |
| 9 | C | 1242 | 923 | 3.64 | 0.39 | 1.54 | 680 | 65 | Comparative |
| 10 | D | 1225 | 894 | 3.91 | 0.59 | 1.09 | — | 39 | Example |
| 11 | D | 1244 | 925 | 2.87 | 0.49 | 1.03 | — | 68 | Example |
| 12 | E | 1224 | 932 | 2.93 | 0.21 | 1.21 | 600 | 31 | Example |
| 13 | F | 1232 | 964 | 1.26 | 0.38 | 1.16 | — | 44 | Example |
| 14 | F | 1241 | 886 | 2.31 | 0.45 | 1.13 | — | 63 | Example |
| 15 | F | 1244 | 931 | 2.35 | 0.33 | 0.88 | — | 59 | Comparative |
| 16 | G | 1231 | 928 | 2.58 | 0.31 | 1.14 | — | 45 | Example |
| 17 | G | 1221 | 948 | 3.40 | 0.45 | 1.21 | — | 78 | Example |
| 18 | H | 1268 | 887 | 2.23 | 0.34 | 1.08 | — | 77 | Example |
| 19 | I | 1218 | 889 | 2.42 | 0.16 | 1.12 | — | 35 | Example |
| 20 | I | 1241 | 929 | 3.41 | 0.27 | 1.15 | — | 57 | Example |
| 21 | J | 1229 | 972 | 3.49 | 0.35 | 1.11 | — | 41 | Example |
| 22 | K | 1220 | 951 | 2.25 | 0.49 | 1.09 | — | 74 | Example |
| 23 | K | 1268 | 964 | 1.41 | 0.41 | 1.15 | 540 | 54 | Example |
| 24 | L | 1222 | 943 | 2.34 | 0.38 | 1.13 | — | 75 | Example |
| 25 | L | 1239 | 902 | 1.67 | 0.42 | 1.32 | 630 | 49 | Example |
| 26 | M | 1259 | 879 | 2.42 | 0.87 | 1.10 | — | 47 | Example |
| 27 | M | 1255 | 880 | 1.70 | 0.75 | 1.18 | 595 | 56 | Example |
| 28 | N | 1203 | 892 | 2.35 | 0.49 | 1.18 | 580 | 65 | Example |
| 29 | N | 1268 | 947 | 3.21 | 0.54 | 1.05 | — | 65 | Example |
| 30 | O | 1248 | 882 | 3.20 | 0.88 | 1.15 | — | 69 | Example |
| 31 | O | 1237 | 970 | 3.33 | 0.93 | 1.03 | 450 | 61 | Example |
| 32 | O | 1255 | 901 | 2.24 | 1.45 | 1.18 | — | 36 | Comparative |
| 33 | P | 1262 | 968 | 2.27 | 0.81 | 1.13 | — | 35 | Example |
| 34 | P | 1268 | 953 | 1.46 | 0.57 | 1.13 | 390 | 36 | Example |

※A value with underline indicates that the value is out of the scope of the invention.

TABLE 4

| Hot-rolled steel sheet | Chemical component | Hot-rolling process: Heating temperature ° C. | Hot rolling completion temperature ° C. | Left side of Formula (A) | Left side of Formula (2) | Middle side of Formula (3) | Tempering temperature ° C. | Cold-rolling process Cold rolling ratio % | |
|---|---|---|---|---|---|---|---|---|---|
| 35 | Q | 1258 | 915 | 3.69 | 0.37 | 1.14 | — | 59 | Example |
| 36 | Q | 1266 | 911 | 3.98 | 0.42 | 1.41 | 660 | 57 | Example |
| 37 | R | 1272 | 916 | 1.47 | 0.41 | 1.21 | 550 | 58 | Example |
| 38 | R | 1244 | 926 | 1.21 | 0.65 | 1.14 | — | 45 | Example |
| 39 | S | 1217 | 970 | 3.67 | 0.36 | 1.08 | — | 41 | Example |
| 40 | S | 1270 | 964 | 1.58 | 0.43 | 1.45 | 670 | 47 | Example |
| 41 | T | 1231 | 948 | 3.99 | 0.29 | 1.20 | — | 31 | Example |
| 42 | T | 1231 | 948 | 1.63 | 0.29 | 1.24 | 670 | 60 | Example |
| 43 | T | 1231 | 948 | 2.61 | 0.29 | 1.55 | — | 68 | Comparative |
| 44 | U | 1221 | 894 | 2.68 | 0.24 | 1.15 | — | 41 | Example |
| 45 | V | 1253 | 891 | 2.94 | 0.48 | 1.18 | 600 | 44 | Example |
| 46 | V | 1255 | 887 | 2.69 | 0.80 | 1.14 | — | 73 | Example |
| 47 | V | 1222 | 908 | 2.07 | 1.06 | 1.16 | — | 67 | Comparative |
| 48 | W | 1222 | 917 | 3.05 | 0.83 | 1.21 | — | 39 | Example |
| 49 | X | 1235 | 963 | 1.12 | 0.64 | 1.25 | — | 64 | Example |
| 50 | Y | 1236 | 881 | 4.08 | 0.72 | 1.22 | — | 71 | Example |
| 51 | Y | 1260 | 972 | 2.04 | 0.53 | 1.08 | — | 54 | Example |
| 52 | Z | 1214 | 908 | 2.40 | 0.15 | 1.05 | — | 76 | Example |
| 53 | Z | 1228 | 928 | 1.51 | 0.30 | 1.19 | — | 45 | Example |
| 54 | AA | 1214 | 947 | 1.25 | 0.55 | 1.27 | — | 50 | Comparative |
| 55 | AB | 1222 | 952 | 3.16 | 0.77 | 1.10 | — | 50 | Comparative |
| 56 | AC | Test was terminated because a slab was cracked during casting process. | | | | | | | Comparative |
| 57 | AD | Test was terminated because a slab was cracked during casting process. | | | | | | | Comparative |
| 58 | AE | Test was terminated because a slab was cracked during casting process. | | | | | | | Comparative |
| 59 | AF | 1278 | 970 | 2.80 | 0.74 | 1.14 | — | 50 | Comparative |
| 60 | AG | Test was terminated because a slab was cracked during casting process. | | | | | | | Comparative |
| 61 | AH | 1256 | 959 | 2.73 | 0.34 | 1.12 | — | 50 | Comparative |
| 62 | AI | Test was terminated because a slab was cracked during casting process. | | | | | | | Comparative |

TABLE 4-continued

| Hot-rolled steel sheet | Chemical component | Hot-rolling process: Heating temperature ° C. | Hot rolling completion temperature ° C. | Left side of Formula (A) | Left side of Formula (2) | Middle side of Formula (3) | Tempering temperature ° C. | Cold-rolling process: Cold rolling ratio % | |
|---|---|---|---|---|---|---|---|---|---|
| 63 | AJ | 1238 | 926 | 2.47 | 0.36 | 1.14 | — | 50 | Comparative |
| 64 | AK | 1245 | 967 | 3.36 | 0.53 | 1.22 | — | 50 | Comparative |
| 65 | C | 1242 | 923 | 0.85 | 0.39 | 1.03 | — | 50 | Comparative |
| 66 | F | 1244 | 931 | 2.21 | 0.33 | 1.07 | — | 54 | Example |
| 67 | T | 1266 | 948 | 3.37 | 0.45 | 1.26 | — | 50 | Example |
| 68 | X | 1270 | 900 | 2.50 | 0.36 | 1.06 | — | 50 | Comparative |

※A value with underline indicates that the value is out of the scope of the invention.

The steel sheets shown in Tables 3 and 4 are subjected to the intermediate heat treatment under the conditions shown in Tables 5 to 7 and as required, subjected to the cold rolling to provide the steel sheets for heat treatment. In the intermediate heat treatment process, the "dwell time 2" in the cooling process means a dwell time in a range from 450 to 200 degrees C. When the cold rolling is performed, numerical values are indicated in the "cold rolling ratio" column in Tables 5 to 7. The microstructures of the obtained steel sheets for heat treatment are shown in Tables 8 to 10. Some steel sheets are divided and heat treated under a plurality of different conditions.

TABLE 5

| Steel sheet for heat treatment | Hot-rolled steel sheet | Chemical component | Intermediate heat treatment: Heating process: Average heating rate ° C./sec | Maximum heating temperature ° C. | Maximum heating temperature-Ac3° C. | Ac3 ° C. | Dwell time 1 sec | Cooling process: Average cooling rate ° C./sec | Dwell time 2 sec | Cold rolling: Cold rolling ratio % | |
|---|---|---|---|---|---|---|---|---|---|---|---|
| 1A | 1 | A | 93 | 825 | 29 | 796 | 10 | 50 | 52 | 0.2 | Example |
| 1B | 1 | A | 8 | 808 | 12 | 796 | 19 | 43 | 32 | — | Comparative |
| 2 | 2 | A | 39 | 784 | −12 | 796 | 16 | 47 | 124 | — | Example |
| 3 | 3 | A | 58 | 811 | 15 | 796 | 45 | 95 | 19 | — | Example |
| 4 | 4 | A | 86 | 846 | 50 | 796 | 15 | 42 | 39 | 1.7 | Example |
| 5 | 5 | B | 86 | 857 | 13 | 844 | 23 | 32 | 50 | 1.0 | Example |
| 6 | 6 | B | 89 | 891 | 47 | 844 | 17 | 42 | 282 | 0.5 | Comparative |
| 7A | 7 | C | 94 | 836 | 17 | 819 | 35 | 94 | 44 | — | Example |
| 7B | 7 | C | 86 | 838 | 19 | 819 | 149 | 42 | 136 | — | Comparative |
| 8 | 8 | C | 91 | 877 | 58 | 819 | 16 | 37 | 31 | 0.5 | Example |
| 9 | 9 | C | 86 | 823 | 4 | 819 | 46 | 49 | 55 | — | Comparative |
| 10 | 10 | D | 38 | 905 | 48 | 857 | 19 | 70 | 341 | — | Example |
| 11 | 11 | D | 58 | 903 | 46 | 857 | 36 | 40 | 39 | 0.2 | Example |
| 12 | 12 | E | 88 | 821 | 38 | 783 | 38 | 42 | 131 | 1.0 | Example |
| 13 | 13 | F | 90 | 854 | 42 | 812 | 8 | 43 | 36 | — | Example |
| 14A | 14 | F | 65 | 789 | −23 | 812 | 22 | 48 | 29 | — | Example |
| 14B | 14 | F | 89 | 759 | −53 | 812 | 54 | 42 | 60 | 0.7 | Comparative |
| 15 | 15 | F | 90 | 832 | 20 | 812 | 20 | 48 | 30 | 0.9 | Comparative |
| 16 | 16 | G | 95 | 793 | −4 | 797 | 46 | 42 | 26 | — | Example |
| 17 | 17 | G | 88 | 813 | 16 | 797 | 26 | 48 | 46 | — | Example |
| 18 | 18 | H | 91 | 868 | 31 | 837 | 12 | 46 | 31 | 1.4 | Example |
| 19A | 19 | I | 89 | 870 | 21 | 849 | 50 | 103 | 27 | 0.6 | Example |
| 19B | 19 | I | 67 | 864 | 15 | 849 | 163 | 46 | 42 | — | Comparative |
| 20 | 20 | I | 91 | 892 | 43 | 849 | 20 | 43 | 24 | — | Example |
| 21 | 21 | J | 87 | 838 | 31 | 807 | 38 | 49 | 13 | — | Example |
| 22 | 22 | K | 68 | 829 | 10 | 819 | 8 | 47 | 42 | — | Example |
| 23 | 23 | K | 85 | 859 | 40 | 819 | 22 | 50 | 8 | — | Example |

※value with underline indicates that the value is out of the scope of the invention

TABLE 6

| Steel sheet for heat treatment | Hot-rolled steel sheet | Chemical component | Intermediate heat treatment: Heating process: Average heating rate ° C./sec | Maximum heating temperature ° C. | Maximum heating temperature-Ac3 ° C. | Ac3 ° C. | Dwell time 1 sec | Cooling process: Average cooling rate ° C./sec | Dwell time 2 sec | Cold rolling: Cold rolling ratio % | |
|---|---|---|---|---|---|---|---|---|---|---|---|
| 24 | 24 | L | 95 | 861 | 37 | 824 | 82 | 43 | 61 | — | Example |
| 25 | 25 | L | 91 | 855 | 31 | 824 | 51 | 47 | 7 | 1.7 | Example |
| 26 | 26 | M | 93 | 945 | 46 | 899 | 48 | 41 | 21 | — | Example |
| 27 | 27 | M | 126 | 945 | 46 | 899 | 54 | 67 | 62 | 3.3 | Example |
| 28 | 28 | N | 63 | 869 | 13 | 856 | 8 | 128 | 28 | — | Example |
| 29 | 29 | N | 92 | 868 | 12 | 856 | 7 | 48 | 23 | 0.4 | Example |
| 30A | 30 | O | 89 | 913 | 26 | 887 | 12 | 39 | 29 | — | Example |
| 30B | 30 | O | 95 | 841 | −46 | 887 | 17 | 50 | 45 | — | Comparative |
| 31 | 31 | O | 94 | 924 | 37 | 887 | 13 | 40 | 46 | 0.7 | Example |
| 32 | 32 | O | 69 | 916 | 29 | 887 | 25 | 48 | 59 | 1.2 | Comparative |
| 33 | 33 | P | 95 | 918 | 25 | 893 | 10 | 31 | 241 | — | Example |
| 34 | 34 | P | 67 | 920 | 27 | 893 | 21 | 47 | 18 | — | Example |
| 35A | 35 | Q | 89 | 874 | 47 | 827 | 1 | 42 | 41 | 0.5 | Example |
| 35B | 35 | Q | 89 | 963 | 136 | 827 | 26 | 37 | 44 | — | Comparative |
| 36 | 36 | Q | 95 | 840 | 13 | 827 | 5 | 41 | 45 | — | Example |
| 37 | 37 | R | 33 | 869 | 48 | 821 | 10 | 75 | 124 | 0.9 | Example |
| 38 | 38 | R | 287 | 866 | 45 | 821 | 12 | 46 | 261 | 0.8 | Example |
| 39A | 39 | S | 87 | 853 | 41 | 812 | 15 | 33 | 32 | — | Example |
| 39B | 39 | S | 90 | 823 | 11 | 812 | 16 | 21 | 37 | — | Comparative |
| 40 | 40 | S | 56 | 861 | 49 | 812 | 14 | 50 | 46 | — | Example |
| 41A | 41 | T | 93 | 849 | 37 | 812 | 21 | 36 | 56 | — | Example |
| 41B | 41 | T | 90 | 836 | 24 | 812 | 22 | 18 | 36 | — | Comparative |
| 42 | 42 | T | 93 | 828 | 16 | 812 | 64 | 103 | 64 | 3.3 | Example |
| 43 | 43 | T | 92 | 854 | 42 | 812 | 44 | 76 | 219 | — | Comparative |
| 44 | 44 | U | 59 | 965 | 17 | 948 | 8 | 49 | 299 | — | Example |

X value with underline indicates that the value is out of the scope of the invention.

TABLE 7

| Steel sheet for heat treatment | Hot-rolled steel sheet | Chemical component | Intermediate heat treatment: Heating process: Average heating rate ° C./sec | Maximum heating temperature ° C. | Maximum heating temperature-Ac3 ° C. | Ac3 ° C. | Dwell time 1 sec | Cooling process: Average cooling rate ° C./sec | Dwell time 2 sec | Cold rolling: Cold rolling ratio % | |
|---|---|---|---|---|---|---|---|---|---|---|---|
| 45 | 45 | V | 69 | 892 | 22 | 870 | 23 | 40 | 44 | 0.1 | Example |
| 46A | 46 | V | 124 | 886 | 16 | 870 | 21 | 48 | 33 | — | Example |
| 46B | 46 | V | 23 | 896 | 26 | 870 | 51 | 30 | 29 | — | Comparative |
| 47 | 47 | V | 95 | 888 | 18 | 870 | 40 | 68 | 63 | 0.6 | Comparative |
| 48 | 48 | W | 57 | 881 | 49 | 832 | 2 | 42 | 65 | — | Example |
| 49 | 49 | X | 95 | 838 | 4 | 834 | 9 | 39 | 32 | — | Example |
| 50 | 50 | Y | 87 | 887 | 46 | 841 | 49 | 40 | 44 | — | Example |
| 51 | 51 | Y | 57 | 878 | 37 | 841 | 11 | 46 | 31 | 0.3 | Example |
| 52 | 52 | Z | 86 | 817 | 34 | 783 | 58 | 43 | 36 | — | Example |
| 53 | 53 | Z | 57 | 846 | 63 | 783 | 15 | 96 | 40 | — | Example |
| 54 | 54 | AA | 75 | 854 | 18 | 836 | 15 | 44 | 42 | — | Comparative |
| 55 | 55 | AB | 78 | 886 | 23 | 863 | 10 | 41 | 40 | 1.6 | Comparative |
| 56 | 56 | AC | Test was terminated because a slab was cracked during casting process. | | | | | | | | Comparative |
| 57 | 57 | AD | Test was terminated because a slab was cracked during casting process. | | | | | | | | Comparative |
| 58 | 58 | AE | Test was terminated because a slab was cracked during casting process. | | | | | | | | Comparative |
| 59 | 59 | AF | 90 | 863 | 18 | 845 | 16 | 35 | 36 | — | Comparative |
| 60 | 60 | AG | Test was terminated because a slab was cracked during casting process. | | | | | | | | Comparative |
| 61 | 61 | AH | 92 | 831 | 21 | 810 | 8 | 48 | 51 | — | Comparative |
| 62 | 62 | AI | Test was terminated because a slab was cracked during casting process. | | | | | | | | Comparative |
| 63 | 63 | AJ | 86 | 844 | 28 | 816 | 14 | 40 | 33 | 1.3 | Comparative |
| 64 | 64 | AK | 86 | 841 | 19 | 822 | 7 | 41 | 35 | 1.8 | Comparative |
| 65 | 65 | C | 35 | 868 | 49 | 819 | 23 | 47 | 70 | — | Comparative |
| 66 | 66 | F | 57 | 851 | 39 | 812 | 15 | 95 | 58 | 4.6 | Example |
| 67 | 67 | T | 42 | 817 | 5 | 812 | 21 | 40 | 36 | 7.3 | Example |
| 68 | 68 | X | 91 | 853 | 19 | 834 | 7 | 42 | 56 | 26.0 | Comparative |

X value with underline indicates that the value is out of the scope of the invention.

TABLE 8

| Steel sheet for heat treatment | Hot-rolled steel sheet | Chemical component | Steel sheet for heat treatment: Volume fraction (Sum of lath structure) Martensite % | Tempered martensite % | Bainite % | Bainitic ferrite % | Aggregated ferrite % | Residual austenite % | Other structure % | Carbide having equivalent circle diameter of 0.1 μm or more in lath structure: Density $10^{10}$ pieces/$m^2$ | Average size μm | |
|---|---|---|---|---|---|---|---|---|---|---|---|---|
| 1A | 1 | A | 0 | 56 | 22 | 9 | 87 | 11 | 2 | 0 | 2.9 | 0.41 | Example |
| 1B | 1 | A | 45 | 25 | 10 | 11 | 91 | 7 | 0 | 2 | 0.3 | 0.30 | Comparative |
| 2 | 2 | A | 0 | 41 | 33 | 7 | 81 | 16 | 3 | 0 | 2.3 | 0.36 | Example |
| 3 | 3 | A | 0 | 85 | 5 | 9 | 99 | 0 | 1 | 0 | 2.0 | 0.70 | Example |
| 4 | 4 | A | 4 | 51 | 28 | 7 | 90 | 10 | 0 | 0 | 3.4 | 0.33 | Example |
| 5 | 5 | B | 0 | 34 | 37 | 15 | 86 | 12 | 1 | 1 | 1.2 | 0.79 | Example |
| 6 | 6 | B | 3 | 20 | 40 | 20 | 83 | 14 | 2 | 1 | 0.5 | 0.28 | Comparative |
| 7A | 7 | C | 23 | 52 | 7 | 15 | 97 | 0 | 3 | 0 | 5.2 | 0.28 | Example |
| 7B | 7 | C | 41 | 9 | 13 | 28 | 91 | 4 | 5 | 0 | 0.2 | 0.18 | Comparative |
| 8 | 8 | C | 9 | 60 | 3 | 15 | 87 | 10 | 3 | 0 | 2.9 | 0.40 | Example |
| 9 | 9 | C | 0 | 70 | 3 | 21 | 94 | 3 | 3 | 0 | 0.2 | 1.31 | Comparative |
| 10 | 10 | D | 12 | 3 | 55 | 22 | 92 | 5 | 3 | 0 | 1.2 | 0.36 | Example |
| 11 | 11 | D | 5 | 34 | 16 | 32 | 87 | 12 | 1 | 0 | 1.5 | 0.23 | Example |
| 12 | 12 | E | 0 | 43 | 17 | 23 | 83 | 12 | 5 | 0 | 9.9 | 0.76 | Example |
| 13 | 13 | F | 0 | 70 | 14 | 4 | 88 | 11 | 0 | 1 | 5.7 | 0.41 | Example |
| 14A | 14 | F | 4 | 64 | 10 | 4 | 82 | 17 | 0 | 1 | 3.8 | 0.37 | Example |
| 14B | 14 | F | 3 | 22 | 12 | 4 | 41 | 51 | 4 | 4 | 2.3 | 0.38 | Comparative |
| 15 | 15 | F | 24 | 48 | 8 | 6 | 86 | 13 | 0 | 1 | 0.3 | 0.22 | Comparative |
| 16 | 16 | G | 7 | 60 | 18 | 0 | 85 | 15 | 0 | 0 | 2.2 | 0.29 | Example |
| 17 | 17 | G | 0 | 52 | 32 | 0 | 84 | 14 | 0 | 2 | 1.4 | 0.31 | Example |
| 18 | 18 | H | 0 | 83 | 5 | 6 | 94 | 6 | 0 | 0 | 4.0 | 0.48 | Example |
| 19A | 19 | I | 0 | 82 | 15 | 0 | 97 | 3 | 0 | 0 | 12.4 | 0.23 | Example |
| 19B | 19 | I | 38 | 38 | 11 | 0 | 87 | 12 | 1 | 0 | 0.2 | 0.19 | Comparative |
| 20 | 20 | I | 0 | 81 | 4 | 0 | 85 | 14 | 1 | 0 | 8.9 | 0.35 | Example |
| 21 | 21 | J | 12 | 61 | 9 | 1 | 83 | 16 | 1 | 0 | 3.0 | 0.25 | Example |
| 22 | 22 | K | 13 | 37 | 22 | 12 | 84 | 13 | 1 | 2 | 4.0 | 0.44 | Example |
| 23 | 23 | K | 0 | 72 | 7 | 5 | 84 | 15 | 1 | 0 | 3.5 | 0.60 | Example |

※value with underline indicates that the value is out of the scope of the invention.

TABLE 9

| Steel sheet for heat treatment | Hot-rolled steel sheet | Chemical component | Steel sheet for heat treatment Volume fraction: Martensite % | Tempered martensite % | Bainite % | Bainitic ferrite % | (Sum of lath structure) % | Aggregated ferrite % | Residual austenite % |
|---|---|---|---|---|---|---|---|---|---|
| 24 | 24 | L | 23 | 34 | 18 | 17 | 92 | 8 | 0 |
| 25 | 25 | L | 0 | 88 | 2 | 3 | 93 | 7 | 0 |
| 26 | 26 | M | 5 | 48 | 0 | 38 | 91 | 8 | 1 |
| 27 | 27 | M | 0 | 52 | 0 | 44 | 96 | 2 | 2 |
| 28 | 28 | N | 0 | 70 | 6 | 23 | 99 | 0 | 0 |
| 29 | 29 | N | 8 | 60 | 4 | 23 | 95 | 2 | 3 |
| 30A | 30 | O | 0 | 50 | 0 | 43 | 93 | 7 | 0 |
| 30B | 30 | O | 0 | 32 | 0 | 34 | 66 | 34 | 0 |
| 31 | 31 | O | 0 | 42 | 0 | 48 | 90 | 8 | 0 |
| 32 | 32 | O | 26 | 14 | 0 | 52 | 92 | 8 | 0 |
| 33 | 33 | P | 2 | 25 | 4 | 57 | 88 | 6 | 6 |
| 34 | 34 | P | 0 | 55 | 2 | 33 | 90 | 9 | 1 |
| 35A | 35 | Q | 0 | 74 | 3 | 16 | 93 | 4 | 1 |
| 35B | 35 | Q | 21 | 40 | 6 | 25 | 92 | 5 | 3 |
| 36 | 36 | Q | 0 | 66 | 5 | 17 | 88 | 7 | 5 |
| 37 | 37 | R | 0 | 37 | 24 | 36 | 97 | 1 | 2 |
| 38 | 38 | R | 0 | 35 | 32 | 23 | 90 | 5 | 5 |
| 39A | 39 | S | 0 | 57 | 8 | 18 | 83 | 14 | 3 |
| 39B | 39 | S | 0 | 56 | 2 | 11 | 69 | 28 | 2 |
| 40 | 40 | S | 0 | 63 | 8 | 21 | 92 | 7 | 1 |
| 41A | 41 | T | 0 | 57 | 22 | 2 | 81 | 19 | 0 |
| 41B | 41 | T | 0 | 51 | 14 | 0 | 65 | 33 | 0 |
| 42 | 42 | T | 0 | 64 | 28 | 3 | 95 | 4 | 0 |

TABLE 9-continued

| | | | | | | | | | |
|---|---|---|---|---|---|---|---|---|---|
| 43 | 43 | T | 0 | 36 | 49 | 3 | 88 | 7 | 4 |
| 44 | 44 | U | 13 | 36 | 32 | 8 | 89 | 7 | 4 |

| Steel sheet for heat treatment | | | | |
|---|---|---|---|---|
| Steel sheet for heat treatment | Volume fraction Other structure % | Carbide having equivalent circle diameter of 0.1 μm or more in lath structure: Density $10^{10}$ pieces/$m^2$ | Carbide having equivalent circle diameter of 0.1 μm or more in lath structure: Average size μm | |
| 24 | 0 | 4.3 | 0.38 | Example |
| 25 | 0 | 2.3 | 0.73 | Example |
| 26 | 0 | 1.9 | 0.31 | Example |
| 27 | 0 | 1.2 | 0.43 | Example |
| 28 | 1 | 5.1 | 0.78 | Example |
| 29 | 0 | 5.0 | 0.37 | Example |
| 30A | 0 | 1.2 | 0.39 | Example |
| 30B | 0 | 1.6 | 0.34 | Comparative |
| 31 | 2 | 1.1 | 0.50 | Example |
| 32 | 0 | 0.6 | 0.31 | Comparative |
| 33 | 0 | 1.6 | 0.31 | Example |
| 34 | 0 | 2.9 | 0.35 | Example |
| 35A | 2 | 8.2 | 0.55 | Example |
| 35B | 0 | 0.0 | — | Comparative |
| 36 | 0 | 4.3 | 0.67 | Example |
| 37 | 0 | 4.5 | 0.59 | Example |
| 38 | 0 | 4.6 | 0.36 | Example |
| 39A | 0 | 6.3 | 0.49 | Example |
| 39B | 1 | 6.1 | 0.40 | Comparative |
| 40 | 0 | 1.5 | 0.93 | Example |
| 41A | 0 | 3.4 | 0.33 | Example |
| 41B | 2 | 3.5 | 0.35 | Comparative |
| 42 | 1 | 1.2 | 0.51 | Example |
| 43 | 1 | 0.1 | 1.23 | Comparative |
| 44 | 0 | 10.7 | 0.39 | Example |

※A value with underline indicates that the value is out of the scope of the invention.

TABLE 10

| | | | Steel sheet for heat treatment Volume fraction | | | | | | |
|---|---|---|---|---|---|---|---|---|---|
| Steel sheet for heat treatment | Hot-rolled steel sheet | Chemical component | Martensite % | Tempered martensite % | Bainite % | Bainitic ferrite % | (Sum of lath structure) % | Aggregated ferrite % | Residual austenite % |
| 45 | 45 | V | 0 | 45 | 4 | 43 | 92 | 7 | 0 |
| 46A | 46 | V | 4 | 53 | 3 | 29 | 89 | 8 | 3 |
| 46B | 46 | V | 20 | 33 | 3 | 30 | 86 | 12 | 0 |
| 47 | 47 | V | 21 | 37 | 3 | 32 | 93 | 3 | 4 |
| 48 | 48 | W | 0 | 28 | 50 | 6 | 84 | 15 | 1 |
| 49 | 49 | X | 13 | 51 | 11 | 13 | 88 | 10 | 0 |
| 50 | 50 | Y | 3 | 35 | 35 | 13 | 86 | 12 | 1 |
| 51 | 51 | Y | 0 | 47 | 21 | 23 | 91 | 9 | 0 |
| 52 | 52 | Z | 0 | 81 | 5 | 4 | 90 | 9 | 1 |
| 53 | 53 | Z | 16 | 68 | 7 | 3 | 94 | 4 | 2 |
| 54 | 54 | AA | 2 | 34 | 28 | 17 | 81 | 17 | 2 |
| 55 | 55 | AB | 0 | 11 | 35 | 18 | 64 | 36 | 0 |
| 56 | 56 | AC | Test was terminated because a slab was cracked during casting process. | | | | | | |
| 57 | 57 | AD | Test was terminated because a slab was cracked during casting process. | | | | | | |
| 58 | 58 | AE | Test was terminated because a slab was cracked during casting process. | | | | | | |
| 59 | 59 | AF | 6 | 0 | 17 | 35 | 58 | 42 | 0 |
| 60 | 60 | AG | Test was terminated because a slab was cracked during casting process. | | | | | | |
| 61 | 61 | AH | 4 | 54 | 13 | 18 | 89 | 6 | 3 |
| 62 | 62 | AI | Test was terminated because a slab was cracked during casting process. | | | | | | |
| 63 | 63 | AJ | 0 | 54 | 12 | 22 | 88 | 8 | 2 |
| 64 | 64 | AK | 8 | 55 | 15 | 12 | 90 | 9 | 0 |
| 65 | 65 | C | 14 | 57 | 6 | 17 | 94 | 1 | 4 |
| 66 | 66 | F | 0 | 66 | 17 | 11 | 94 | 3 | 3 |
| 67 | 67 | T | 5 | 57 | 22 | 1 | 85 | 13 | 1 |
| 68 | 68 | X | 0 | 0 | 0 | 0 | 0 | 0 | 3 |

TABLE 10-continued

| Steel sheet for heat treatment | | | | |
|---|---|---|---|---|
| Steel sheet for heat treatment | Volume fraction Other structure % | Carbide having equivalent circle diameter of 0.1 μm or more in lath structure: Density $10^{10}$ pieces/$m^2$ | Carbide having equivalent circle diameter of 0.1 μm or more in lath structure: Average size μm | |
| 45 | 1 | 2.0 | 0.74 | Example |
| 46A | 0 | 3.4 | 0.43 | Example |
| 46B | 2 | 0.4 | 0.28 | Comparative |
| 47 | 0 | 0.8 | 0.39 | Comparative |
| 48 | 0 | 1.1 | 0.47 | Example |
| 49 | 2 | 2.6 | 0.36 | Example |
| 50 | 1 | 1.2 | 0.22 | Example |
| 51 | 0 | 1.6 | 0.29 | Example |
| 52 | 0 | 18.2 | 0.33 | Example |
| 53 | 0 | 8.2 | 0.44 | Example |
| 54 | 0 | 0.5 | 0.30 | Comparative |
| 55 | 0 | 0.0 | 0.35 | Comparative |
| 56 | Test was terminated because a slab was cracked during casting process. | | | Comparative |
| 57 | Test was terminated because a slab was cracked during casting process. | | | Comparative |
| 58 | Test was terminated because a slab was cracked during casting process. | | | Comparative |
| 59 | 0 | 1.7 | 0.33 | Comparative |
| 60 | Test was terminated because a slab was cracked during casting process. | | | Comparative |
| 61 | 2 | 7.4 | 0.40 | Comparative |
| 62 | Test was terminated because a slab was cracked during casting process. | | | Comparative |
| 63 | 2 | 4.1 | 0.34 | Comparative |
| 64 | 1 | 4.4 | 0.35 | Comparative |
| 65 | 1 | 0.7 | 0.36 | Comparative |
| 66 | 0 | 3.4 | 0.61 | Example |
| 67 | 1 | 1.4 | 0.42 | Example |
| 68 | 97 | 4.8 | 0.35 | Comparative |

※A value with underline indicates that the value is out of the scope of the invention.

Examples: Manufacture of High-Strength Steel Sheet

Steel sheets for heat treatment shown in Tables 8 to 10 are subjected to the main heat treatment under the conditions shown in Tables 11 to 14, and as required, are subjected to the skin pass and/or the heat treatment (tempering). For reference, the average heating rate in a range from 450 to 650 degrees C. in the heat treatment is indicated as an "average heating rate 1" and the average heating rate in a range from 650 to 750 degrees C. in the heat treatment is indicated as an "average heating rate 2" in Tables. The retention time at the steel sheet heating temperature (maximum heating temperature) is indicated as a "dwell time 1" in Tables. In the cooling process, the average cooling rate in the temperature region of 700 degrees C. to 550 degrees C. is indicated as an "average cooling rate" and the temperature at which cooling is stopped and starts to dwell is indicated as a "cooling stop temperature", and the dwell time in is indicated as a "dwell time 2" in Tables. When the skin pass rolling is performed, numerical values are indicated in the "skin pass rolling ratio" column in Tables 11 to 14. When the tempering heat treatment is performed, numerical values are indicated in the "tempering treatment" column in Tables 11 and 14.

Some of the steel sheets for heat treatment are subjected to the plating treatment under conditions shown in Table 15 in addition to the main heat treatment shown in Tables 11 to 14. In the "Surface" column of Table 15, EG means electroplating, GI means hot-dip plating (forming a galvanized layer), and GA means hot-dip plating (forming a zinc alloy plated layer).

TABLE 11

| | | | | Main heat treatment Heating process | | | | | | | | | |
|---|---|---|---|---|---|---|---|---|---|---|---|---|---|
| Example | Steel sheet for heat treatment | Hot-rolled steel sheet | Chemical component | Average heating rate 1 ° C./sec | Formula (B) | Average heating rate 2 ° C./sec | Middle side of Formula (C) | Maximum heating temperature ° C. | Maximum heating temperature-Ac1 ° C. | Ac1 ° C. | Ac3-Maximum heating temperature ° C. | Ac3 ° C. | Dwell time 1 sec |
| 1 | 1A | 1 | A | 9 | 2.61 | 4 | 1.22 | 765 | 68 | 697 | 31 | 796 | 73 |
| 2 | 1A | 1 | A | 64 | 1.92 | 3 | 1.64 | 772 | 75 | 697 | 24 | 796 | 40 |
| 3 | 1A | 1 | A | 9 | 2.79 | 3 | 1.41 | 757 | 60 | 697 | 39 | 796 | 70 |
| 4 | 1A | 1 | A | 0.3 | 3.70 | 2 | 1.07 | 756 | 59 | 697 | 40 | 796 | 43 |
| 5 | 1B | 1 | A | 9 | 2.38 | 1 | 2.27 | 758 | 61 | 697 | 38 | 796 | 70 |
| 6 | 2 | 2 | A | 6 | 2.58 | 2 | 1.73 | 764 | 67 | 697 | 32 | 796 | 45 |
| 7 | 2 | 2 | A | 9 | 2.38 | 3 | 1.48 | 762 | 65 | 697 | 34 | 796 | 71 |
| 8 | 3 | 3 | A | 8 | 2.84 | 3 | 1.33 | 752 | 55 | 697 | 44 | 796 | 12 |
| 9 | 3 | 3 | A | 67 | 2.17 | 2 | 1.89 | 770 | 73 | 697 | 26 | 796 | 45 |

TABLE 11-continued

| | | | | | | | | | | | | | |
|---|---|---|---|---|---|---|---|---|---|---|---|---|---|
| 10 | 4 | 4 | A | 89 | 1.81 | 3 | 1.92 | 767 | 70 | 697 | 29 | 796 | 17 |
| 11 | 4 | 4 | A | 8 | 2.55 | 3 | 1.49 | 754 | 57 | 697 | 42 | 796 | 42 |
| 12 | 5 | 5 | B | 68 | 1.76 | 3 | 1.88 | 795 | 76 | 719 | 49 | 844 | 68 |
| 13 | 6 | 6 | B | 14 | 2.08 | 1 | 3.54 | 821 | 102 | 719 | 23 | 844 | 12 |
| 14 | 7A | 7 | C | 13 | 2.21 | 1 | 1.98 | 803 | 90 | 713 | 16 | 819 | 72 |
| 15 | 7B | 7 | C | 5 | 2.39 | 2 | 1.26 | 777 | 64 | 713 | 42 | 819 | 44 |
| 16 | 8 | 8 | C | 6 | 2.52 | 3 | 1.03 | 776 | 63 | 713 | 43 | 819 | 40 |
| 17 | 8 | 8 | C | 62 | 1.70 | 1 | 2.53 | 716 | 3 | 713 | 103 | 819 | 68 |
| 18 | 9 | 9 | C | 60 | 2.19 | 3 | 1.28 | 769 | 56 | 713 | 50 | 819 | 15 |
| 19 | 10 | 10 | D | 12 | 2.20 | 1 | 3.20 | 823 | 105 | 718 | 34 | 857 | 73 |
| 20 | 11 | 11 | D | 9 | 2.22 | 3 | 1.73 | 798 | 80 | 718 | 59 | 857 | 16 |
| 21 | 11 | 11 | D | 12 | 2.17 | 4 | 1.45 | 812 | 94 | 718 | 45 | 857 | 15 |
| 22 | 12 | 12 | E | 8 | 2.44 | 3 | 1.62 | 761 | 41 | 720 | 22 | 783 | 133 |
| 23 | 13 | 13 | F | 4 | 2.64 | 3 | 1.28 | 768 | 56 | 712 | 44 | 812 | 15 |
| 24 | 14A | 14 | F | 7 | 2.47 | 4 | 1.22 | 778 | 66 | 712 | 34 | 812 | 71 |
| 25 | 14B | 14 | F | 4 | 2.79 | 5 | 1.06 | 771 | 59 | 712 | 41 | 812 | 71 |
| 26 | 15 | 15 | F | 6 | 2.34 | 4 | 1.29 | 768 | 56 | 712 | 44 | 812 | 41 |

| | Main heat treatment Cooling process | | | | | Tempering treatment | | | |
|---|---|---|---|---|---|---|---|---|---|
| Example | Average cooling rate ° C./sec | Stop cooling temperature ° C. | Dwell time 2 sec | Left-side of Formula (4) | Skin pass rolling rate % | Treatment temperature ° C. | Treatment time sec | Rolling reduction after treatment % | |
| 1 | 65 | 400 | 124 | 0.45 | 0.7 | — | — | — | Example |
| 2 | 62 | 450 | 28 | 0.96 | 0.4 | — | — | — | Example |
| 3 | 3 | 438 | 41 | 0.87 | 0.2 | — | — | — | Comparative |
| 4 | 61 | 400 | 402 | 0.26 | 0.4 | — | — | — | Comparative |
| 5 | 97 | 458 | 146 | 0.47 | 0.4 | — | — | — | Comparative |
| 6 | 33 | 448 | 225 | 0.55 | 0.1 | — | — | — | Example |
| 7 | 62 | 468 | 397 | 0.34 | 0.3 | 539 | 10 | 0.2 | Example |
| 8 | 28 | 416 | 40 | 0.71 | 0.5 | — | — | — | Example |
| 9 | 32 | 430 | 474 | 0.24 | 0.1 | 240 | 45940 | 0.3 | Example |
| 10 | 30 | 444 | 298 | 0.32 | — | — | — | — | Example |
| 11 | 33 | 449 | 128 | 0.63 | 1.8 | — | — | — | Example |
| 12 | 31 | 392 | 76 | 0.18 | 0.5 | — | — | — | Example |
| 13 | 33 | 484 | 155 | 0.18 | 0.3 | — | — | — | Comparative |
| 14 | 59 | 449 | 248 | 0.39 | 0.2 | — | — | — | Example |
| 15 | 27 | 493 | 136 | 0.68 | 0.3 | — | — | — | Comparative |
| 16 | 32 | 411 | 39 | 0.90 | 0.5 | — | — | — | Example |
| 17 | 29 | 379 | 122 | 0.43 | 0.3 | — | — | — | Comparative |
| 18 | 35 | 481 | 32 | 0.88 | 0.6 | — | — | — | Comparative |
| 19 | 59 | 392 | 34 | 0.19 | 1.7 | — | — | — | Example |
| 20 | 35 | 526 | 62 | 0.14 | — | — | — | — | Example |
| 21 | 37 | 400 | 795 | 0.04 | 0.1 | — | — | — | Example |
| 22 | 93 | 506 | 350 | 0.09 | 0.4 | — | — | — | Example |
| 23 | 35 | 497 | 165 | 0.22 | 0.5 | 294 | 149 | — | Example |
| 24 | 34 | 385 | 166 | 0.19 | 0.4 | — | — | — | Example |
| 25 | 88 | 452 | 46 | 0.37 | 0.5 | — | — | — | Comparative |
| 26 | 97 | 324 | 140 | 0.20 | 0.1 | — | — | — | Comparative |

X A value with underline indicates that the value is out of the scope of the invention.

TABLE 12

| | | | | Main heat treatment Heating process | | | | | | | | | |
|---|---|---|---|---|---|---|---|---|---|---|---|---|---|
| Example | Steel sheet for heat treatment | Hot-rolled steel sheet | Chemical component | Average heating rate 1 ° C./sec | Formula (B) | Average heating rate 2 ° C./sec | Middle side of Formula (C) | Maximum heating temperature ° C. | Maximum heating temperature-Ac1 ° C. | Ac1 ° C. | Ac3-Maximum heating temperature ° C. | Ac3 ° C. | Dwell time 1 sec |
| 27 | 16 | 16 | G | 97 | 2.11 | 0.8 | 3.12 | 761 | 46 | 715 | 36 | 797 | 101 |
| 28 | 17 | 17 | G | 7 | 3.11 | 3 | 1.04 | 766 | 51 | 715 | 31 | 797 | 13 |
| 29 | 17 | 17 | G | 12 | 2.69 | 1 | 1.95 | 766 | 51 | 715 | 31 | 797 | 40 |
| 30 | 18 | 18 | H | 4 | 2.52 | 0.4 | 2.67 | 765 | 76 | 689 | 72 | 837 | 14 |
| 31 | 18 | 18 | H | 34 | 2.10 | 3 | 1.22 | 796 | 107 | 689 | 41 | 837 | 72 |
| 32 | 19A | 19 | I | 93 | 1.85 | 9 | 1.17 | 809 | 104 | 705 | 40 | 849 | 100 |
| 33 | 19B | 19 | I | 12 | 2.59 | 4 | 1.26 | 754 | 49 | 705 | 95 | 849 | 98 |
| 34 | 20 | 20 | I | 70 | 2.09 | 6 | 1.18 | 769 | 64 | 705 | 80 | 849 | 69 |
| 35 | 20 | 20 | I | 5 | 2.92 | 2 | 1.49 | 792 | 87 | 705 | 57 | 849 | 16 |
| 36 | 21 | 21 | J | 37 | 2.13 | 8 | 1.27 | 785 | 81 | 704 | 22 | 807 | 4 |

TABLE 12-continued

| | | | | | | | | | | | | | |
|---|---|---|---|---|---|---|---|---|---|---|---|---|---|
| 37 | 22 | 22 | K | 92 | 1.54 | 7 | 1.66 | 788 | 62 | 726 | 31 | 819 | 96 |
| 38 | 23 | 23 | K | 96 | 1.91 | 4 | 2.15 | 811 | 85 | 726 | 8 | 819 | 101 |
| 39 | 23 | 23 | K | 5 | 2.43 | 4 | 1.24 | 796 | 70 | 726 | 23 | 819 | 16 |
| 40 | 24 | 24 | L | 14 | 2.29 | 2 | 1.80 | 777 | 57 | 720 | 47 | 824 | 68 |
| 41 | 25 | 25 | L | 7 | 2.67 | 2 | 1.69 | 768 | 48 | 720 | 56 | 824 | 73 |
| 42 | 25 | 25 | L | 36 | 2.11 | 7 | 1.34 | 777 | 57 | 720 | 47 | 824 | 16 |
| 43 | 26 | 26 | M | 8 | 2.50 | 9 | 1.24 | 820 | 66 | 754 | 79 | 899 | 44 |
| 44 | 27 | 27 | M | 13 | 2.19 | 4 | 1.91 | 868 | 114 | 754 | 31 | 899 | 13 |
| 46 | 28 | 28 | N | 4 | 2.80 | 7 | 1.18 | 815 | 54 | 761 | 41 | 856 | 70 |
| 47 | 29 | 29 | N | 11 | 2.24 | 0.6 | 4.83 | 812 | 51 | 761 | 44 | 856 | 41 |
| 49 | 30A | 30 | O | 4 | 2.70 | 3 | 2.00 | 837 | 123 | 714 | 50 | 887 | 7 |
| 50 | 30B | 30 | O | 4 | 2.44 | 3 | 1.17 | 814 | 100 | 714 | 73 | 887 | 14 |
| 51 | 31 | 31 | O | 61 | 1.69 | 1 | 2.65 | 791 | 77 | 714 | 96 | 887 | 17 |
| 52 | 32 | 32 | O | 70 | 1.65 | 2 | 3.25 | 830 | 116 | 714 | 57 | 887 | 42 |

| | Main heat treatment Cooling process | | | | | Tempering treatment | | | |
|---|---|---|---|---|---|---|---|---|---|
| Example | Average cooling rate ° C./sec | Stop cooling temperature ° C. | Dwell time 2 sec | Left side of Formula (4) | Skin pass rolling rate % | Treatment temperature ° C. | Treatment time sec | Rolling reduction after treatment % | |
| 27 | 35 | 485 | 420 | 0.93 | 0.7 | — | — | — | Example |
| 28 | 87 | 334 | 329 | 0.95 | 0.1 | — | — | — | Example |
| 29 | 34 | 366 | 418 | 0.98 | 1.0 | — | — | — | Example |
| 30 | 36 | 355 | 356 | 0.58 | 0.5 | — | — | — | Example |
| 31 | 18 | 390 | 429 | 0.53 | 0.2 | — | — | — | Example |
| 32 | 37 | 379 | 461 | 0.26 | 0.4 | 459 | 13 | — | Example |
| 33 | 37 | 421 | 35 | 0.92 | 0.3 | — | — | — | Comparative |
| 34 | 30 | 487 | 283 | 0.39 | 0.3 | — | — | — | Example |
| 35 | 32 | 399 | 31 | 0.93 | 0.1 | — | — | — | Example |
| 36 | 28 | 488 | 21 | 0.76 | 0.5 | — | — | — | Example |
| 37 | 87 | 435 | 294 | 0.11 | 0.4 | — | — | — | Example |
| 38 | 97 | 406 | 87 | 0.23 | 0.1 | — | — | — | Example |
| 39 | 63 | 396 | 1318 | 0.05 | 0.4 | — | — | — | Comparative |
| 40 | 29 | 376 | 139 | 0.14 | 1.3 | — | — | — | Example |
| 41 | 31 | 381 | 37 | 0.26 | — | — | — | — | Example |
| 42 | 31 | 452 | 28 | 0.33 | 0.9 | — | — | — | Example |
| 43 | 96 | 388 | 178 | 0.05 | 1.5 | 284 | 7198 | 0.3 | Example |
| 44 | 13 | 394 | 31 | 0.13 | 0.5 | — | — | — | Example |
| 46 | 67 | 478 | 291 | 0.03 | 0.2 | — | — | — | Example |
| 47 | 32 | 413 | 40 | 0.09 | 0.5 | — | — | — | Example |
| 49 | 60 | 348 | 120 | 0.10 | 1.1 | — | — | — | Example |
| 50 | 37 | 377 | 136 | 0.11 | 0.2 | — | — | — | Comparative |
| 51 | 35 | 450 | 536 | 0.05 | 0.3 | — | — | — | Example |
| 52 | 32 | 443 | 228 | 0.07 | 0.3 | — | — | — | Comparative |

TABLE 13

| | | | | Main heat treatment Heating process | | | | | | | | | |
|---|---|---|---|---|---|---|---|---|---|---|---|---|---|
| Example | Steel sheet for heat treatment | Hot-rolled steel sheet | Chemical component | Average heating rate 1 ° C./sec | Formula (B) | Average heating rate 2 ° C./sec | Middle side of Formula (C) | Maximum heating temperature ° C. | Maximum heating temperature-Ac1 ° C. | Ac1 ° C. | Ac3-Maximum heating temperature ° C. | Ac3 ° C. | Dwell time 1 sec |
| 53 | 33 | 33 | P | 60 | 1.78 | 8 | 1.47 | 819 | 78 | 741 | 74 | 893 | 13 |
| 54 | 34 | 34 | P | 12 | 2.26 | 3 | 1.75 | 857 | 116 | 741 | 36 | 893 | 142 |
| 55 | 34 | 34 | P | 14 | 2.32 | 4 | 1.61 | 901 | 160 | 741 | −8 | 893 | 100 |
| 56 | 35A | 35 | Q | 5 | 2.80 | 3 | 1.46 | 783 | 46 | 737 | 44 | 827 | 72 |
| 57 | 35B | 35 | Q | 32 | 2.09 | 3 | 1.89 | 785 | 48 | 737 | 42 | 827 | 17 |
| 58 | 36 | 36 | Q | 6 | 2.32 | 2 | 2.01 | 795 | 58 | 737 | 32 | 827 | 15 |
| 59 | 37 | 37 | R | 10 | 2.31 | 3 | 1.69 | 798 | 60 | 738 | 23 | 821 | 13 |
| 60 | 38 | 38 | R | 68 | 1.60 | 2 | 1.81 | 787 | 49 | 738 | 34 | 821 | 100 |
| 61 | 38 | 38 | R | 65 | 1.82 | 4 | 1.89 | 787 | 49 | 738 | 34 | 821 | 73 |
| 62 | 39A | 39 | S | 213 | 1.27 | 3 | 2.17 | 776 | 69 | 707 | 36 | 812 | 15 |
| 63 | 39B | 39 | S | 12 | 2.22 | 3 | 1.47 | 752 | 45 | 707 | 60 | 812 | 13 |
| 64 | 40 | 40 | S | 66 | 1.98 | 2 | 1.80 | 790 | 83 | 707 | 22 | 812 | 71 |
| 65 | 40 | 40 | S | 8 | 2.47 | 3 | 1.14 | 789 | 82 | 707 | 23 | 812 | 516 |
| 66 | 41A | 41 | T | 36 | 2.10 | 1 | 2.14 | 780 | 82 | 698 | 32 | 812 | 15 |
| 67 | 41B | 41 | T | 32 | 2.20 | 3 | 1.45 | 752 | 54 | 698 | 60 | 812 | 17 |
| 68 | 42 | 42 | T | 60 | 2.21 | 3 | 1.46 | 782 | 84 | 698 | 30 | 812 | 70 |

TABLE 13-continued

| | | | | | | | | | | | | | |
|---|---|---|---|---|---|---|---|---|---|---|---|---|---|
| 69 | 43 | 43 | T | 15 | 2.89 | 3 | 1.30 | 764 | 66 | 698 | 48 | 812 | 40 |
| 70 | 44 | 44 | U | 94 | 1.79 | 8 | 1.66 | 921 | 178 | 743 | 27 | 948 | 117 |
| 71 | 45 | 45 | V | 13 | 2.35 | 5 | 1.48 | 813 | 57 | 756 | 57 | 870 | 45 |
| 72 | 46A | 46 | V | 5 | 2.33 | 0.7 | 3.61 | 838 | 82 | 756 | 32 | 870 | 12 |
| 73 | 46B | 46 | V | 6 | 2.29 | 3 | 1.73 | 815 | 59 | 756 | 55 | 870 | 16 |
| 74 | 47 | 47 | V | 9 | 2.33 | 3 | 1.86 | 817 | 61 | 756 | 53 | 870 | 45 |
| 75 | 48 | 48 | W | 40 | 2.02 | 7 | 1.49 | 762 | 50 | 712 | 70 | 832 | 40 |
| 76 | 49 | 49 | X | 4 | 2.70 | 3 | 1.26 | 800 | 90 | 710 | 34 | 834 | 69 |
| 77 | 50 | 50 | Y | 14 | 2.40 | 7 | 1.46 | 829 | 123 | 706 | 12 | 841 | 101 |
| 78 | 51 | 51 | Y | 70 | 1.81 | 3 | 1.86 | 802 | 96 | 706 | 39 | 841 | 45 |

| | Main heat treatment Cooling process | | | | | Tempering treatment | | | |
|---|---|---|---|---|---|---|---|---|---|
| Example | Average cooling rate ° C./sec | Stop cooling temperature ° C. | Dwell time 2 sec | Left side of Formula (4) | Skin pass rolling rate % | Treatment temperature ° C. | Treatment time sec | Rolling reduction after treatment % | |
| 53 | 60 | 362 | 411 | 0.04 | 1.0 | 328 | 9 | 0.6 | Example |
| 54 | 89 | 435 | 392 | 0.05 | 0.1 | — | — | — | Example |
| 55 | 35 | 401 | 40 | 0.15 | 0.3 | — | — | — | Comparative |
| 56 | 33 | 425 | 62 | 0.17 | 0.4 | — | — | — | Example |
| 57 | 27 | 384 | 21 | 0.26 | 0.2 | — | — | — | Comparative |
| 58 | 34 | 478 | 396 | 0.06 | 0.2 | — | — | — | Example |
| 59 | 32 | 460 | 137 | 0.10 | 0.5 | — | — | — | Example |
| 60 | 62 | 498 | 141 | 0.12 | 0.2 | 218 | 233 | 0.2 | Example |
| 61 | 28 | 401 | 5 | 0.71 | 0.5 | — | — | — | Example |
| 62 | 36 | 451 | 44 | 0.46 | — | 251 | 18 | 0.4 | Example |
| 63 | 34 | 466 | 126 | 0.27 | 0.3 | — | — | — | Comparative |
| 64 | 87 | 441 | 50 | 0.42 | 0.5 | — | — | — | Example |
| 65 | 33 | 480 | 67 | 0.41 | 0.3 | — | — | — | Comparative |
| 66 | 67 | 529 | 41 | 0.98 | 0.5 | — | — | — | Example |
| 67 | 30 | 451 | 58 | 0.81 | 1.6 | — | — | — | Comparative |
| 68 | 27 | 434 | 138 | 0.56 | 1.6 | — | — | — | Example |
| 69 | 27 | 444 | 164 | 0.60 | 0.3 | — | — | — | Comparative |
| 70 | 36 | 541 | 316 | 0.08 | 0.4 | — | — | — | Example |
| 71 | 31 | 545 | 50 | 0.12 | 0.1 | — | — | — | Example |
| 72 | 27 | 459 | 174 | 0.05 | 0.1 | — | — | — | Example |
| 73 | 94 | 420 | 245 | 0.05 | 0.2 | — | — | — | Comparative |
| 74 | 32 | 494 | 242 | 0.06 | 0.5 | — | — | — | Comparative |
| 75 | 32 | 446 | 167 | 0.21 | 0.3 | — | — | — | Example |
| 76 | 31 | 368 | 167 | 0.14 | 0.2 | 517 | 26 | — | Example |
| 77 | 28 | 373 | 59 | 0.33 | 0.4 | — | — | — | Example |
| 78 | 30 | 321 | 66 | 0.34 | — | 493 | 27 | 0.3 | Example |

※A value with underline indicates that the value is out the scope of the invention.

TABLE 14

| | | | | Main heat treatment | | | | | | | | | |
|---|---|---|---|---|---|---|---|---|---|---|---|---|---|
| | | | | | | | | Heating process | | | | | |
| Example | Steel sheet for heat treatment | Hot-rolled steel sheet | Chemical component | Average heating rate 1 ° C./sec | Formula (B) | Average heating rate 2 ° C./sec | Middle side of Formula (C) | Maximum heating temperature ° C. | Maximum heating temperature-Ac1 ° C. | Ac1 ° C. | Ac3-Maximum heating temperature ° C. | Ac3 ° C. | Dwell time 1 sec |
| 79 | 51 | 51 | Y | 3 | 2.83 | 5 | 1.11 | 727 | 21 | 706 | 114 | 841 | 43 |
| 80 | 52 | 52 | Z | 3 | 2.89 | 1 | 1.64 | 757 | 66 | 691 | 26 | 783 | 72 |
| 81 | 52 | 52 | Z | 9 | 2.31 | 2 | 1.30 | 756 | 65 | 691 | 27 | 783 | 45 |
| 82 | 53 | 53 | Z | 4 | 2.72 | 2 | 1.19 | 747 | 56 | 691 | 36 | 783 | 17 |
| 83 | 54 | 54 | AA | 7 | 2.71 | 3 | 1.56 | 804 | 81 | 723 | 32 | 836 | 71 |
| 84 | 55 | 55 | AB | 10 | 2.14 | 2 | 1.83 | 832 | 117 | 715 | 31 | 863 | 96 |
| 85 | 56 | 56 | AC | Test was terminated because a slab was cracked during casting process. | | | | | | | | | |
| 86 | 57 | 57 | AD | Test was terminated because a slab was cracked during casting process. | | | | | | | | | |
| 87 | 58 | 58 | AE | Test was terminated because a slab was cracked during casting process. | | | | | | | | | |
| 88 | 59 | 59 | AF | 4 | 2.74 | 4 | 1.81 | 811 | 55 | 756 | 34 | 845 | 71 |
| 89 | 60 | 60 | AG | Test was terminated because a slab was cracked during casting process. | | | | | | | | | |
| 90 | 61 | 61 | AH | 67 | 1.71 | 3 | 2.05 | 771 | 62 | 709 | 39 | 810 | 101 |
| 91 | 62 | 62 | AI | Test was terminated because a slab was cracked during casting process. | | | | | | | | | |
| 92 | 63 | 63 | AJ | 4 | 2.70 | 1 | 3.02 | 755 | 49 | 706 | 61 | 816 | 73 |
| 93 | 64 | 64 | AK | 10 | 2.14 | 4 | 2.29 | 784 | 63 | 721 | 38 | 822 | 98 |
| 94 | 1A | 1 | A | 18 | 2.20 | 20 | 0.46 | 762 | 65 | 697 | 34 | 796 | 25 |

TABLE 14-continued

| | | | | | | | | | | | | | |
|---|---|---|---|---|---|---|---|---|---|---|---|---|---|
| 95 | 65 | 65 | C | 13 | 1.93 | 4 | 1.06 | 769 | 56 | 713 | 50 | 819 | 113 |
| 96 | 66 | 66 | F | 12 | 2.39 | 3 | 1.58 | 781 | 69 | 712 | 31 | 812 | 40 |
| 97 | 67 | 67 | T | 12 | 2.63 | 3 | 1.19 | 754 | 56 | 698 | 58 | 812 | 45 |
| 98 | 68 | 68 | X | 97 | 1.55 | 1 | 4.02 | 802 | 92 | 710 | 32 | 834 | 13 |
| 99 | 5 | 5 | B | 5 | 2.90 | 7 | 0.87 | 806 | 87 | 719 | 38 | 844 | 69 |
| 100 | 44 | 44 | U | 29 | 2.05 | 0.8 | 5.34 | 770 | 27 | 743 | 178 | 948 | 69 |
| 101 | 39A | 39 | S | 4 | 2.63 | 3 | 1.23 | 763 | 56 | 707 | 49 | 812 | 97 |
| 102 | 44 | 44 | U | 14 | 2.28 | 4 | 2.04 | 805 | 62 | 743 | 143 | 948 | 69 |
| 103 | 67 | 67 | T | 3 | 3.24 | 2 | 1.12 | 760 | 62 | 698 | 52 | 812 | 68 |
| 104 | 18 | 18 | H | 12 | 2.20 | 3 | 1.22 | 795 | 106 | 689 | 42 | 837 | 76 |

| | Main heat treatment Cooling process | | | | | | | | |
|---|---|---|---|---|---|---|---|---|---|
| | | Stop | | | Skin | Tempering treatment | | | |
| Example | Average cooling rate ° C./sec | cooling temperature ° C. | Dwell time 2 sec | Left side of Formula (4) | pass rolling rate % | Treatment temperature ° C. | Treatment time sec | Rolling rate after treatment % | |
| 79 | 34 | 323 | 242 | 0.13 | 0.1 | — | — | — | Comparative |
| 80 | 30 | 368 | 42 | 0.95 | 0.5 | — | — | — | Example |
| 81 | 33 | 456 | 446 | 0.34 | 0.4 | 375 | 516 | 0.1 | Example |
| 82 | 29 | 339 | 73 | 0.79 | 0.8 | — | — | — | Example |
| 83 | 27 | 420 | 135 | 0.19 | 0.3 | — | — | — | Comparative |
| 84 | 29 | 499 | 129 | 0.21 | 0.5 | — | — | — | Comparative |
| 85 | Test was terminated because a slab was cracked during casting process. | | | | | | | | Comparative |
| 86 | Test was terminated because a slab was cracked during casting process. | | | | | | | | Comparative |
| 87 | Test was terminated because a slab was cracked during casting process. | | | | | | | | Comparative |
| 88 | 29 | 355 | 164 | 0.04 | 1.1 | — | — | — | Comparative |
| 89 | Test was terminated because a slab was cracked during casting process. | | | | | | | | Comparative |
| 90 | 28 | 472 | 147 | 0.18 | 0.4 | — | — | — | Comparative |
| 91 | Test was terminated because a slab was cracked during casting process. | | | | | | | | Comparative |
| 92 | 36 | 385 | 142 | 0.20 | 0.5 | — | — | — | Comparative |
| 93 | 87 | 410 | 138 | 0.20 | 0.2 | — | — | — | Comparative |
| 94 | 42 | 458 | 97 | 0.49 | 0.1 | — | — | — | Comparative |
| 95 | 37 | 383 | 45 | 0.73 | 0.4 | — | — | — | Comparative |
| 96 | 28 | 371 | 141 | 0.19 | 0.2 | — | — | — | Example |
| 97 | 30 | 427 | 85 | 0.77 | — | 339 | 8 | 0.3 | Example |
| 98 | 27 | 427 | 29 | 0.28 | 0.4 | — | — | — | Comparative |
| 99 | 28 | 533 | 38 | 0.39 | 0.1 | — | — | — | Comparative |
| 100 | 62 | 449 | 136 | 0.10 | 1.0 | — | — | — | Comparative |
| 101 | 7 | 347 | 140 | 0.21 | 0.5 | — | — | — | Comparative |
| 102 | 61 | 480 | 2030 | 0.03 | 0.1 | — | — | — | Comparative |
| 103 | 94 | 350 | 48 | 0.91 | 0.3 | — | — | — | Comparative |
| 104 | 28 | 418 | 130 | 1.39 | 0.2 | — | — | — | Comparative |

※A value with underline indicates that the value is out of the scope of the invention.

TABLE 15

| | | | | | Hot dip galvanizing | | | Alloying treatment | | |
|---|---|---|---|---|---|---|---|---|---|---|
| Example | Steel sheet for heat treatment | Hot-rolled steel sheet | Chemical component | Surface | Plating bath temperature ° C. | Steel sheet temperature ° C. | Effective amount of Al in plating bath % | Temperature ° C. | Time sec | |
| 7 | 2 | 2 | A | GA | 462 | 453 | 0.09 | 539 | 10 | Example |
| 9 | 3 | 3 | A | EG | | | | | | Example |
| 12 | 5 | 5 | B | GA | 461 | 448 | 0.09 | 547 | 7 | Example |
| 16 | 8 | 8 | C | GI | 465 | 466 | 0.28 | | | Example |
| 21 | 11 | 11 | D | GI | 454 | 461 | 0.12 | | | Example |
| 24 | 14A | 14 | F | GA | 452 | 455 | 0.04 | 493 | 12 | Example |
| 28 | 17 | 17 | G | GI | 461 | 460 | 0.26 | | | Example |
| 32 | 19A | 19 | I | GI | 454 | 459 | 0.32 | | | Example |
| 42 | 25 | 25 | L | EG | | | | | | Example |
| 54 | 34 | 34 | P | GI | 461 | 473 | 0.12 | | | Example |
| 72 | 46A | 46 | V | GA | 453 | 454 | 0.06 | 482 | 42 | Example |
| 78 | 51 | 51 | Y | GA | 457 | 456 | 0.10 | 493 | 27 | Example |
| 82 | 53 | 53 | Z | EG | | | | | | Example |

The microstructures and properties of the obtained high-strength steel sheets are shown in Tables 16 to 23. In the "Surface" in Tables, CR means no plating, and EG, GI, and GA have the same meaning as in Table 15. In the "Structure fraction" column in Tables, acicular a and aggregated a mean acicular ferrite and aggregated ferrite, respectively. Moreover, (martensite), (tempered martensite), and (residual austenite) mean details of the island-shaped hard structure. The total of pearlite and/or cementite is indicated as "Others". In the "island-shaped hard structure" column, the equivalent circle diameter of less than 1.5 μm is indicated as "<1.5 μm", and the equivalent circle diameter of 1.5 μm or more is indicated as "≥1.5 μm". A ratio between the maximum number density and the minimum number density is indicated as a "number density ratio".

TABLE 16

| | | | | | | Microstructure of high-strength steel sheet Structure Fraction | | | | |
|---|---|---|---|---|---|---|---|---|---|---|
| Example | Steel sheet for heat treatment | Hot-rolled steel sheet | Chemical component | Surface | Plate thickness mm | Acicular α % | Aggregated α % | Island-shaped hard structure % | (Martensite) % | (Tempered martensite) % |
| 1 | 1A | 1 | A | CR | 1.1 | 50 | 2 | 29 | 14 | 1 |
| 2 | 1A | 1 | A | CR | 1.1 | 50 | 2 | 39 | 2 | 29 |
| 3 | 1A | 1 | A | CR | 1.1 | 28 | 44 | 21 | 6 | 4 |
| 4 | 1A | 1 | A | CR | 1.1 | 61 | 3 | 20 | 0 | 3 |
| 5 | 1B | 1 | A | CR | 1.1 | 54 | 1 | 24 | 7 | 7 |
| 6 | 2 | 2 | A | CR | 1.2 | 40 | 18 | 22 | 6 | 1 |
| 7 | 2 | 2 | A | GA | 1.2 | 52 | 3 | 37 | 1 | 30 |
| 8 | 3 | 3 | A | CR | 1.5 | 54 | 13 | 24 | 4 | 6 |
| 9 | 3 | 3 | A | EG | 1.5 | 37 | 15 | 24 | 4 | 4 |
| 10 | 4 | 4 | A | CR | 1.9 | 40 | 16 | 35 | 18 | 4 |
| 11 | 4 | 4 | A | CR | 1.9 | 48 | 16 | 22 | 8 | 1 |
| 12 | 5 | 5 | B | GA | 1.6 | 52 | 9 | 20 | 7 | 8 |
| 13 | 6 | 6 | B | CR | 1.6 | 43 | 13 | 21 | 11 | 7 |
| 14 | 7A | 7 | C | CR | 1.3 | 28 | 0 | 37 | 18 | 5 |
| 15 | 7B | 7 | C | CR | 1.3 | 33 | 16 | 29 | 11 | 9 |
| 16 | 8 | 8 | C | GI | 1.7 | 34 | 16 | 42 | 15 | 21 |
| 17 | 8 | 8 | C | CR | 1.7 | 44 | 10 | 20 | 8 | 5 |
| 18 | 9 | 9 | C | CR | 1.7 | 42 | 8 | 37 | 10 | 19 |
| 19 | 10 | 10 | D | CR | 2.0 | 52 | 1 | 21 | 9 | 7 |
| 20 | 11 | 11 | D | CR | 1.2 | 50 | 14 | 21 | 9 | 5 |
| 21 | 11 | 11 | D | GI | 1.2 | 51 | 10 | 22 | 9 | 7 |
| 22 | 12 | 12 | E | CR | 1.9 | 35 | 1 | 28 | 8 | 5 |
| 23 | 13 | 13 | F | CR | 2.0 | 49 | 16 | 21 | 3 | 1 |
| 24 | 14A | 14 | F | GA | 1.7 | 34 | 18 | 41 | 12 | 19 |
| 25 | 14B | 14 | F | CR | 1.7 | 11 | 42 | 28 | 17 | 3 |
| 26 | 15 | 15 | F | CR | 1.6 | 55 | 3 | 24 | 13 | 3 |

| | Microstructure of high-strength steel sheet | | | | | | | | |
|---|---|---|---|---|---|---|---|---|---|
| | | | | | Island-shaped hard structure | | | | |
| | | | | | <1.5 μm | | | | |
| | Structure Fraction | | | | | Number | | | |
| Example | (Residual austenite) % | Bainite % | Bainitic ferrite % | Others % | Average aspect ratio | density $10^{10}$ pieces/$m^2$ | Number density rate | ≥1.5 μm Average aspect ratio | |
| 1 | 14 | 6 | 12 | 1 | 1.2 | 5.4 | 1.3 | 3.0 | Example |
| 2 | 8 | 8 | 1 | 0 | 1.1 | 8.8 | 1.5 | 3.1 | Example |
| 3 | 11 | 4 | 1 | 2 | 1.6 | 5.4 | 1.4 | 1.8 | Comparative |
| 4 | 17 | 2 | 13 | 1 | 3.2 | 0.7 | 1.4 | 3.9 | Comparative |
| 5 | 10 | 8 | 13 | 0 | 3.1 | 2.4 | 1.8 | 4.0 | Comparative |
| 6 | 15 | 2 | 16 | 2 | 1.8 | 6.5 | 1.9 | 3.0 | Example |
| 7 | 6 | 7 | 1 | 0 | 1.5 | 5.6 | 1.8 | 3.7 | Example |
| 8 | 14 | 6 | 3 | 0 | 1.3 | 3.3 | 1.7 | 4.1 | Example |
| 9 | 16 | 3 | 19 | 2 | 1.9 | 8.2 | 1.5 | 3.0 | Example |
| 10 | 13 | 7 | 2 | 0 | 1.9 | 11.3 | 1.6 | 3.1 | Example |
| 11 | 13 | 8 | 5 | 1 | 1.3 | 6.5 | 1.3 | 2.7 | Example |
| 12 | 5 | 2 | 16 | 1 | 1.6 | 8.9 | 2.2 | 3.3 | Example |

TABLE 16-continued

| | | | | | | | | | |
|---|---|---|---|---|---|---|---|---|---|
| 13 | 3 | 5 | 18 | 0 | 2.1 | 3.6 | 1.9 | 3.0 | Comparative |
| 14 | 14 | 5 | 29 | 1 | 1.3 | 19.8 | 2.3 | 3.2 | Example |
| 15 | 9 | 9 | 12 | 1 | 2.7 | 1.6 | 2.2 | 2.9 | Comparative |
| 16 | 6 | 6 | 2 | 0 | 1.2 | 3.7 | 1.9 | 3.0 | Example |
| 17 | 7 | 6 | 9 | 11 | 1.3 | 3.2 | 2.0 | 3.5 | Comparative |
| 18 | 8 | 7 | 2 | 4 | 3.2 | 1.4 | 2.0 | 3.5 | Comparative |
| 19 | 5 | 0 | 25 | 1 | 1.7 | 7.5 | 1.7 | 4.6 | Example |
| 20 | 7 | 0 | 15 | 0 | 1.4 | 6.2 | 1.4 | 3.5 | Example |
| 21 | 6 | 0 | 17 | 0 | 1.7 | 5.3 | 1.7 | 3.2 | Example |
| 22 | 15 | 0 | 36 | 0 | 1.6 | 17.1 | 2.0 | 3.4 | Example |
| 23 | 17 | 1 | 12 | 1 | 1.2 | 6.4 | 2.1 | 3.3 | Example |
| 24 | 10 | 6 | 1 | 0 | 1.8 | 5.0 | 1.8 | 3.0 | Example |
| 25 | 8 | 6 | 12 | 1 | 1.4 | 2.5 | 2.0 | 1.4 | Comparative |
| 26 | 8 | 2 | 15 | 1 | 2.4 | 1.2 | 2.0 | 3.8 | Comparative |

※A value with underline indicates that the value is out of the scope of the invention.

TABLE 17

| | | | | | | Machanical characteristics | | | | Impact characteristics | | |
|---|---|---|---|---|---|---|---|---|---|---|---|---|
| Example | Steel sheet for heat treatment | Hot-rolled steel sheet | Chemical component | Surface | Plate thickness mm | TS MPa | El % | λ % | Left side of Formula (5) | $T_{TR}$ ° C. | $E_B/E_{RT}$ | |
| 1 | 1A | 1 | A | CR | 1.1 | 1075 | 21 | 39 | 4.6 | −70 | 0.36 | Example |
| 2 | 1A | 1 | A | CR | 1.1 | 1128 | 17 | 43 | 4.2 | −90 | 0.57 | Example |
| 3 | 1A | 1 | A | CR | 1.1 | 996 | 20 | 21 | 2.9 | −20 | 0.21 | Comparative |
| 4 | 1A | 1 | A | CR | 1.1 | 875 | 24 | 45 | 4.2 | −60 | 0.21 | Comparative |
| 5 | 1B | 1 | A | CR | 1.1 | 1000 | 20 | 45 | 4.2 | −30 | 0.24 | Comparative |
| 6 | 2 | 2 | A | CR | 1.2 | 928 | 28 | 34 | 4.6 | −50 | 0.26 | Example |
| 7 | 2 | 2 | A | GA | 1.2 | 1074 | 17 | 51 | 4.3 | −90 | 0.45 | Example |
| 8 | 3 | 3 | A | CR | 1.5 | 960 | 22 | 49 | 4.6 | −90 | 0.41 | Example |
| 9 | 3 | 3 | A | EG | 1.5 | 836 | 26 | 51 | 4.5 | −70 | 0.28 | Example |
| 10 | 4 | 4 | A | CR | 1.9 | 1224 | 20 | 25 | 4.3 | −60 | 0.25 | Example |
| 11 | 4 | 4 | A | CR | 1.9 | 1020 | 26 | 28 | 4.5 | −70 | 0.40 | Example |
| 12 | 5 | 5 | B | GA | 1.6 | 735 | 29 | 57 | 4.4 | −70 | 0.32 | Example |
| 13 | 6 | 6 | B | CR | 1.6 | 713 | 29 | 61 | 4.3 | −40 | 0.23 | Comparative |
| 14 | 7A | 7 | C | CR | 1.3 | 1059 | 23 | 35 | 4.7 | −60 | 0.33 | Example |
| 15 | 7B | 7 | C | CR | 1.3 | 1037 | 21 | 35 | 4.1 | −30 | 0.23 | Comparative |
| 16 | 8 | 8 | C | GI | 1.7 | 1317 | 17 | 27 | 4.2 | −70 | 0.39 | Example |
| 17 | 8 | 8 | C | CR | 1.7 | 939 | 14 | 25 | 2.0 | −10 | 0.19 | Comparative |
| 18 | 9 | 9 | C | CR | 1.7 | 1242 | 18 | 26 | 4.0 | 0 | 0.13 | Comparative |
| 19 | 10 | 10 | D | CR | 2.0 | 706 | 35 | 47 | 4.5 | −80 | 0.28 | Example |
| 20 | 11 | 11 | D | CR | 1.2 | 666 | 40 | 41 | 4.4 | −80 | 0.36 | Example |
| 21 | 11 | 11 | D | GI | 1.2 | 683 | 37 | 44 | 4.4 | −70 | 0.30 | Example |
| 22 | 12 | 12 | E | CR | 1.9 | 1206 | 25 | 31 | 5.8 | −60 | 0.30 | Example |
| 23 | 13 | 13 | F | CR | 2.0 | 818 | 32 | 38 | 4.6 | −80 | 0.40 | Example |
| 24 | 14A | 14 | F | GA | 1.7 | 1164 | 19 | 31 | 4.2 | −70 | 0.34 | Example |
| 25 | 14B | 14 | F | CR | 1.7 | 1154 | 15 | 25 | 2.9 | 10 | 0.13 | Comparative |
| 26 | 15 | 15 | F | CR | 1.6 | 983 | 24 | 40 | 4.7 | −40 | 0.22 | Comparative |

※A value with underline indicates that the value is out of the scope of the invention.

TABLE 18

| | | | | | | Microstructure of high-strength steel sheet Structure fraction | | | | |
|---|---|---|---|---|---|---|---|---|---|---|
| Example | Steel sheet for heat treatment | Hot-rolled steel sheet | Chemical component | Surface | Plate thickness mm | Acicular α % | Aggregated α % | Island-shaped hard structure % | (Martensite) % | (Tempered martensite) % |
| 27 | 16 | 16 | G | CR | 1.6 | 58 | 12 | 27 | 17 | 4 |
| 28 | 17 | 17 | G | GI | 0.4 | 72 | 3 | 24 | 10 | 10 |
| 29 | 17 | 17 | G | CR | 0.4 | 60 | 13 | 20 | 13 | 5 |
| 30 | 18 | 18 | H | CR | 0.7 | 58 | 6 | 28 | 22 | 2 |
| 31 | 18 | 18 | H | CR | 0.7 | 34 | 12 | 47 | 6 | 34 |
| 32 | 19A | 19 | I | GI | 2.2 | 28 | 17 | 42 | 6 | 23 |
| 33 | 19B | 19 | I | CR | 2.2 | 46 | 16 | 28 | 18 | 7 |
| 34 | 20 | 20 | I | CR | 1.9 | 50 | 14 | 35 | 17 | 11 |

TABLE 18-continued

| | | | | | | | | | | |
|---|---|---|---|---|---|---|---|---|---|---|
| 35 | 20 | 20 | I | CR | 1.9 | 50 | 12 | 33 | 18 | 12 |
| 36 | 21 | 21 | J | CR | 2.0 | 54 | 14 | 21 | 4 | 5 |
| 37 | 22 | 22 | K | CR | 0.5 | 46 | 1 | 24 | 13 | 0 |
| 38 | 23 | 23 | K | CR | 1.6 | 33 | 0 | 39 | 26 | 7 |
| 39 | 23 | 23 | K | CR | 1.6 | 54 | 2 | 16 | 4 | 0 |
| 40 | 24 | 24 | L | CR | 0.7 | 35 | 18 | 22 | 10 | 2 |
| 41 | 25 | 25 | L | CR | 2.3 | 44 | 14 | 25 | 5 | 10 |
| 42 | 25 | 25 | L | EG | 2.3 | 48 | 16 | 31 | 7 | 15 |
| 43 | 26 | 26 | M | CR | 2.3 | 50 | 3 | 28 | 10 | 8 |
| 44 | 27 | 27 | M | CR | 1.4 | 28 | 10 | 31 | 15 | 8 |
| 46 | 28 | 28 | N | CR | 1.2 | 33 | 0 | 29 | 11 | 1 |
| 47 | 29 | 29 | N | CR | 0.9 | 38 | 0 | 50 | 21 | 21 |
| 49 | 30A | 30 | O | CR | 0.9 | 52 | 2 | 31 | 23 | 2 |
| 50 | 30B | 30 | O | CR | 0.9 | 16 | 47 | 20 | 11 | 4 |
| 51 | 31 | 31 | O | CR | 1.2 | 43 | 13 | 28 | 13 | 6 |
| 52 | 32 | 32 | O | CR | 1.6 | 34 | 18 | 27 | 5 | 17 |

| | Microstructure of high-strength steel sheet | | | | | | | | |
|---|---|---|---|---|---|---|---|---|---|
| | | | | | Island-shaped hard structure | | | | |
| | Structure fraction | | | | <1.5 μm | | | | |
| Example | (Residual austenite) % | Bainite % | Bainitic ferrite % | Others % | Average aspect ratio | Number density $10^{10}$ pieces/$m^2$ | Number density ratio | ≥1.5 μm Average aspect ratio | |
| 27 | 6 | 2 | 1 | 0 | 1.7 | 9.7 | 1.7 | 2.7 | Example |
| 28 | 4 | 1 | 0 | 0 | 1.5 | 1.3 | 1.5 | 3.3 | Example |
| 29 | 2 | 6 | 1 | 0 | 1.3 | 4.5 | 1.8 | 2.9 | Example |
| 30 | 4 | 6 | 2 | 0 | 1.8 | 13.6 | 2.0 | 3.7 | Example |
| 31 | 7 | 5 | 1 | 1 | 1.3 | 7.4 | 2.2 | 3.5 | Example |
| 32 | 13 | 9 | 3 | 1 | 1.8 | 19.9 | 2.0 | 3.8 | Example |
| 33 | 3 | 8 | 2 | 0 | 2.6 | 2.8 | 2.1 | 2.9 | Comparative |
| 34 | 7 | 1 | 0 | 0 | 1.9 | 11.6 | 1.2 | 2.5 | Example |
| 35 | 3 | 4 | 1 | 0 | 1.7 | 9.1 | 1.7 | 3.2 | Example |
| 36 | 12 | 5 | 5 | 1 | 1.3 | 5.5 | 1.5 | 2.7 | Example |
| 37 | 11 | 0 | 28 | 1 | 1.9 | 16.8 | 1.5 | 3.7 | Example |
| 38 | 6 | 11 | 17 | 0 | 1.4 | 11.0 | 2.4 | 3.1 | Example |
| 39 | 12 | 3 | 25 | 0 | 1.3 | 2.5 | 2.4 | 3.5 | Comparative |
| 40 | 10 | 2 | 22 | 1 | 1.5 | 10.3 | 2.0 | 2.8 | Example |
| 41 | 10 | 2 | 15 | 0 | 1.2 | 6.1 | 2.2 | 3.1 | Example |
| 42 | 9 | 4 | 1 | 0 | 1.5 | 6.4 | 2.3 | 3.1 | Example |
| 43 | 10 | 0 | 19 | 0 | 1.3 | 5.0 | 1.7 | 3.9 | Example |
| 44 | 8 | 1 | 29 | 1 | 1.3 | 6.5 | 1.9 | 3.1 | Example |
| 46 | 17 | 0 | 36 | 2 | 1.2 | 3.1 | 1.8 | 4.5 | Example |
| 47 | 8 | 8 | 4 | 0 | 1.6 | 1.9 | 1.9 | 3.9 | Example |
| 49 | 6 | 4 | 10 | 1 | 1.5 | 4.6 | 1.7 | 3.9 | Example |
| 50 | 5 | 1 | 16 | 0 | 1.6 | 1.7 | 1.9 | 1.8 | Comparative |
| 51 | 9 | 0 | 15 | 1 | 1.2 | 9.9 | 2.0 | 3.0 | Example |
| 52 | 5 | 1 | 20 | 0 | 2.6 | 2.3 | 2.0 | 3.1 | Comparative |

X A value with underline indicates that the value is out of the scope of the invention.

TABLE 19

| | | | | | | Characteristics | | | | | | |
|---|---|---|---|---|---|---|---|---|---|---|---|---|
| | | | | | | Machanical characteristics | | | | Impact characteristics | | |
| Example | Steel sheet for heat treatment | Hot-rolled steel sheet | Chemical component | Surface | Plate thickness mm | TS MPa | El % | λ % | Left side of Formula (5) $\times 10^6$ | $T_{TR}$ ° C. | $E_B/E_{RT}$ | |
| 27 | 16 | 16 | G | CR | 1.6 | 989 | 20 | 46 | 4.2 | −60 | 0.29 | Example |
| 28 | 17 | 17 | G | GI | 0.4 | 1055 | 18 | 48 | 4.3 | −80 | 0.36 | Example |
| 29 | 17 | 17 | G | CR | 0.4 | 885 | 24 | 48 | 4.4 | −70 | 0.36 | Example |
| 30 | 18 | 18 | H | CR | 0.7 | 956 | 22 | 48 | 4.5 | −70 | 0.27 | Example |
| 31 | 18 | 18 | H | CR | 0.7 | 962 | 18 | 63 | 4.3 | −80 | 0.52 | Example |
| 32 | 19A | 19 | I | GI | 2.2 | 991 | 24 | 36 | 4.5 | −80 | 0.36 | Example |
| 33 | 19B | 19 | I | CR | 2.2 | 1226 | 22 | 21 | 4.3 | −30 | 0.18 | Comparative |
| 34 | 20 | 20 | I | CR | 1.9 | 1218 | 20 | 25 | 4.3 | −60 | 0.28 | Example |
| 35 | 20 | 20 | I | CR | 1.9 | 1139 | 20 | 30 | 4.2 | −70 | 0.31 | Example |
| 36 | 21 | 21 | J | CR | 2.0 | 938 | 24 | 42 | 4.5 | −70 | 0.39 | Example |
| 37 | 22 | 22 | K | CR | 0.5 | 1055 | 22 | 39 | 4.7 | −60 | 0.26 | Example |

TABLE 19-continued

| Example | Steel sheet for heat treatment | Hot-rolled steel sheet | Chemical component | Surface | Plate thickness mm | Characteristics: Machanical characteristics: TS MPa | El % | λ % | Left side of Formula (5) ×10^6 | Impact characteristics: $T_{TR}$ ° C. | $E_B/E_{RT}$ | |
|---|---|---|---|---|---|---|---|---|---|---|---|---|
| 38 | 23 | 23 | K | CR | 1.6 | 1349 | 19 | 24 | 4.6 | −60 | 0.31 | Example |
| 39 | 23 | 23 | K | CR | 1.6 | 812 | 26 | 43 | 3.9 | −60 | 0.37 | Comparative |
| 40 | 24 | 24 | L | CR | 0.7 | 863 | 30 | 36 | 4.6 | −50 | 0.34 | Example |
| 41 | 25 | 25 | L | CR | 2.3 | 909 | 32 | 28 | 4.6 | −70 | 0.39 | Example |
| 42 | 25 | 25 | L | EG | 2.3 | 1092 | 20 | 35 | 4.3 | −70 | 0.35 | Example |
| 43 | 26 | 26 | M | CR | 2.3 | 774 | 30 | 55 | 4.8 | −70 | 0.41 | Example |
| 44 | 27 | 27 | M | CR | 1.4 | 839 | 26 | 54 | 4.6 | −60 | 0.38 | Example |
| 46 | 28 | 28 | N | CR | 1.2 | 900 | 28 | 42 | 4.9 | −70 | 0.41 | Example |
| 47 | 29 | 29 | N | CR | 0.9 | 1380 | 21 | 29 | 5.8 | −70 | 0.34 | Example |
| 49 | 30A | 30 | O | CR | 0.9 | 906 | 24 | 50 | 4.6 | −70 | 0.28 | Example |
| 50 | 30B | 30 | O | CR | 0.9 | 765 | 26 | 28 | 2.9 | −30 | 0.23 | Comparative |
| 51 | 31 | 31 | O | CR | 1.2 | 666 | 42 | 38 | 4.4 | −70 | 0.42 | Example |
| 52 | 32 | 32 | O | CR | 1.6 | 822 | 28 | 46 | 4.5 | −30 | 0.24 | Comparative |

※A value with underline indicates that the value is out of the scope of the invention.

TABLE 20

| Example | Steel sheet for heat treatment | Hot-rolled steel sheet | Chemical component | Surface | Plate thickness mm | Microstructure of high-strength steel sheet Structure fraction: Acicular α % | Aggregated α % | Island-shaped hard structure % | (Martensite) % | (Tempered martensite) % |
|---|---|---|---|---|---|---|---|---|---|---|
| 53 | 33 | 33 | P | CR | 1.6 | 57 | 4 | 23 | 0 | 10 |
| 54 | 34 | 34 | P | GI | 1.7 | 28 | 1 | 25 | 12 | 2 |
| 55 | 34 | 34 | P | CR | 1.7 | 0 | 15 | 59 | 18 | 34 |
| 56 | 35A | 35 | Q | CR | 1.2 | 29 | 18 | 43 | 7 | 28 |
| 57 | 35B | 35 | Q | CR | 1.2 | 36 | 15 | 30 | 7 | 7 |
| 58 | 36 | 36 | Q | CR | 0.9 | 29 | 17 | 29 | 5 | 3 |
| 59 | 37 | 37 | R | CR | 1.1 | 32 | 0 | 29 | 17 | 4 |
| 60 | 38 | 38 | R | CR | 1.5 | 21 | 2 | 50 | 3 | 36 |
| 61 | 38 | 38 | R | CR | 1.5 | 30 | 1 | 58 | 2 | 53 |
| 62 | 39A | 39 | S | CR | 2.3 | 36 | 17 | 30 | 15 | 4 |
| 63 | 39B | 39 | S | CR | 2.3 | 19 | 45 | 22 | 4 | 5 |
| 64 | 40 | 40 | S | CR | 1.7 | 39 | 1 | 51 | 10 | 36 |
| 65 | 40 | 40 | S | CR | 1.7 | 0 | 9 | 49 | 23 | 15 |
| 66 | 41A | 41 | T | CR | 2.0 | 61 | 4 | 28 | 8 | 17 |
| 67 | 41B | 41 | T | CR | 2.0 | 16 | 58 | 20 | 14 | 2 |
| 68 | 42 | 42 | T | CR | 1.6 | 48 | 17 | 26 | 12 | 4 |
| 69 | 43 | 43 | T | CR | 1.2 | 46 | 15 | 23 | 7 | 11 |
| 70 | 44 | 44 | U | CR | 2.0 | 28 | 3 | 28 | 13 | 9 |
| 71 | 45 | 45 | V | CR | 2.0 | 38 | 17 | 32 | 8 | 4 |
| 72 | 46A | 46 | V | GA | 0.7 | 33 | 17 | 29 | 6 | 2 |
| 73 | 46B | 46 | V | CR | 0.7 | 53 | 4 | 28 | 1 | 5 |
| 74 | 47 | 47 | V | CR | 1.5 | 37 | 14 | 33 | 10 | 6 |
| 75 | 48 | 48 | W | CR | 2.0 | 60 | 13 | 20 | 10 | 2 |
| 76 | 49 | 49 | X | CR | 1.0 | 31 | 18 | 28 | 0 | 17 |
| 77 | 50 | 50 | Y | CR | 0.9 | 36 | 8 | 48 | 9 | 30 |
| 78 | 51 | 51 | Y | GA | 1.3 | 44 | 18 | 21 | 0 | 15 |

| Example | Microstructure of high-strength steel sheet: Structure fraction: (Residual austenite) % | Bainite % | Bainitic ferrite % | Others % | Island-shaped hard structure <1.5 μm: Average aspect ratio | Number density $10^{10}$ pieces/$m^2$ | Number density rate | ≥1.5 μm Average aspect ratio | |
|---|---|---|---|---|---|---|---|---|---|
| 53 | 13 | 0 | 15 | 1 | 1.2 | 8.1 | 1.6 | 4.4 | Example |
| 54 | 11 | 0 | 44 | 2 | 1.7 | 9.8 | 2.0 | 3.7 | Example |

TABLE 20-continued

| | | | | | | | | | |
|---|---|---|---|---|---|---|---|---|---|
| 55 | 7 | 5 | 21 | 0 | 1.4 | 0.4 | 1.7 | 1.3 | Comparative |
| 56 | 8 | 8 | 2 | 0 | 1.3 | 13.3 | 1.3 | 3.2 | Example |
| 57 | 16 | 1 | 17 | 1 | 3.8 | 2.1 | 1.6 | 3.3 | Comparative |
| 58 | 21 | 0 | 24 | 1 | 1.3 | 16.1 | 1.6 | 2.9 | Example |
| 59 | 8 | 8 | 30 | 1 | 1.4 | 16.0 | 2.1 | 4.0 | Example |
| 60 | 11 | 14 | 13 | 0 | 1.5 | 5.4 | 2.4 | 4.3 | Example |
| 61 | 3 | 10 | 1 | 0 | 1.7 | 12.7 | 2.1 | 3.9 | Example |
| 62 | 11 | 6 | 11 | 0 | 1.7 | 23.2 | 1.6 | 2.8 | Example |
| 63 | 13 | 2 | 12 | 0 | 1.8 | 2.8 | 1.4 | 1.7 | Comparative |
| 64 | 5 | 6 | 2 | 1 | 1.4 | 7.1 | 2.0 | 4.6 | Example |
| 65 | 11 | 7 | 34 | 1 | 1.3 | 3.1 | 2.0 | 1.7 | Comparative |
| 66 | 3 | 4 | 1 | 2 | 1.2 | 11.5 | 1.3 | 3.3 | Example |
| 67 | 4 | 4 | 0 | 2 | 1.3 | 1.7 | 1.4 | 1.8 | Comparative |
| 68 | 10 | 8 | 1 | 0 | 1.1 | 3.7 | 1.8 | 3.7 | Example |
| 69 | 5 | 5 | 7 | 4 | 4.1 | 1.4 | 2.1 | 3.1 | Comparative |
| 70 | 6 | 5 | 34 | 2 | 1.1 | 24.9 | 2.0 | 2.2 | Example |
| 71 | 20 | 1 | 12 | 0 | 1.3 | 6.2 | 1.4 | 3.1 | Example |
| 72 | 21 | 0 | 20 | 1 | 1.1 | 13.5 | 1.4 | 3.4 | Example |
| 73 | 22 | 0 | 15 | 0 | 3.6 | 2.3 | 1.8 | 3.4 | Comparative |
| 74 | 17 | 1 | 14 | 1 | 2.7 | 1.7 | 2.1 | 3.4 | Comparative |
| 75 | 8 | 3 | 4 | 0 | 1.5 | 4.4 | 1.9 | 2.6 | Example |
| 76 | 11 | 2 | 20 | 1 | 1.4 | 4.5 | 2.3 | 2.8 | Example |
| 77 | 9 | 6 | 1 | 1 | 1.4 | 3.4 | 1.5 | 3.2 | Example |
| 78 | 6 | 3 | 13 | 1 | 1.9 | 8.4 | 2.1 | 2.9 | Example |

X A value with underline indicates that the value is out of the scope of the invention.

TABLE 21

| | | | | | | Characteristics | | | | | | |
|---|---|---|---|---|---|---|---|---|---|---|---|---|
| | | | | | | Machanical characteristics | | | | | | |
| | Steel sheet | Hot-rolled | | | Plate | | | | Left side of | Impact characteristics | | |
| Example | for heat treatment | steel sheet | Chemical component | Surface | thickness mm | TS MPa | El % | λ % | Formula (5) $\times 10^6$ | $T_{TR}$ ° C. | $E_B/E_{RT}$ | |
| 53 | 33 | 33 | P | CR | 1.6 | 752 | 36 | 40 | 4.7 | −90 | 0.46 | Example |
| 54 | 34 | 34 | P | GI | 1.7 | 759 | 32 | 50 | 4.7 | −60 | 0.30 | Example |
| 55 | 34 | 34 | P | CR | 1.7 | 1015 | 15 | 16 | 1.9 | 20 | 0.27 | Comparative |
| 56 | 35A | 35 | Q | CR | 1.2 | 1444 | 16 | 24 | 4.3 | −80 | 0.44 | Example |
| 57 | 35B | 35 | Q | CR | 1.2 | 1086 | 22 | 28 | 4.2 | −20 | 0.23 | Comparative |
| 58 | 36 | 36 | Q | CR | 0.9 | 1005 | 30 | 27 | 5.0 | −50 | 0.37 | Example |
| 59 | 37 | 37 | R | CR | 1.1 | 910 | 26 | 44 | 4.7 | −70 | 0.33 | Example |
| 60 | 38 | 38 | R | CR | 1.5 | 1011 | 22 | 43 | 4.6 | −80 | 0.45 | Example |
| 61 | 38 | 38 | R | CR | 1.5 | 1114 | 17 | 67 | 5.2 | −80 | 0.43 | Example |
| 62 | 39A | 39 | S | CR | 2.3 | 1036 | 29 | 23 | 4.6 | −60 | 0.32 | Example |
| 63 | 39B | 39 | S | CR | 2.3 | 924 | 24 | 32 | 3.8 | −20 | 0.22 | Comparative |
| 64 | 40 | 40 | S | CR | 1.7 | 1313 | 20 | 23 | 4.6 | −90 | 0.45 | Example |
| 65 | 40 | 40 | S | CR | 1.7 | 1121 | 19 | 17 | 2.9 | 0 | 0.19 | Comparative |
| 66 | 41A | 41 | T | CR | 2.0 | 1123 | 18 | 40 | 4.3 | −80 | 0.39 | Example |
| 67 | 41B | 41 | T | CR | 2.0 | 1062 | 21 | 28 | 3.8 | −30 | 0.27 | Comparative |
| 68 | 42 | 42 | T | CR | 1.6 | 986 | 22 | 43 | 4.5 | −80 | 0.40 | Example |
| 69 | 43 | 43 | T | CR | 1.2 | 814 | 25 | 48 | 4.0 | −10 | 0.16 | Comparative |
| 70 | 44 | 44 | U | CR | 2.0 | 938 | 22 | 49 | 4.4 | −60 | 0.44 | Example |
| 71 | 45 | 45 | V | CR | 2.0 | 997 | 31 | 25 | 4.9 | −50 | 0.40 | Example |
| 72 | 46A | 46 | V | GA | 0.7 | 887 | 34 | 30 | 4.9 | −60 | 0.48 | Example |
| 73 | 46B | 46 | V | CR | 0.7 | 868 | 31 | 37 | 4.8 | 0 | 0.13 | Comparative |
| 74 | 47 | 47 | V | CR | 1.5 | 1073 | 26 | 28 | 4.8 | −20 | 0.24 | Comparative |
| 75 | 48 | 48 | W | CR | 2.0 | 787 | 31 | 40 | 4.3 | −60 | 0.34 | Example |
| 76 | 49 | 49 | X | CR | 1.0 | 847 | 32 | 34 | 4.6 | −70 | 0.38 | Example |
| 77 | 50 | 50 | Y | CR | 0.9 | 1045 | 19 | 44 | 4.3 | −80 | 0.48 | Example |
| 78 | 51 | 51 | Y | GA | 1.3 | 764 | 29 | 54 | 4.5 | −70 | 0.27 | Example |

X A value with underline indicates that the value is out of the scope of the invention.

TABLE 22

| Example | Steel sheet for heat treatment | Hot-rolled steel sheet | Chemical component | Surface | Plate thickness mm | Microstructure of high-strength steel sheet Structure fraction: Acicular α % | Aggregated α % | Island-shaped hard structure % | (Martensite) % | (Tempered martensite) % |
|---|---|---|---|---|---|---|---|---|---|---|
| 79 | 51 | 51 | Y | CR | 1.3 | 48 | 15 | 21 | 12 | 1 |
| 80 | 52 | 52 | Z | CR | 1.0 | 22 | 18 | 55 | 9 | 44 |
| 81 | 52 | 52 | Z | CR | 1.0 | 28 | 18 | 28 | 0 | 17 |
| 82 | 53 | 53 | Z | EG | 2.1 | 35 | 17 | 44 | 13 | 27 |
| 83 | 54 | 54 | AA | CR | 2.0 | 47 | 16 | 22 | 13 | 1 |
| 84 | 55 | 55 | AB | CR | 2.0 | 15 | 33 | 13 | 8 | 2 |
| 85 | 56 | 56 | AC | Test was terminated because a slab was cracked during casting process. | | | | | | |
| 86 | 57 | 57 | AD | Test was terminated because a slab was cracked during casting process. | | | | | | |
| 87 | 58 | 58 | AE | Test was terminated because a slab was cracked during casting process. | | | | | | |
| 88 | 59 | 59 | AF | CR | 2.0 | 9 | 45 | 9 | 5 | 0 |
| 89 | 60 | 60 | AG | Test was terminated because a slab was cracked during casting process. | | | | | | |
| 90 | 61 | 61 | AH | CR | 2.0 | 44 | 8 | 27 | 9 | 4 |
| 91 | 62 | 62 | AI | Test was terminated because a slab was cracked during casting process. | | | | | | |
| 92 | 63 | 63 | AJ | CR | 2.0 | 55 | 8 | 22 | 8 | 6 |
| 93 | 64 | 64 | AK | CR | 2.0 | 47 | 1 | 27 | 9 | 8 |
| 94 | 1A | 1 | A | CR | 1.1 | 52 | 7 | 23 | 5 | 6 |
| 95 | 65 | 65 | C | CR | 2.5 | 23 | 17 | 38 | 5 | 26 |
| 96 | 66 | 66 | F | CR | 1.9 | 48 | 9 | 23 | 5 | 2 |
| 97 | 67 | 67 | T | CR | 1.0 | 59 | 16 | 20 | 4 | 9 |
| 98 | 68 | 68 | X | CR | 1.9 | 0 | 56 | 29 | 11 | 12 |
| 99 | 5 | 5 | B | CR | 1.0 | 49 | 11 | 35 | 15 | 16 |
| 100 | 44 | 44 | U | CR | 2.0 | 43 | 14 | 25 | 1 | 9 |
| 101 | 39A | 39 | S | CR | 2.3 | 26 | 26 | 26 | 11 | 6 |
| 102 | 44 | 44 | U | CR | 2.0 | 50 | 4 | 11 | 2 | 0 |
| 103 | 67 | 67 | T | CR | 1.0 | 41 | 17 | 37 | 15 | 19 |
| 104 | 18 | 18 | H | CR | 0.7 | 41 | 9 | 43 | 9 | 34 |

| Example | Microstructure of high-strength steel sheet: Structure fraction: (Residual austenite) % | Bainite % | Bainitic ferrite % | Others % | Island-shaped hard structure: <1.5 μm: Average aspect ratio | Number density $10^{10}$ pieces/$m^2$ | Number density rate | ≥1.5 μm Average aspect ratio | |
|---|---|---|---|---|---|---|---|---|---|
| 79 | 8 | 0 | 5 | 11 | 1.8 | 1.2 | 2.1 | 3.1 | Comparative |
| 80 | 2 | 4 | 1 | 0 | 1.2 | 6.3 | 1.9 | 2.7 | Example |
| 81 | 11 | 2 | 23 | 1 | 1.3 | 21.0 | 1.9 | 2.5 | Example |
| 82 | 4 | 4 | 0 | 0 | 1.8 | 8.2 | 2.3 | 3.0 | Example |
| 83 | 8 | 2 | 12 | 1 | 2.2 | 0.5 | 2.3 | 2.7 | Comparative |
| 84 | 3 | 13 | 25 | 1 | 2.3 | 0.0 | — | 1.8 | Comparative |
| 85 | Test was terminated because a slab was cracked during casting process. | | | | | | | | Comparative |
| 86 | Test was terminated because a slab was cracked during casting process. | | | | | | | | Comparative |
| 87 | Test was terminated because a slab was cracked during casting process. | | | | | | | | Comparative |
| 88 | 4 | 8 | 21 | 4 | 1.7 | 2.4 | 1.9 | 1.5 | Comparative |
| 89 | Test was terminated because a slab was cracked during casting process. | | | | | | | | Comparative |
| 90 | 14 | 1 | 19 | 1 | 1.7 | 12.6 | 1.5 | 3.3 | Comparative |
| 91 | Test was terminated because a slab was cracked during casting process. | | | | | | | | Comparative |
| 92 | 8 | 1 | 14 | 0 | 1.1 | 9.2 | 1.7 | 3.4 | Comparative |
| 93 | 10 | 2 | 22 | 1 | 1.5 | 15.5 | 1.5 | 3.9 | Comparative |
| 94 | 12 | 2 | 16 | 0 | 2.8 | 0.2 | 1.5 | 3.7 | Comparative |
| 95 | 7 | 8 | 14 | 0 | 1.8 | 2.3 | 2.7 | 2.9 | Comparative |
| 96 | 16 | 1 | 19 | 0 | 1.9 | 6.8 | 1.8 | 4.0 | Example |
| 97 | 7 | 3 | 1 | 1 | 1.3 | 2.3 | 1.8 | 3.2 | Example |
| 98 | 6 | 1 | 8 | 0 | 1.8 | 25.4 | 1.7 | 1.5 | Comparative |
| 99 | 4 | 5 | 0 | 0 | 2.2 | 0.8 | 2.1 | 3.2 | Comparative |
| 100 | 15 | 0 | 18 | 0 | 2.4 | 0.2 | 1.8 | 1.8 | Comparative |
| 101 | 9 | 15 | 17 | 0 | 1.6 | 8.7 | 1.5 | 1.9 | Comparative |
| 102 | 9 | 0 | 35 | 0 | 1.1 | 17.9 | 2.0 | 3.3 | Comparative |
| 103 | 3 | 4 | 1 | 0 | 2.5 | 0.6 | 1.5 | 2.8 | Comparative |
| 104 | 0 | 6 | 1 | 0 | 1.5 | 7.1 | 2.3 | 3.0 | Comparative |

※A value with underline indicates that the value is out of the scope of the invention.

TABLE 23

| Example | Steel sheet for heat treatment | Hot-rolled steel sheet | Chemical component | Surface | Plate thickness mm | Machanical characteristics TS MPa | El % | λ % | Left side of Formula (5) ×10^6 | Impact characteristics $T_{TR}$ ° C. | $E_B/E_{RT}$ | |
|---|---|---|---|---|---|---|---|---|---|---|---|---|
| 79 | 51 | 51 | Y | CR | 1.3 | 734 | 19 | 24 | 1.9 | −30 | 0.14 | Comparative |
| 80 | 52 | 52 | Z | CR | 1.0 | 1365 | 15 | 31 | 4.2 | −80 | 0.58 | Example |
| 81 | 52 | 52 | Z | CR | 1.0 | 952 | 29 | 30 | 4.7 | −60 | 0.40 | Example |
| 82 | 53 | 53 | Z | EG | 2.1 | 1504 | 16 | 32 | 5.3 | −70 | 0.31 | Example |
| 83 | 54 | 54 | AA | CR | 2.0 | 805 | 26 | 49 | 4.2 | −40 | 0.18 | Comparative |
| 84 | 55 | 55 | AB | CR | 2.0 | 545 | 28 | 36 | 2.1 | — | — | Comparative |
| 85 | 56 | 56 | AC | Test was terminated because a slab was cracked during casting process. | | | | | | | | Comparative |
| 86 | 57 | 57 | AD | Test was terminated because a slab was cracked during casting process. | | | | | | | | Comparative |
| 87 | 58 | 58 | AE | Test was terminated because a slab was cracked during casting process. | | | | | | | | Comparative |
| 88 | 59 | 59 | AF | CR | 2.0 | 574 | 31 | 28 | 2.3 | — | — | Comparative |
| 89 | 60 | 60 | AG | Test was terminated because a slab was cracked during casting process. | | | | | | | | Comparative |
| 90 | 61 | 61 | AH | CR | 2.0 | 914 | 13 | 16 | 1.4 | −20 | 0.09 | Comparative |
| 91 | 62 | 62 | AI | Test was terminated because a slab was cracked during casting process. | | | | | | | | Comparative |
| 92 | 63 | 63 | AJ | CR | 2.0 | 894 | 16 | 23 | 2.1 | −30 | 0.15 | Comparative |
| 93 | 64 | 64 | AK | CR | 2.0 | 967 | 7 | 9 | 0.6 | 10 | 0.05 | Comparative |
| 94 | 1A | 1 | A | CR | 1.1 | 931 | 25 | 40 | 4.5 | −30 | 0.23 | Comparative |
| 95 | 65 | 65 | C | CR | 2.5 | 1026 | 22 | 41 | 4.6 | −50 | 0.24 | Comparative |
| 96 | 66 | 66 | F | CR | 1.9 | 921 | 30 | 32 | 4.7 | −70 | 0.27 | Example |
| 97 | 67 | 67 | T | CR | 1.0 | 836 | 27 | 45 | 4.4 | −80 | 0.40 | Example |
| 98 | 68 | 68 | X | CR | 1.9 | 1014 | 19 | 23 | 2.9 | −10 | 0.17 | Comparative |
| 99 | 5 | 5 | B | CR | 1.0 | 923 | 19 | 64 | 4.3 | −60 | 0.23 | Comparative |
| 100 | 44 | 44 | U | CR | 2.0 | 973 | 22 | 31 | 3.7 | −40 | 0.24 | Comparative |
| 101 | 39A | 39 | S | CR | 2.3 | 964 | 19 | 26 | 2.9 | −20 | 0.20 | Comparative |
| 102 | 44 | 44 | U | CR | 2.0 | 682 | 29 | 50 | 3.7 | −80 | 0.43 | Comparative |
| 103 | 67 | 67 | T | CR | 1.0 | 1108 | 19 | 34 | 4.1 | −40 | 0.23 | Comparative |
| 104 | 18 | 18 | H | CR | 0.7 | 999 | 12 | 64 | 3.0 | −70 | 0.49 | Comparative |

※A value with underline indicates that the value is out of the scope of the invention.

A tensile test and a hole expansion test are performed in order to evaluate the strength and the formability. A No. 5 test piece described in JIS Z 2201 is produced. In accordance with JIS Z 2241, the tensile test is performed with a tensile axis in line with a width direction of the steel sheet. The hole expansion test is performed in accordance with JIS Z 2256.

In a high-strength steel sheet with tensile strength of 590 MPa or more, when a formula (5) below consisting of the maximum tensile strength TS (MPa), total elongation El (%), and hole expandability λ (%) is satisfied, the steel sheet was judged to have excellent formability-strength balance.

$$TS^{1.5} \times El \times \lambda^{0.5} \geq 4.0 \times 10^6 \quad (5)$$

Charpy impact test is conducted in order to evaluate toughness. When a thickness of a steel sheet was less than 2.5 mm, a laminated Charpy test piece is produced by laminating the steel sheets until a total thickness thereof exceeds 5.0 mm, fastening the laminated steel sheets with bolts, and giving a V notch of 2-mm depth thereto. Other conditions are in accordance with JIS Z 2242.

When a ductile-brittle transition temperature $T_{TR}$ at which a brittle fracture surface ratio was 50% or more was −50 degrees C. or less, and a ratio $E_B/E_{RT}$ of shock absorption energy $E_B$ after brittle transition to shock absorption energy $E_{RT}$ at the room temperature is 0.25 or more, the steel sheet is judged to have an excellent toughness.

Experimental Example a 83 to 93 are comparative examples in which the cast steel sheets had chemical compositions falling out of the ranges of the invention and a predetermined base steel sheet for heat treatment and a predetermined high-strength steel sheet were not obtained.

Experimental Example 84 is an example in which C contained in the steel sheet was less than 0.080 mass %, and the lath structure and a predetermined carbide were not obtained in the steel sheet for heat treatment, and a sufficient amount of the island-shaped hard structure was not obtained in the high-strength steel sheet. TS (tensile strength) was inferior in Experimental Example 84. Since the number density of the island-shaped hard structure with a equivalent circle diameter of less than 1.5 μm was 0.0, the number density ratio was not evaluated.

Experimental Example 85 is an example in which C contained in the steel sheet exceeded 0.500 mass %. Since slab was cracked in the casting process, the steel sheet for heat treatment and the high-strength steel sheet were not obtained. Experimental Example 86 is an example in which Si contained in the steel sheet exceeded 2.50 mass %. Since slab was cracked in the casting process, the steel sheet for heat treatment and the high-strength steel sheet were not obtained.

Experimental Example 87 is an example in which Mn contained in the steel sheet exceeded 5.00 mass %. Since slab was cracked in the casting process, the steel sheet for heat treatment and the high-strength steel sheet were not obtained. Experimental Example 88 is an example in which Mn contained in the steel sheet was less than 0.50 mass %, and the lath structure was not sufficiently obtained in the steel sheet for heat treatment, and a sufficient amount of the acicular ferrite was not obtained in the high-strength steel sheet. The strength-formability balance and impact resistance were inferior in Experimental Example 88.

Experimental Example 89 is an example in which P contained in the steel sheet exceeded 0.100 mass %. Since slab was cracked in the casting process, the steel sheet for heat treatment and the high-strength steel sheet were not obtained. Experimental Example 90 is an example in which S contained in the steel sheet exceeded 0.0100 mass %, and formability of the steel sheet for heat treatment and the high-strength steel sheet was significantly lowered due to generation of a large amount of inclusions.

Experimental Example 91 is an example in which Al contained in the steel sheet exceeded 2.000 mass %. Since slab was cracked in the casting process, the steel sheet for heat treatment and the high-strength steel sheet were not obtained.

Experimental Example 92 is an example in which N contained in the steel sheet exceeded 0.0150 mass %, and formability of the steel sheet for heat treatment and the high-strength steel sheet was significantly lowered due to generation of a large amount of coarse nitrides.

Experimental Example 93 is an example in which N contained in the steel sheet exceeded 0.0150 mass %, and formability of the steel sheet for heat treatment and the high-strength steel sheet was significantly lowered due to generation of a large amount of coarse nitrides. Experimental Example 83 is an example in which the chemical composition of the steel sheet did not satisfy the formula (1), a carbide density of the steel sheet for heat treatment became insufficient, and the aspect ratio of the fine island-shaped hard structure became large and the impact resistance was lowered in the high-strength steel sheet.

Experimental Example 13, 18, 26, 52, 69, 74 are comparative examples in which the manufacturing conditions fell out of the range of the invention in the hot rolling process for manufacturing the steel sheet for heat treatment, the steel sheet for heat treatment having a predetermined microstructure was not obtained, and the properties after the main heat treatment became inferior.

Experimental Example 95 (steel sheet for heat treatment 65) did not satisfy the formula (A), the microstructure of the hot-rolled steel sheet became inhomogeneous, and impact resistance was lowered since the island-shaped hard structure was inhomogeneously dispersed in the steel sheet after the main heat treatment.

Experimental Example 52 (steel sheet for heat treatment 32) and

Experimental Example 74 (steel sheet for heat treatment 47) are examples in which the cooling conditions did not satisfy the formula (2) in the hot rolling process, a carbide density of the steel sheet for heat treatment became insufficient, and the aspect ratio of the fine island-shaped hard structure became large and the impact resistance was lowered in the high-strength steel sheet.

Experimental Example 13 (steel sheet for heat treatment 6) and Experimental Example 26 (steel sheet for heat treatment 15) are examples in which the temperature history from the hot rolling to the heat treatment did not satisfy the lower limit of the formula (3), a carbide density of the steel sheet for heat treatment became insufficient, and the aspect ratio of the fine island-shaped hard structure became large and the impact resistance was lowered in the high-strength steel sheet.

Experimental Example 18 (steel sheet for heat treatment 9) and Experimental Example 69 (steel sheet for heat treatment 43) are examples in which the temperature history from the hot rolling to the heat treatment did not satisfy the upper limit of the formula (3), coarse carbides remained in the steel sheet for heat treatment and the carbide density became insufficient in the steel sheet for heat treatment. Accordingly, the formability of the steel sheet for heat treatment is lowered, and the aspect ratio of the fine island-shaped hard structure becomes large and the impact resistance is lowered in the high-strength steel sheet.

Experimental Example 5, 15, 25, 33, 50, 57, 63, 67, 73, and 98 are comparative examples in which the manufacturing conditions fell out of the range of the invention in the manufacturing process of the steel sheet for heat treatment by subjecting the hot-rolled steel sheet to the intermediate heat treatment, the steel sheet for heat treatment having a predetermined microstructure was not obtained, and the properties after the main heat treatment became inferior.

Experimental Example 5 (steel sheet for heat treatment 1B) and Experimental Example 73 (steel sheet for heat treatment 46B) are examples in which the average heating rate was slow in the temperature region from 650 degrees C. to (Ac3−40) degrees C., a carbide density of the steel sheet for heat treatment became insufficient, and the aspect ratio of the fine island-shaped hard structure became large and the impact resistance was lowered in the high-strength steel sheet.

Experimental Example 25 (steel sheet for heat treatment 14B) and Experimental Example 50 (steel sheet for heat treatment 30B) are examples in which the maximum heating temperature was low, a sufficient amount of the lath structure was not obtained in the steel sheet for heat treatment, and strength-formability balance and impact resistance were lowered in the high-strength steel sheet.

Experimental Example 57 (steel sheet for heat treatment 35B) is an example in which the maximum heating temperature was high and the carbide density became insufficient in the steel sheet for heat treatment. Accordingly, in the steel sheet for heat treatment, C is solid-dissolved excessively and the formability of the steel sheet for heat treatment becomes inferior. Moreover, the aspect ratio of the fine island-shaped hard structure becomes large and the impact resistance is lowered in the high-strength steel sheet.

Experimental Example 15 (steel sheet for heat treatment 7B) and Experimental Example 33 (steel sheet for heat treatment 19B) are examples in which the dwell time at the maximum heating temperature was long, and the carbide density became insufficient in the steel sheet for heat treatment. Accordingly, in the steel sheet for heat treatment, C is solid-dissolved excessively and the formability of the steel sheet for heat treatment becomes inferior. Moreover, the aspect ratio of the fine island-shaped hard structure becomes large and the impact resistance is lowered in the high-strength steel sheet.

In Experimental Example 63 (steel sheet for heat treatment 39B) and Experimental Example 67 (steel sheet for heat treatment 41B), the cooling rate in a range from 750 degrees C. to 450 degrees C. was slow, and a ratio of aggregated ferrite was high in the steel sheet for heat treatment, so that the lath structure was not obtained. Therefore, the strength-formability balance and impact resistance of the high-strength steel sheet were lowered in the high-strength steel sheet.

Experimental Example 98 (steel sheet for heat treatment 68) is an example in which the cold rolling ratio of the steel sheet for heat treatment was high. Since the lath structure collapsed in the steel sheet for heat treatment, a predetermined microstructure was not obtained in the high-strength steel sheet, so that the strength-formability balance and impact resistance were lowered.

Among Experimental Examples shown in Tables 7 to 9, the steel sheets except for the steel sheets of the above comparative examples are the steel sheets for heat treatment of the invention and can provide a high-strength steel sheet excellent in formability and impact resistance by being subjected to a predetermined heat treatment of the invention.

Experimental Example 3, 4, 17, 39, 45, 48, 55, 65, 79, 94, and 99 to 104 are examples in which the heating conditions of the main heat treatment for the steel sheet for heat treatment of the invention fell out of the range of the invention, so that the high-strength steel sheet excellent in formability and impact resistance was not obtained.

Experimental Examples 4 and 48 are examples in which the heating rate in the temperature region from 450 degrees C. to 650 degrees C. was insufficient, and the aspect ratio of the fine island-shaped hard structure became large in the high-strength steel sheet, so that the impact resistance was lowered.

Experimental Example 45 is an example in which the heating rate in the temperature region from 650 degrees C. to 750 degrees C. was excessively large, and the aspect ratio of the fine island-shaped hard structure became large and the impact resistance was lowered in the high-strength steel sheet. Experimental Example 17 and 79 are examples in which the maximum heating temperature was low, and a large amount of carbides remained undissolved, so that strength, formability, and/or impact resistance were lowered in the high-strength steel sheet.

Experimental Example 55 is an example in which the maximum heating temperature was high, the lath structure completely disappeared, and the strength-formability balance and the impact resistance were lowered in the high-strength steel sheet. Experimental Examples 39 and 80 are examples in which the dwell time at the maximum heating temperature was long, and the lath structure completely disappeared, so that the strength-formability balance and the impact resistance were lowered in the high-strength steel sheet.

Experimental Examples 3 and 101 are examples in which the average cooling rate in the temperature region from 700 degrees C. to 550 degrees C. was insufficient, and aggregated ferrite was excessively generated, so that the strength-formability balance and the impact resistance were lowered in the high-strength steel sheet.

Experimental Examples 51 and 102 are examples in which the dwell time in the temperature region from 550 degrees C. to 300 degrees C. was long, transformation excessively progressed, and the island-shaped hard structure was not obtained, so that the strength-formability balance was lowered in the high-strength steel sheet.

Experimental Examples 94 and 99 are examples in which the value of the formula (C) was excessively low and the number density of the fine island-shaped hard structure was insufficient in the high-strength steel sheet, so that the impact resistance was lowered.

Experimental Example 100 is a example in which the value of the formula (C) was excessively high, the coarse and aggregated having a small aspect ratio developed, so that the strength-formability balance and the impact resistance were lowered in the high-strength steel sheet.

Experimental Examples 4 and 103 in which the formula (B) was not satisfied and the isotropic and fine island-shaped structure was be sufficiently obtained, so that the impact resistance was lowered in the high-strength steel sheet.

Experimental Example 104 is an example in which the formula (4) was not satisfied and residual austenite was not obtained, so that the strength-formability balance was lowered in the high-strength steel sheet.

Among Experimental Examples shown in Tables 19 to 267, the steel sheets except for the steel sheets of the above comparative examples are the high-strength steel sheet of the invention excellent in the formability and the impact resistance. It is understood that according to the manufacturing conditions of the invention, a high-strength steel sheet excellent in the formability and the impact resistance can be obtained.

Experimental Example 47 (steel sheet for heat treatment 29) is an example in which in manufacturing the steel sheet for heat treatment, since the formula (2) was not satisfied in the hot rolling process, the hot-rolled steel sheet was heated to the Ac3 or more and then cooled and tempered under the conditions satisfying the formulae (2) and (3), and subsequently was subjected to the heat treatment as shown in Tables 4 to 6 to provide the steel sheet for heat treatment of the invention, and the steel sheet for heat treatment of the invention was further subjected to the heat treatment as shown in Tables 10 to 17 to provide the high-strength steel sheet of the invention excellent in formability and impact resistance. Only in this Experimental Example, the results in the heating and cooling processes after the hot rolling are indicated in columns of the formulae (2) and (3) in Table 2.

Experimental Examples 16, 21, 28, 32 and 54 are examples in which a high-strength galvanized steel sheet of the invention excellent in formability and impact resistance was obtained by immersing the steel sheet in a hot-dip zinc bath. Experimental Examples 16 and 21 are examples in which the steel sheet was immersed in a zinc bath immediately after dwelling in the temperature range of 550 degrees C. to 300 degrees C. is completed, and cooled to room temperature.

On the other hand, Experimental Examples 28 and 32 are examples in which the steel sheet was immersed in a zinc bath while dwelling in the temperature range of 550 degrees C. to 300 degrees C. Experimental Example 32 is an example in which after the steel sheet is subjected to the heat treatment shown in Tables 10 to 17, the steel sheet was immersed in a zinc bath concurrently with being subjected to the tempering treatment.

Experimental Examples 7, 12, 24, 72, and 78 are examples in which the high-galvannealed steel sheet of the invention excellent in formability and impact resistance can be obtained by immersing the steel sheet in a molten zinc bath and subsequently subjecting the steel sheet to the alloying treatment.

Experimental Examples 12 and 24 are examples in which the steel sheet was immersed in a zinc bath immediately after the completion of the dwell treatment in the temperature region ranging from 550 to 300 degrees C., subjected to the alloying treatment, and then cooled to the room temperature.

Experimental Example 72 is an example in which the steel sheet was immersed in a zinc bath while dwelling in the temperature region ranging from 550 to 300 degrees C., then alloyed after the dwell treatment was completed, and cooled to the room temperature. Experimental Example 78 is an example in which the steel sheet was immersed in a zinc bath while dwelling in the temperature region ranging from 550 to 300 degrees C., then cooled to the room temperature after the dwell treatment was completed, and concurrently subjected to the tempering treatment and the alloying treatment. Experimental Example 7 is an example in which after the steel sheet was subjected to the heat treatment shown in Tables 10 to 17, the steel sheet was immersed in a zinc bath immediately before the tempering treatment and were concurrently subjected to the tempering treatment and the alloying treatment.

Experimental Examples 9, 42, and 82 are examples in which the high-strength galvanized steel sheet of the invention excellent in formability and impact resistance was obtained by an electroplating treatment. Experimental Examples 42 and 82 are examples in which after the steel sheet was subjected to the heat treatment shown in Tables 10 to 17, the steel sheet was subjected to the electroplating treatment. Experimental Example 9 is an example in which after the steel sheet was subjected to the heat treatment shown in Tables 10 to 17, the steel sheet was subjected to the electroplating treatment and further to the tempering treatment shown in Tables 10 to 17.

As described above, according to the invention, a high-strength steel sheet excellent in formability and impact resistance can be provided. Since the high-strength steel sheet of the invention is a steel sheet suitable for a significant weight reduction in an automobile and to secure protection and safety of a passenger, the invention is highly applicable to the steel sheet manufacturing industry and the automobile industry.

EXPLANATION OF CODES

1 aggregated ferrite
2 coarse island-shaped hard structure (aspect ratio: small)
3 acicular ferrite
4 coarse island-shaped hard structure (aspect ratio: large)
5 fine island-shaped hard structure (aspect ratio: small)

The invention claimed is:

1. A high-strength steel sheet excellent in formability and impact resistance, the high-strength steel sheet comprising a chemical composition comprising: by mass %, C in a range from 0.080 to 0.500%;
Si of 2.50% or less;
Mn in a range from 0.50 to 5.00%;
P of 0.100% or less;
S of 0.0100% or less;
Al in a range from 0.001 to 2.000%;
N of 0.0150% or less;
O of 0.0050% or less; and
a balance comprising Fe and inevitable impurities, and in a steel sheet satisfying a formula (1), the high-strength steel sheet comprising a microstructure in a region from ⅛t (t: sheet thickness) to ⅜t (t: sheet thickness) from a steel sheet surface, the microstructure comprising:

by volume %,
20% or more of acicular ferrite;
20% or more of an island-shaped hard structure comprising one or more of martensite, tempered martensite, and residual austenite,
2% to 25% of residual austenite;
20% or less of aggregated ferrite; and
5% or less of pearlite and/or cementite in total, wherein in the island-shaped hard structure, an average aspect ratio of a hard region having an equivalent circle diameter of 1.5 μm or more is 2.0 or more, and an average aspect ratio of a hard region having an equivalent circle diameter of less than 1.5 μm is less than 2.0, and an average of a number density per unit area of the hard region having the equivalent circle diameter of less than 1.5 μm is equal to or more than $1.0\times10^{10}$ pieces·$m^{-2}$, and when the number density of the island-shaped hard structure in an area of at least $5.0\times10^{-10}$ $m^2$ in each of three view fields is obtained, a ratio between a maximum number density and a minimum number density thereof is 2.5 or less, $$[Si]+0.35[Mn]+0.15[Al]+2.80[Cr]+0.84[Mo]+0.50[Nb]+0.30[Ti]\geq1.00 \quad (1)$$

[element]: mass % of each element.

2. The high-strength steel sheet excellent in formability and impact resistance according to claim 1, wherein the chemical composition further comprises: by mass %, one or more of Ti of 0.300% or less, Nb of 0.100% or less, and V of 1.00% or less.

3. The high-strength steel sheet excellent in formability and impact resistance according to claim 1, wherein the chemical composition further comprises: by mass %, one or more of Cr of 2.00% or less, Ni of 2.00% or less, Cu of 2.00% or less, Mo of 1.00% or less, W of 1.00% or less, and B of 0.0100% or less.

4. The high-strength steel sheet excellent in formability and impact resistance according to claim 1, wherein the chemical composition further comprises: by mass %, one or more of Sn of 1.00% or less, and Sb of 0.200% or less.

5. The high-strength steel sheet excellent in formability and impact resistance according to claim 1, wherein the chemical composition further comprises: by mass %, one or more of Ca, Ce, Mg, Zr, La, Hf, and REM being 0.0100% or less in total.

6. The high-strength steel sheet excellent in formability and impact resistance according to claim 1, wherein the high-strength steel sheet comprises a galvanized layer or a zinc alloy plated layer on one surface or both surfaces of the high-strength steel sheet.

7. The high-strength steel sheet excellent in formability and impact resistance according to claim 6, wherein the galvanized layer or the zinc alloy plated layer is an alloyed plated layer.

8. The high-strength steel sheet according to claim 1, wherein the chemical composition further comprises, by mass %:

Ti: 0.008% or less.

9. A manufacturing method of the high-strength steel sheet excellent in formability and impact resistance according to claim 1, the method comprising: providing a steel sheet for heat treatment by performing:

a hot rolling process of heating a cast slab comprising components according to claim 1 to a temperature in a range from 1080 degrees C. to 1300 degrees C., and subsequently subjecting the cast slab to hot rolling, in which hot rolling conditions in a temperature region from a maximum heating temperature to 1000 degrees C. satisfy a formula (A) and a hot rolling completion temperature falls in a range from 975 degrees C. to 850 degrees C.;

a cooling process in which cooling conditions applied from the completion of the hot rolling to 600 degrees C. satisfy a formula (2) that represents a sum of transformation progress degrees in 15 temperature regions obtained by equally dividing a temperature region ranging from the hot rolling completion temperature to 600 degrees C., and a temperature history that is measured by every 20 degrees C. from a time when 600 degrees C. is reached to a time when an intermediate heat treatment below is started satisfies a formula (3);

a cold rolling process of cold rolling at a rolling reduction of 80% or less; and an intermediate heat treatment process comprising: heating the cold-rolled cast slab to a temperature in a range from (Ac3−30) degrees C. to (Ac3+100) degrees C. at an average heating rate of at least 30 degrees C. per second in a temperature region ranging from 650 degrees C. to (Ac3−40) degrees C.; limiting a dwell time in a temperature region ranging from the heating temperature to (maximum heating temperature −10) degrees C. to 100 seconds or less; and subsequently cooling the cast slab from the heating temperature at an average cooling rate of at least 30 degrees C. per second in a temperature region ranging from 750 degrees C. to 450 degrees C.; and performing a main heat treatment process comprising:

heating the steel sheet for heat treatment to a temperature ranging from (Ac1+25) degrees C. to an Ac3 point so that a temperature history from 450 degrees C. to 650 degrees C. satisfies a formula (B) below and subsequently a temperature history from 650 degrees C. to 750 degrees C. satisfies a formula (C) below;

retaining the steel sheet for heat treatment for 150 seconds or less at the heating temperature;

cooling the steel sheet for heat treatment from the heating retention temperature to a temperature region ranging from 550 degrees C. to 300 degrees C. at an average cooling rate of at least 10 degrees C. per second in a temperature region from 700 degrees C. to 550 degrees C.;

setting a dwell time in the temperature region from 550 degrees C. to 300 degrees C. to 1000 seconds or less; and setting dwell conditions in the temperature region from 550 degrees C. to 300 degrees C. to satisfy a formula (4) below, $$\sum_{i=1}^{n}\left[A\cdot\frac{h_i-h_{i-1}}{h_i}\cdot\exp\left(-\frac{B}{T_i+273}\right)\cdot t^{0.5}\right]\geqq 1.00 \quad \text{(A)}$$

n: rolling pass number up to 1000 degrees C. after removal from a heating furnace $h_i$: finishing sheet thickness [mm] after i pass Ti: rolling temperature [degrees C.] at the i pass ti: elapsed time [second] after the rolling at the i pass to an (i+1) pass $A=9.11\times10^7, B=2.72\times10^4$:constant value $$\left(\sum_{n=1}^{15}\left[\frac{1.88\times10^2}{1+17\mathrm{Ti}+51\mathrm{Nb}+3.3\sqrt{\mathrm{Mo}}+35\sqrt{\mathrm{B}}}\cdot\exp\left\{36.1-(0.0424-0.0027n)Tf-1.64n-14.4\mathrm{C}+0.62\mathrm{Si}-1.36\mathrm{Mn}+0.82\mathrm{Al}-0.62\mathrm{Cr}-0.62\mathrm{Ni}-\frac{2.85\times10^4}{253+(1.033-0.067n)Tf+40n}\right\}\cdot t(n)^{0.25}\right]\right)^{0.333}\leq 1.00 \quad (2)$$

t(n): dwell time [second] in the n-th temperature region element symbol: mass % of the element Tf: hot rolling completion temperature [degrees C.]

$$1.00\leq\left[\frac{T_n\cdot\{\log_{10}(t_n)+\mathrm{C}\}}{1.50\times10^4}\right]^2\leq 1.50 \quad (3)$$

$$t_1=\Delta t_1\ (n=1)$$

$$t_n=\Delta t_n+\frac{T_{n-1}}{T_n}\cdot\{\log_{10}(t_{n-1})+\mathrm{C}\}\ (n>1)$$

$$\mathrm{C}=20.00-1.28\cdot\mathrm{Si}^{0.5}-0.13\cdot\mathrm{Mn}^{0.5}-0.47\cdot\mathrm{Al}^{0.5}-1.20\cdot\mathrm{Ti}-2.50\cdot\mathrm{Nb}-0.82\cdot\mathrm{Cr}^{0.5}-1.70\cdot\mathrm{Mo}^{0.5}$$

$T_n$: an average steel sheet temperature [degrees C.] from the (n−1)th calculation time point to the n-th calculation time point $t_n$: effective total time [hour] for carbide growth at the n-th calculation $\Delta t_n$: an elapsed time [hour] from the (n−1)th calculation time point to the n-th calculation time point C: parameters related to a growth rate of carbides (element symbol: mass % of element)

$$a_0=1.00 \quad \text{(B)}$$

$$a_n=\frac{\mathrm{F}}{C_n}\cdot t_n^{\left(\frac{1}{K}\right)}+10^{\left(\frac{354+5n}{359+5n}\cdot\log_{10}a_{n-1}\right)}$$

$$\mathrm{K}+\log_{10}a_{20}\leq 3.20$$

$$C_n:\left\{1.28+34\cdot\left(1-\frac{89+2n}{130}\right)^2\right\}\cdot\mathrm{Si}^{0.5}+0.13\cdot\mathrm{Mn}^{0.5}+0.47\cdot\mathrm{Al}^{0.5}+0.82\cdot\mathrm{Cr}^{0.5}+1.70\cdot\mathrm{Mo}^{0.5}$$

each element of the chemical composition represents an added amount [mass %],

F: constant value, 2.57

$t_n$: elapsed time [second] from (440+10n) degrees C. to (450+10n) degrees C.

K: a value of a middle side of the formula (3)

$$1.00\leq\sum_{n=1}^{10}\frac{M}{\mathrm{N}+\mathrm{P}}\cdot\exp\left(-\frac{Q}{918+10n}\right)\cdot t_n^{0.5}\leq 5.00 \quad \text{(C)}$$

M: constant value, $5.47\times10^{10}$

N: a value of the left side of the formula (B)

P: 0.38Si+0.64Cr+0.34Mo each element of the chemical composition represents an added amount [mass %], Q: $2.43\times10^4$ $t_n$: elapsed time [second] from (640+10n) degrees C. to (650+10n) degrees C.

$$\left[\sum_{n=1}^{10}1.29\times10^2\cdot\left\{\mathrm{Si}+0.9\mathrm{Al}\cdot\left(\frac{T(n)}{550}\right)^2+0.3(\mathrm{Cr}+1.5\mathrm{Mo})\cdot\frac{T(n)}{550}\right\}\cdot(B_s-T(n))^3\cdot\exp\left(-\frac{1.44\times10^4}{T(n)+273}\right)\cdot t^{0.5}\right]^{-1}\leq 1.00 \quad (4)$$

T(n): an average temperature of the steel sheet in an n-th time zone obtained by equally dividing the dwell time into 10 parts Bs point (degrees C.)=611−33[Mn]−17[Cr]−17[Ni]−21[Mo]
−11[Si]+30[Al]+(24[Cr]+15[Mo]
+5500[B]+240[Nb])/(8[C])

[element]: mass % of each element, at $B_s<T(n)$, (Bs−T(n))=0 t: total [seconds] of a dwell time in the temperature region from 550 degrees C. to 300 degrees C.

10. The manufacturing method according to claim 9, further comprising subjecting the steel sheet for heat treatment to cold rolling at a rolling reduction of 15.0% or less before the main heat treatment process.

11. The manufacturing method according to claim 9, further comprising heating the high-strength steel sheet to a temperature in a range from 200 degrees C. to 600 degrees C. to be tempered.

12. The manufacturing method according to claim 9, further comprising subjecting the high-strength steel sheet to skin pass rolling at a rolling reduction of 2.0% or less.

13. The method according to claim 9 for manufacturing the high-strength steel sheet comprising a chemical composition comprising: by mass %, C in a range from 0.080 to 0.500%;
Si of 2.50% or less;
Mn in a range from 0.50 to 5.00%;
P of 0.100% or less;
S of 0.0100% or less;
Al in a range from 0.001 to 2.000%;
N of 0.0150% or less;
O of 0.0050% or less; and
a balance comprising Fe and inevitable impurities, and in a steel sheet satisfying a formula (1),
the high-strength steel sheet comprising a microstructure in a region from ⅛t (t: sheet thickness) to ⅜t (t: sheet thickness) from a steel sheet surface, the microstructure comprising: by volume %,
20% or more of acicular ferrite;
20% or more of an island-shaped hard structure comprising one or more of martensite, tempered martensite, and residual austenite,
2% to 25% of the residual austenite;
20% or less of aggregated ferrite; and
5% or less of pearlite and/or cementite in total, wherein
in the island-shaped hard structure, an average aspect ratio of a hard region having an equivalent circle diameter of 1.5 μm or more is 2.0 or more, and an average aspect ratio of a hard region having an equivalent circle diameter of less than 1.5 μm is less than 2.0,
an average of a number density per unit area (hereinafter also simply referred to as "the number density") of the hard region having the equivalent circle diameter of less than 1.5 μm is equal to or more than $1.0\times10^{10}$ pieces·$m^{-2}$, and when the number density of the island-shaped hard structure in an area of at least $5.0\times10^{-10}$ $m^2$ in each of three view fields is obtained, a ratio between a maximum number density and a minimum number density thereof is 2.5 or less, and $$[Si]+0.35[Mn]+0.15[Al]+2.80[Cr]+0.84[Mo]+0.50[Nb]+0.30[Ti]\geq1.00 \quad (1)$$

[element]: mass % of each element,
the high-strength steel sheet comprises a galvanized layer or a zinc alloy plated layer on one surface or both surfaces of the high-strength steel sheet, the method comprising:
immersing the high-strength steel sheet dwelling in the temperature region in the range from 550 degrees C. to 300 degrees C. in a plating bath comprising zinc as a main component to form the galvanized layer or the zinc alloy plated layer on one surface or both surfaces of the steel sheet.

14. The method according to claim 13 for manufacturing a high-strength steel sheet comprising a chemical composition comprising: by mass %, C in a range from 0.080 to 0.500%;
Si of 2.50% or less;
Mn in a range from 0.50 to 5.00%;
P of 0.100% or less;
S of 0.0100% or less;
Al in a range from 0.001 to 2.000%;
N of 0.0150% or less;
O of 0.0050% or less; and
a balance comprising Fe and inevitable impurities, and in a steel sheet satisfying a formula (1),
the high-strength steel sheet comprising a microstructure in a region from ⅛t (t: sheet thickness) to ⅜t (t: sheet thickness) from a steel sheet surface, the microstructure comprising: by volume %,
20% or more of acicular ferrite;
20% or more of an island-shaped hard structure comprising one or more of martensite, tempered martensite, and residual austenite,
2% to 25% of the residual austenite;
20% or less of aggregated ferrite; and
5% or less of pearlite and/or cementite in total, wherein
in the island-shaped hard structure, an average aspect ratio of a hard region having an equivalent circle diameter of 1.5 μm or more is 2.0 or more, and an average aspect ratio of a hard region having an equivalent circle diameter of less than 1.5 μm is less than 2.0,
an average of a number density per unit area (hereinafter also simply referred to as "the number density") of the hard region having the equivalent circle diameter of less than 1.5 μm is equal to or more than $1.0\times10^{10}$ pieces·$m^{-2}$, and when the number density of the island-shaped hard structure in an area of at least $5.0\times10^{10}$ $m^2$ in each of three view fields is obtained, a ratio between a maximum number density and a minimum number density thereof is 2.5 or less, $$[Si]+0.35[Mn]+0.15[Al]+2.80[Cr]+0.84[Mo]+0.50[Nb]+0.30[Ti]\geq1.00 \quad (1)$$

[element]: mass % of each element,
the high-strength steel sheet comprises a galvanized layer or a zinc alloy plated layer on one surface or both surfaces of the high-strength steel sheet, and
the galvanized layer or the zinc alloy plated layer is an alloyed plated layer,
the method comprising:
heating the galvanized layer or the zinc alloy plated layer to a temperature in a range from 400 degrees C. to 600 degrees C. to apply an alloying treatment to the galvanized layer or the zinc alloy plated layer.

15. A method of manufacturing a high-strength steel sheet comprising a chemical composition comprising: by mass %, C in a range from 0.080 to 0.500%;
Si of 2.50% or less;
Mn in a range from 0.50 to 5.00%;
P of 0.100% or less;
S of 0.0100% or less;
Al in a range from 0.001 to 2.000%;
N of 0.0150% or less;
O of 0.0050% or less; and
a balance comprising Fe and inevitable impurities, and in a steel sheet satisfying a formula (1),
the high-strength steel sheet comprising a microstructure in a region from ⅛t (t: sheet thickness) to ⅜t (t: sheet thickness) from a steel sheet surface, the microstructure comprising: by volume %,
20% or more of acicular ferrite;
20% or more of an island-shaped hard structure comprising one or more of martensite, tempered martensite, and residual austenite,
2% to 25% of the residual austenite;
20% or less of aggregated ferrite; and 5% or less of pearlite and/or cementite in total, wherein in the island-shaped hard structure, an average aspect ratio of a hard region having an equivalent circle diameter of 1.5 μm or more is 2.0 or more, and an average aspect ratio of a hard region having an equivalent circle diameter of less than 1.5 μm is less than 2.0, an average of a number density per unit area (hereinafter also simply referred to as "the number density") of the hard region having the equivalent circle diameter of less than 1.5 μm is equal to or more than $1.0\times10^{10}$ pieces·$m^{-2}$, and when the number density of the island-shaped hard structure in an area of at least $5.0\times10^{-10}$ $m^2$ in each of three view fields is obtained, a ratio between a maximum number density and a minimum number density thereof is 2.5 or less, and $$[Si]+0.35[Mn]+0.15[Al]+2.80[Cr]+0.84[Mo]+0.50[Nb]+0.30[Ti]\geq1.00 \quad (1)$$

[element]: mass % of each element, the high-strength steel sheet comprises a galvanized layer or a zinc alloy plated layer on one surface or both surfaces of the high-strength steel sheet, the method comprising:

immersing the high-strength steel sheet excellent in formability and impact resistance in the manufacturing method according to claim 9 in a plating bath comprising zinc as a main component to form the galvanized layer or the zinc alloy plated layer on one surface or both surfaces of the steel sheet.

16. A method of manufacturing a high-strength steel sheet comprising a chemical composition comprising: by mass %, C in a range from 0.080 to 0.500%;

Si of 2.50% or less;

Mn in a range from 0.50 to 5.00%;

P of 0.100% or less;

S of 0.0100% or less;

Al in a range from 0.001 to 2.000%;

N of 0.0150% or less;

O of 0.0050% or less; and a balance comprising Fe and inevitable impurities, and in a steel sheet satisfying a formula (1), the high-strength steel sheet comprising a microstructure in a region from ⅛t (t: sheet thickness) to ⅜t (t: sheet thickness) from a steel sheet surface, the microstructure comprising: by volume %, 20% or more of acicular ferrite;

20% or more of an island-shaped hard structure comprising one or more of martensite, tempered martensite, and residual austenite, 2% to 25% of the residual austenite;

20% or less of aggregated ferrite; and

5% or less of pearlite and/or cementite in total, wherein in the island-shaped hard structure, an average aspect ratio of a hard region having an equivalent circle diameter of 1.5 μm or more is 2.0 or more, and an average aspect ratio of a hard region having an equivalent circle diameter of less than 1.5 μm is less than 2.0, an average of a number density per unit area (hereinafter also simply referred to as "the number density") of the hard region having the equivalent circle diameter of less than 1.5 μm is equal to or more than $1.0\times10^{10}$ pieces·$m^{-2}$, and when the number density of the island-shaped hard structure in an area of at least $5.0\times10^{-10}$ $m^2$ in each of three view fields is obtained, a ratio between a maximum number density and a minimum number density thereof is 2.5 or less, and $$[Si]+0.35[Mn]+0.15[Al]+2.80[Cr]+0.84[Mo]+0.50[Nb]+0.30[Ti]\geq1.00 \quad (1)$$

[element]: mass % of each element, the high-strength steel sheet comprises a galvanized layer or a zinc alloy plated layer on one surface or both surfaces of the high-strength steel sheet, the method comprising:

forming, by electroplating, the galvanized layer or the zinc alloy plated layer on one surface or both surfaces of the high-strength steel sheet excellent in formability and impact resistance in the manufacturing method according to claim 9.

17. The method according to claim 16 for manufacturing a high-strength steel sheet comprising a chemical composition comprising: by mass %, C in a range from 0.080 to 0.500%;

Si of 2.50% or less;

Mn in a range from 0.50 to 5.00%;

P of 0.100% or less;

S of 0.0100% or less;

Al in a range from 0.001 to 2.000%;

N of 0.0150% or less;

O of 0.0050% or less; and a balance comprising Fe and inevitable impurities, and in a steel sheet satisfying a formula (1), the high-strength steel sheet comprising a microstructure in a region from ⅛t (t: sheet thickness) to ⅜t (t: sheet thickness) from a steel sheet surface, the microstructure comprising: by volume %, 20% or more of acicular ferrite;

20% or more of an island-shaped hard structure comprising one or more of martensite, tempered martensite, and residual austenite, 2% to 25% of the residual austenite;

20% or less of aggregated ferrite; and

5% or less of pearlite and/or cementite in total, wherein in the island-shaped hard structure, an average aspect ratio of a hard region having an equivalent circle diameter of 1.5 μm or more is 2.0 or more, and an average aspect ratio of a hard region having an equivalent circle diameter of less than 1.5 μm is less than 2.0, an average of a number density per unit area (hereinafter also simply referred to as "the number density") of the hard region having the equivalent circle diameter of less than 1.5 μm is equal to or more than $1.0\times10^{10}$ pieces·$m^{-2}$, and when the number density of the island-shaped hard structure in an area of at least $5.0\times10^{-10}$ $m^2$ in each of three view fields is obtained, a ratio between a maximum number density and a minimum number density thereof is 2.5 or less, $$[Si]+0.35[Mn]+0.15[Al]+2.80[Cr]+0.84[Mo]+0.50[Nb]+0.30[Ti]\geq1.00 \quad (1)$$

[element]: mass % of each element, the high-strength steel sheet comprises a galvanized layer or a zinc alloy plated layer on one surface or both surfaces of the high-strength steel sheet, and the galvanized layer or the zinc alloy plated layer is an alloyed plated layer, the method comprising:

heating the galvanized layer or the zinc alloy plated layer to a temperature in a range from 400 degrees C. to 600 degrees C. to apply an alloying treatment to the galvanized layer or the zinc alloy plated layer.

* * * * *